US007500663B2

(12) United States Patent
Higaki et al.

(10) Patent No.: US 7,500,663 B2
(45) Date of Patent: Mar. 10, 2009

(54) BOOKMAKING APPARATUS AND IMAGE FORMING APPARATUS EQUIPPED WITH THE SAME

(75) Inventors: Akiharu Higaki, Yamanashi (JP); Hiroshi Nakagomi, Minami Alps (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 377 days.

(21) Appl. No.: 11/452,947

(22) Filed: Jun. 15, 2006

(65) Prior Publication Data

US 2007/0003346 A1 Jan. 4, 2007

(30) Foreign Application Priority Data

Jun. 15, 2005 (JP) ..... 2005-175647

(51) Int. Cl.
*B65H 37/04* (2006.01)

(52) U.S. Cl. ..... 270/58.12; 370/32; 370/58.07; 370/58.08; 370/58.09; 370/58.11; 370/58.17

(58) Field of Classification Search ..... 270/32, 270/52.18, 58.07, 58.08, 58.09, 58.11, 58.12, 270/58.17; 412/4, 8, 18, 19, 22, 37
See application file for complete search history.

(56) References Cited

U.S. PATENT DOCUMENTS

| | | | | |
|---|---|---|---|---|
| 5,232,324 | A * | 8/1993 | Graushar | 412/4 |
| 5,316,425 | A * | 5/1994 | Graushar et al. | 412/19 |
| 5,881,352 | A * | 3/1999 | Kobayashi et al. | 399/408 |
| 6,386,812 | B2 * | 5/2002 | Garlichs et al. | 412/19 |
| 6,497,544 | B1 * | 12/2002 | Schmucker et al. | 412/17 |
| 6,717,286 | B2 * | 4/2004 | Tsuchiya et al. | 270/58.07 |
| 7,413,179 | B2 * | 8/2008 | Honmochi et al. | 270/58.11 |
| 2004/0181308 | A1 * | 9/2004 | Hayashi et al. | 700/223 |

* cited by examiner

*Primary Examiner*—Gene Crawford
*Assistant Examiner*—Leslie A Nicholson, III
(74) *Attorney, Agent, or Firm*—Manabu Kanesaka

(57) ABSTRACT

A bookmaking apparatus creates a booklet by accurately positioning a sheet bundle of varied thickness and a cover sheet fed at cross-over directions. The bookmaking apparatus includes an intersecting first path and a second path, a sheet bundle conveyance device, a cover sheet conveyance device, a first and second path cross-over unit, and a joining stage. The cover sheet conveyance device includes a first aligning device for aligning a conveyance direction edge of the cover sheet and a second aligning device for positioning an edge at a direction intersecting the conveyance direction of the cover sheet.

15 Claims, 50 Drawing Sheets

BOOKMAKING APPARATUS AND IMAGE FORMING APPARATUS EQUIPPED WITH THE SAME

The present Application claims priority to Japanese Patent Application No. 2005-175647 and hereby incorporated by reference in its entirety.

BACKGROUND OF THE INVENTION

The present invention relates to a bookmaking apparatus in a bookmaking system that aligns sheets printed by an image forming apparatus in a bundle on a tray in the proper page order and binds the sheet bundle to create a booklet.

Generally, this kind of apparatus is widely used as a terminal device of an image forming apparatus such as a printer or printing machine, to stack sheets formed with images in page order. After aligning the sheets into a booklet, a bookmaking system applies adhesive to one edge of the stacked booklet and binds the stacked booklet to a cover sheet. Of particular note, recently there are many systems that print and finish a predetermined booklet by printing predetermined information and automatically binding and covering the booklet, then cutting the edges of sheets, as an on-demand printing system, such as electronic publishing.

Such a system is proposed in Japanese Patent Application Publication No. 2004-209869 ("869") to automatically create a booklet of sheets output from an image forming apparatus. In this publication, sheets output from an image forming apparatus are received from a discharge outlet and guided to a discharge path where they are stacked and stored in a tray equipped at a lower side of the discharge outlet. The sheet bundle stacked on the tray in a horizontal posture is turned 90 degrees and then guided to an adhesive application unit in a vertical posture for gluing. The glued sheet bundle is then folded around and glued to a cover sheet supplied from an inserter device. After adhesion of the sheet bundle and cover, sheet bundle sides not glued to the sheet bundle are trimmed to finish the booklet. The finished booklet is then stored in a stacker.

In the 869 system, at a cross-over unit comprising a path for conveying a sheet bundle and a path for conveying a cover sheet, both sheets are joined in a substantially upside-down T-shape, and when folding a cover sheet over a back side surface of the sheet bundle, it is necessary to position the sheet bundle and cover sheet with the correct posture.

Positioning of both sheets is done at a joining stage formed at a cross-over unit of both paths. In other words, when conveying a sheet bundle and positioning it at a cover sheet, a sheet bundle conveyance mechanism, e.g., a gripping conveyance mechanism, is often utilized to convey the sheet bundle in front and back directions and left and right width directions of the cover sheet. When conveying the other cover sheet, a mechanism for conveying a cover sheet fed to the joining stage in the front and back directions of the conveyance direction, and for conveying in the left and right width directions is equipped. Such a mechanism requires a complex configuration to be embedded in the area around the joining stage and as a result many bookmaking apparatuses are set to one particular sheet size.

As mentioned above, positioning the sheet bundle and cover sheet at the joining stage requires positional adjustments to both the sheet bundle and cover sheet, resulting in a complex sheet joining unit. Particularly, a folding mechanism comprising rollers for folding a cover sheet to a backside of a sheet bundle at a downstream side, results in large and complex sheet joining unit.

Therefore, the present invention positions a cover sheet in the width direction according to a sheet size upstream of the sheet joining stage and then aligning the length direction of sheets. The cover sheet is then conveyed for a predetermined amount according to the thickness of the sheet bundle. Therefore, the present invention provides a bookmaking apparatus that can accurately position a sheet bundle and cover sheet fed at cross-over directions using a simple mechanism. Furthermore, the present invention provides a bookmaking apparatus that enables the bookmaking of a wide range of sheet types that vary in size, while enabling bookmaking of sheet bundles that vary in thicknesses.

SUMMARY OF THE INVENTION

The present invention employs the following configuration to solve the problems described above.

A first aspect of the present invention is a bookmaking apparatus comprising a first path and a second path that intersect each other, sheet bundle conveyance means for conveying a sheet bundle along the first path, cover sheet conveyance means for conveying a cover sheet along the second path, a cross-over unit for the first and the second paths, and a joining stage for joining the sheet bundle and cover sheet. The sheet bundle and cover sheet are joined in a substantially upside-down T-shape, wherein the cover sheet conveyance means is equipped with a first aligning means for aligning a conveyance direction edge of a cover sheet and a second aligning means for positioning an edge at a direction intersecting the conveyance of the cover sheet. The first and the second aligning means are arranged on the second path at an upstream side of the joining stage, and the cover sheet conveyance means is equipped with offset conveyance means capable of adjusting a conveyance amount of a cover sheet positioned by the first and the second aligning means according to a length direction of the sheet conveyance to the joining stage at a downstream side.

A second aspect of the present invention comprises an adhesive application means for applying adhesive to a sheet bundle on the first path. The adhesive application means is disposed at an upstream side of the joining stage, such as in the configuration of the first aspect, and comprises folding conveyance means for folding a backside of a cover sheet joined to the sheet bundle, at a downstream side of the joining stage.

A third and fourth aspects of the present invention includes a first aligning means that aligns a sheet trailing edge, second aligning means that aligns a side edge of the sheet, and offset conveyance means that conveys a cover sheet to a predetermined position at the joining stage, such as disclosed in the configuration of the first and the second aspects.

According to a $5^{th}$-$7^{th}$ aspect, the first aligning means are configured by a aligning unit for engaging a cover sheet and for aligning a sheet trailing edge at positioning means arranged on the second path. The second aligning means comprise shifting means for shifting the aligning unit to a direct intersecting conveyance. An offset conveyance means is arranged at a downstream side of the aligning unit, and is configured to move between a first position where it touches a cover sheet, and a retracted position that is positioned away from first position.

According to an $8^{th}$ to $10^{th}$ aspect of the invention, the aligning unit conveys a cover sheet in a direction opposite to a conveyance direction, and stopper members operable to hold a cover sheet when the shifting means shifts to a direction the intersects a conveyance direction, are equipped in configuration disclosed by the $5^{th}$ to $7^{th}$ aspects.

The $11^{th}$ to the $13^{th}$ aspects of the present invention are based upon the configuration of the eighth to the $10^{th}$ aspects and set shifting means for shifting the aligning unit in a direction intersecting conveyance to a shifting position of the aligning unit based upon cover sheet size information and information received from a plurality of sensors arranged in the shifting direction of the aligning unit.

A $14^{th}$ aspect of the present invention is based upon the configuration of the first aspect wherein the offset conveyance means further comprises operation means for calculating a conveyance amount according to the cover sheet aligned by the first and the second aligning means, and a thickness of the sheet bundle.

A $15^{th}$ aspect of the present invention includes an operation means that calculates a conveyance amount based on signals from thickness detection means disposed on the sheet bundle conveyance means that may detect the amount that the clamper members are open. Clamper members are disposed on the sheet bundle conveyance means and are operable to open and close in order to grip a backside of the sheet bundle.

A $16^{th}$ aspect of the aspect of the present invention comprises an image forming apparatus including image forming means for forming images on sheets, stacking means for stacking sheets from the image forming means in a bundle, and a bookmaking apparatus for making booklets of sheet bundles stacked in booklets at the stacking means.

The present invention arranges first and second aligning means on a cover sheet conveyance path at an upstream side of a joining stage operable to join a sheet bundle and cover sheet in an upside-down T-shape. Offset conveyance means are included that is operable to adjusting a conveyance amount of a cover sheet positioned by the first and second aligning means according to the thickness of the sheet bundle (according to a length direction of cover sheet conveyance). Therefore, after positioning a cover sheet at an upstream side of the joining stage, the conveyance amount is set after being conveyed a predetermined amount. Accordingly, by operation of a simple mechanism, the sheet bundle and cover sheet maybe accurately positioned. Furthermore, it is possible to make a booklet of a wide range of different sheet sizes of cover sheets with the sheet bundle, with few misalignments of the folding edges of the sheet bundle and cover sheet.

DETAILED DESCRIPTION OF THE PREFERRED EMBODIMENTS

Preferred embodiments of the present invention based on a bookmaking apparatus that employs the invention will be described below with reference to the accompanying drawings.

Figure 1A:
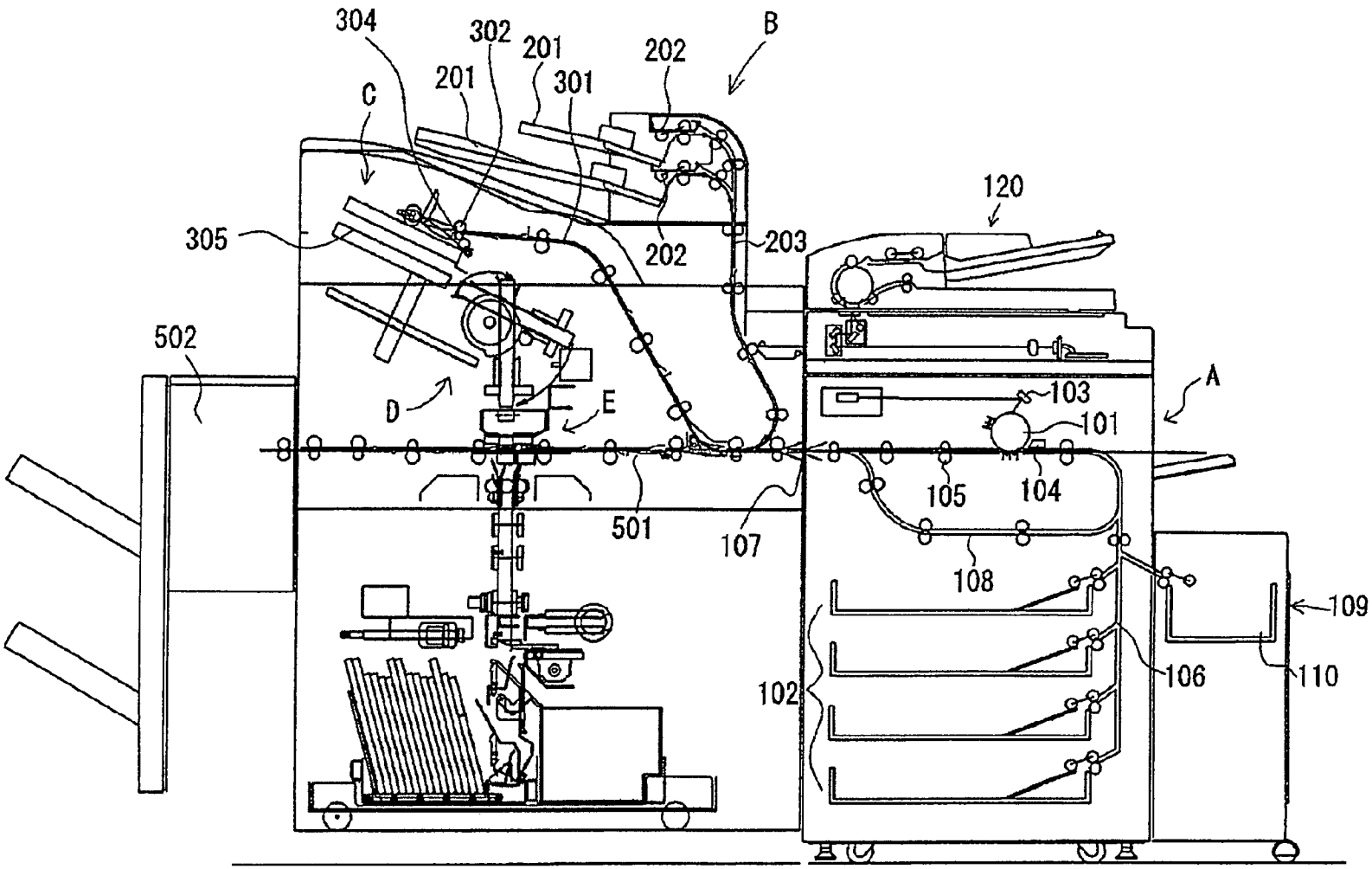
FIG. 1A is a structural view of a bookmaking system according to the present invention.
Figure 1B:
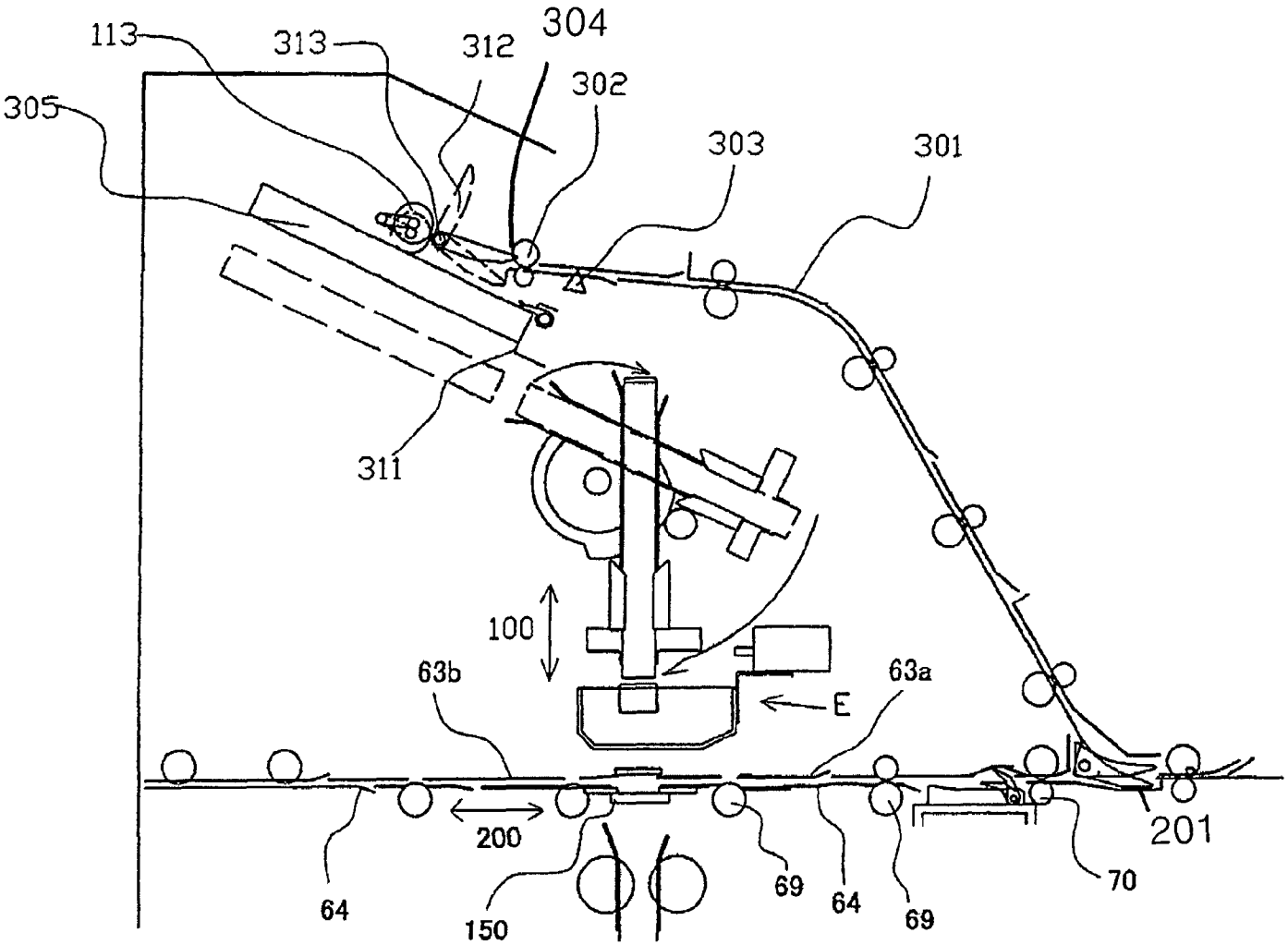
FIG. 1B is a structural view of an upper portion of the bookmaking system according to apparatus of FIG. 1A.
Figure 2:
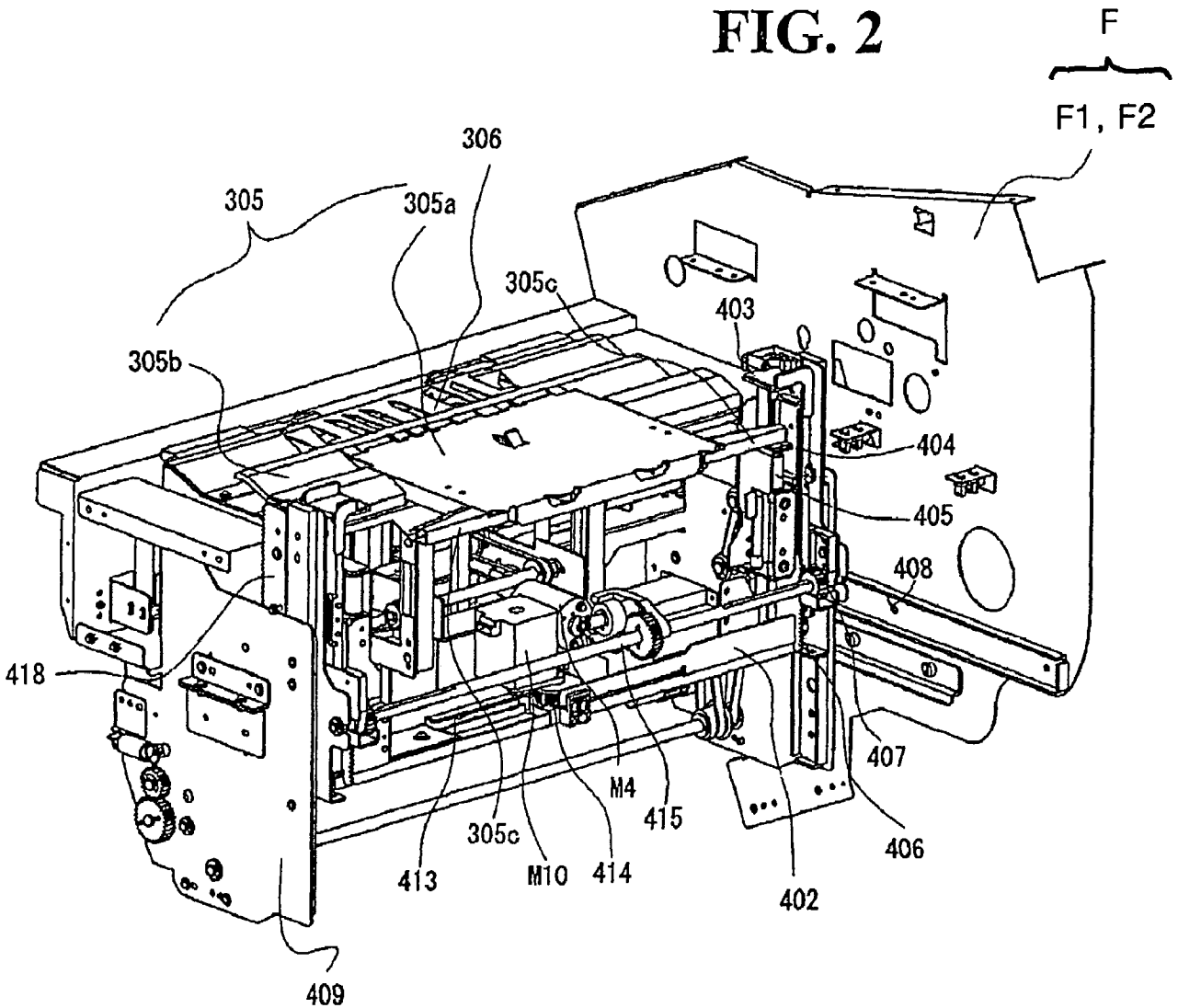
FIG. 2 is a perspective view of a first gripping conveyance means according to the apparatus of FIG. 1A.
Figure 6:
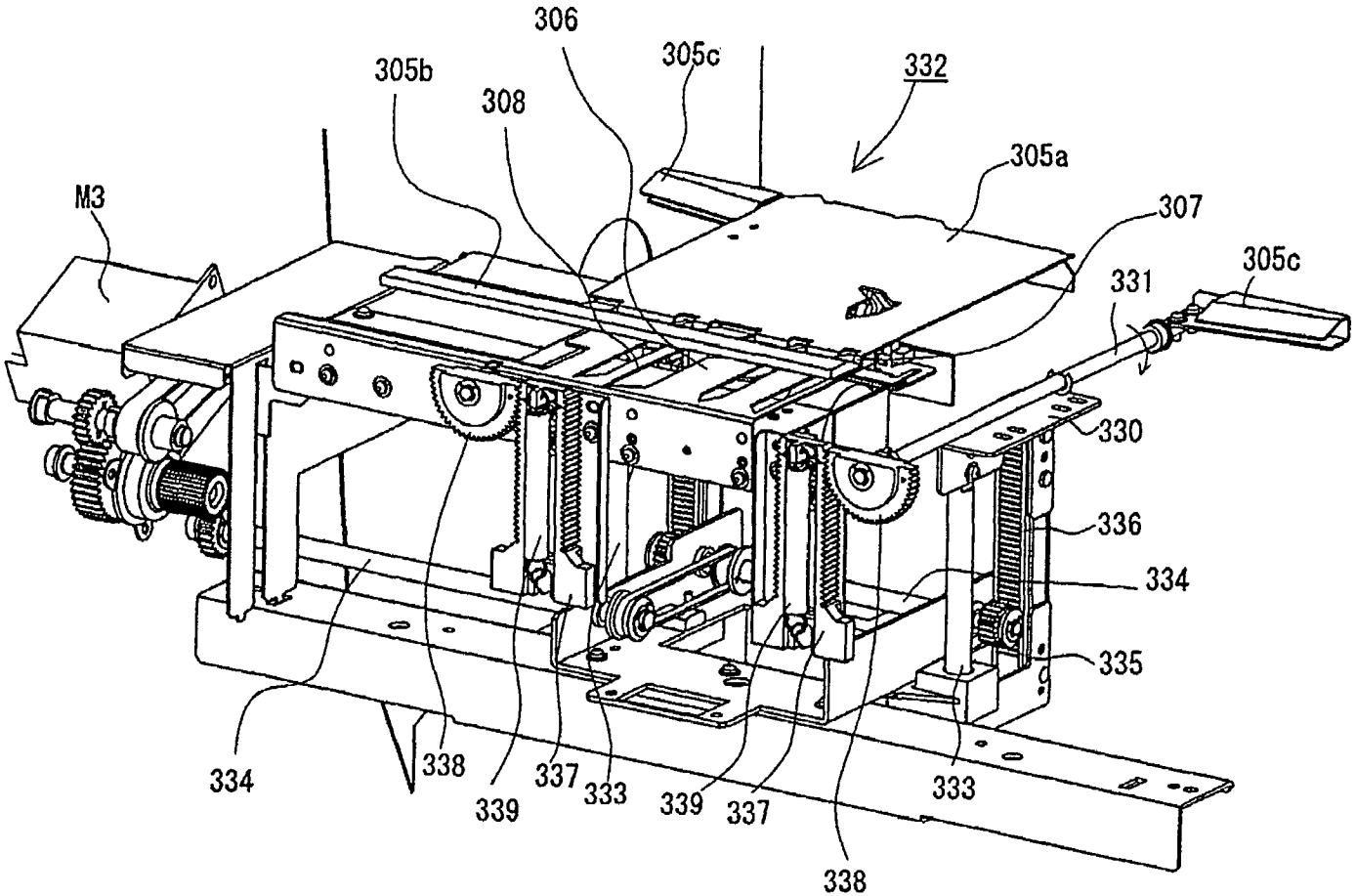
FIG. 6 is an illustration of a tray elevator mechanism according to the apparatus of FIG. 1A.
Figure 19A:
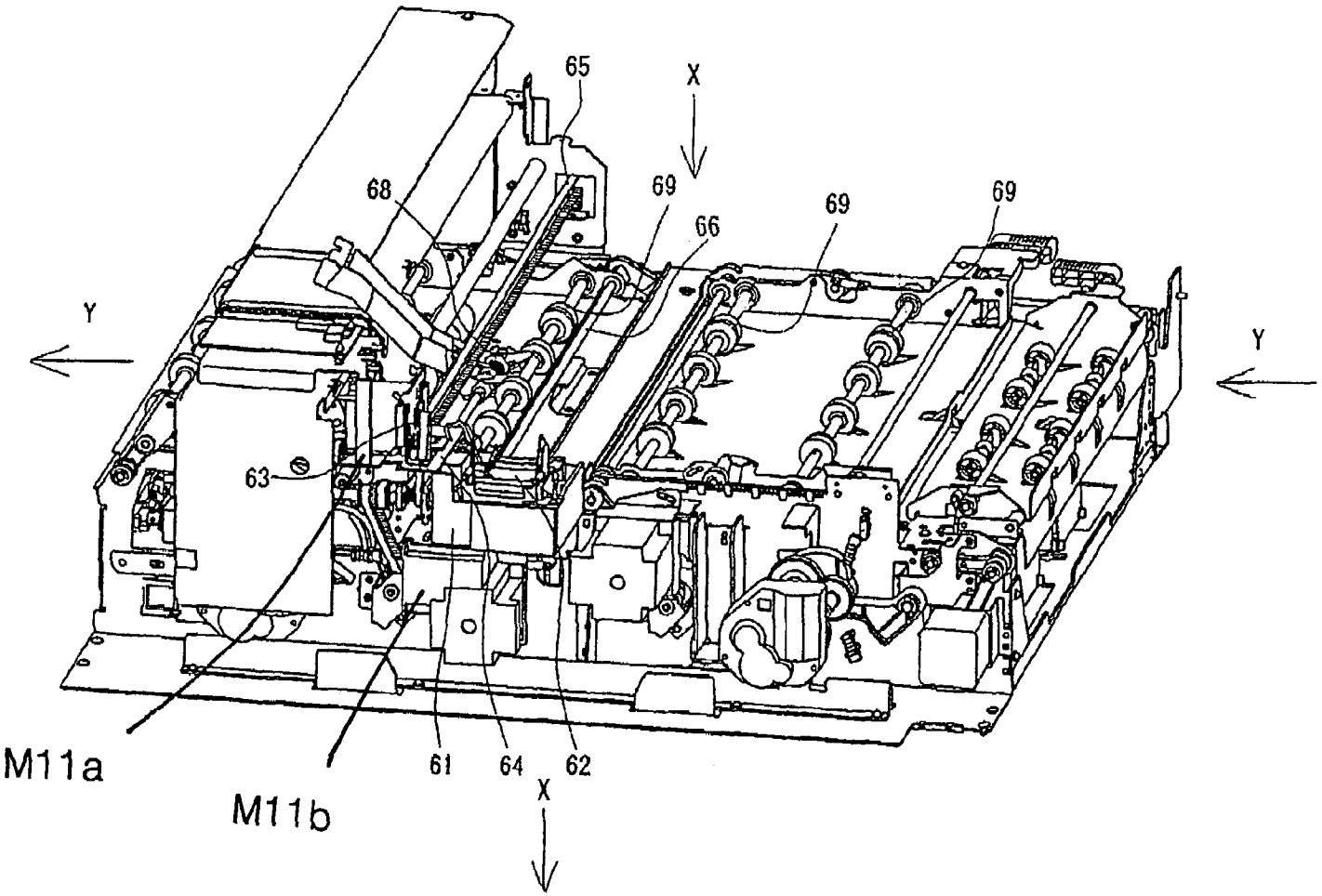
FIG. 19A is a perspective view of a cover sheet conveyance unit according to the apparatus of FIG. 1A.
Figure 19B:
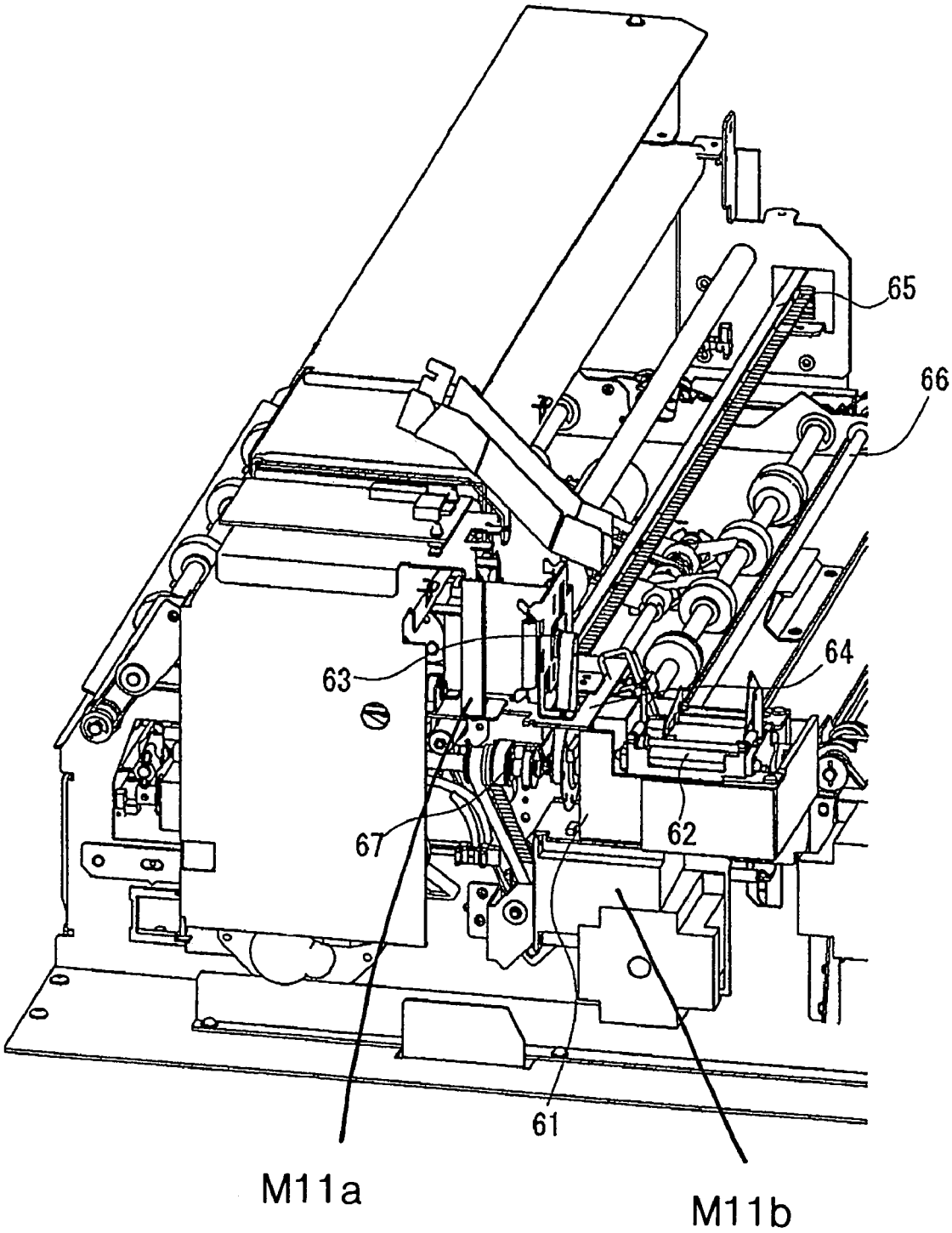
FIG. 19B is a partially expanded perspective view of a cover sheet conveyance unit according to the apparatus of FIG. 1A.
Figure 26A:
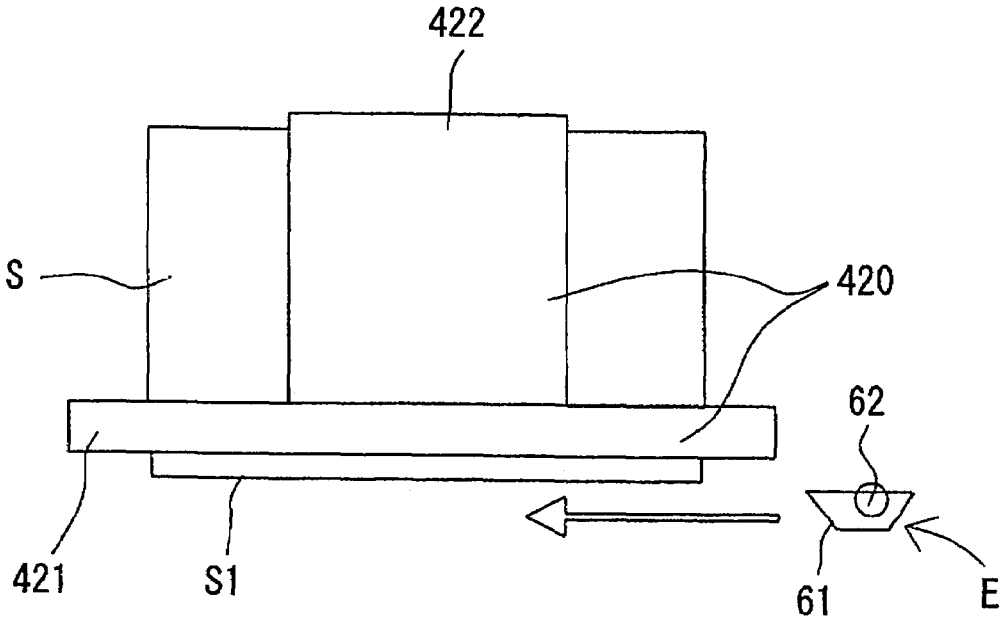
FIG. 26A illustrates dispensing adhesive in an outward direction of operation according to the apparatus of FIG. 19A.
Figure 26B:
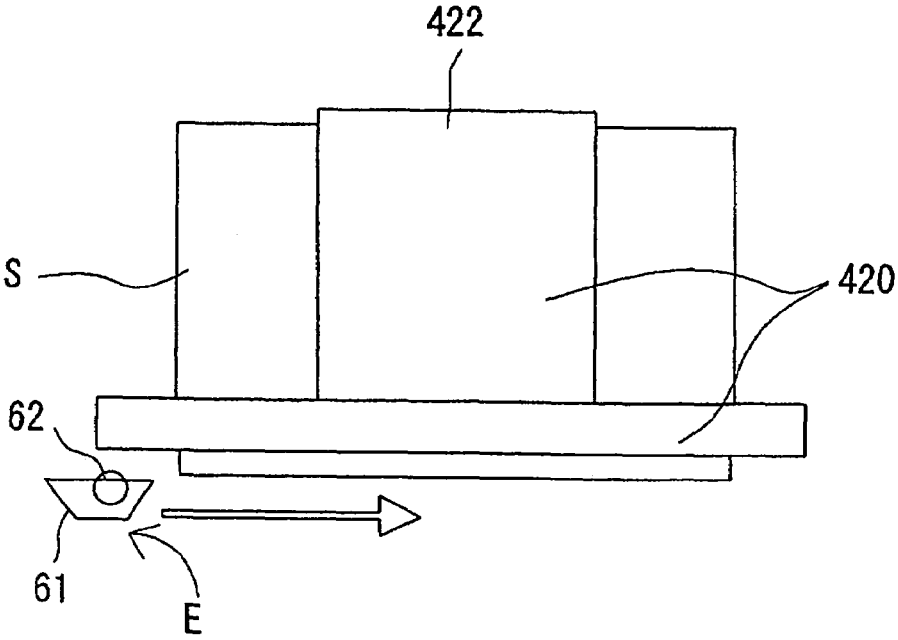
FIG. 26B illustrates dispensing adhesive in return direction of operation according to the apparatus of FIG. 19A.

FIG. 1A is a view of the overall configuration of a bookmaking system that employs the present invention. FIG. 1B shows the essential parts thereof. FIG. 2 is an overall drawing of a stacking tray unit. FIG. 6 is an overall drawing of a bundle conveyance mechanism unit. FIG. 19B is a drawing of the essential parts of a cover conveyance mechanism. FIGS. 26A and 26B includes drawings of the operation of an adhesive dispensing unit.

The bookmaking system shown in FIG. 1A comprises an image printing unit A that sequentially prints sheets; an inserter unit B that inserts sheets from the image printing unit A to a conveyance path; a stacking tray unit C that stacks sheets in page order from the image printing unit A; a bundle conveyance mechanism unit D that conveys a sheet bundle from the stacking tray unit C to an adhesive unit; an adhesive unit E that applies adhesive for the adhering process; a binding unit that binds a sheet bundle and a cover sheet after being applied with adhesive; a trimming unit that cuts sheets made into a book from that bookmaking unit; and a storage unit for storing the final, completed booklet. The following will explain the functions of each of the comprised units and features of the configuration.

Image Printing Unit

The image printing unit A is embedded in a system such as a computer or word processor. It prints to a series of sheets, and then conveys them out from a discharge outlet. Any type of printing means, such as a laser printer or ink jet printer can be employed. There is nothing particularly special about the one disclosed in the drawings. Any known printing means or other configuration of an image forming apparatus may be employed.

Inserter Unit

Sheets discharged from the image printing unit A described above are conveyed toward the stacking tray unit, described below, to undergo the bookmaking process. The inserter unit B supplies a cover sheet to this discharge path. For that reason, a hopper for supplying cover sheets, a separator mechanism for kicking out one sheet at a time from the hopper, and a conveyance mechanism for conveying a sheet to a discharge path are configured. Note that the embodiment disclosed in the drawings does not employ a configuration having any particular feature. Any known inserter configuration may be used.

Stacking Tray Unit

The stacking tray unit C collects sets of sheets sequentially discharged from a discharge outlet of the image printing unit in page order to form a stacked sheet bundle. For that reason, the stacking tray unit is arranged below the discharge outlet and is composed of tray means for sequentially stacking sheets. The tray means is equipped with a trailing edge control member for engaging a sheet edge to control the sheet; auxiliary conveyance means, such as forward and reverse drive rollers, for feeding a sheet to the trailing edge control member; and aligning means for aligning right and left sides of a sheet in the width direction using the sides of the sheet as references, or aligning a sheet using a center as a reference.

A first feature of the apparatus of the embodiment disclosed in the drawings is that a portion of the tray is movable. The tray is configured to allow a portion thereof to be able to extend or retract in the direction of sheet conveyance. A sheet conveyance direction length signal is employed to change the position that supports a leading end of a sheet in the forward or reverse direction (in the direction of sheet conveyance). This configuration makes it possible to support sheets in a stable manner and without misalignment, regardless of the length of the sheets. Simultaneously, this configuration makes it possible to adjust the position of the curling portion of the sheet which results into accurate position alignment of stacked sheets.

A second feature is that the tray performs multiple rolls that include stacking sheets, as described above, and conveying a sheet bundle toward, for example, a stacking position and a processing position of a next process. Specifically, the stacking tray unit is capable of rising and lowering between a stacking position for stacking sheets, and a conveyance position for conveying sheets to a next process. This configuration simplifies the sheet bundle conveyance mechanism and enables a more compact apparatus.

Bundle Conveyance Mechanism Unit

The bundle conveyance mechanism unit conveys sheets stacked and aligned in a bundle at the stacking tray unit, disclosed above, to a processing position of a next process with their edges and positions neatly aligned by aligning means. In order to feed the bundle to the finishing process position, e.g., the application of adhesive, the bundle conveyance turns from the tray in a substantially horizontal position to a substantially vertically position. An additional feature of the apparatus shown in the drawings includes a sheet bundle being conveyed from the stacking tray unit to a finishing position of a next process by first gripping conveyance means and second gripping conveyance means.

Simultaneous to this, tray means cooperate with the first gripping conveyance means to move a sheet bundle from a stacking position downward to a sheet conveyance position below over a predetermined distance, and to then move the sheet bundle to the second gripping conveyance means. At that point the second gripping conveyance means moves to a finishing position in a substantially vertical posture by turning the sheet bundle a predetermined angle, but at that time the tray means are lowered a predetermined amount to the lower side, and after handing the sheet bundle over to the second gripping conveyance means, there is no need to arrange a discharge path beyond what is necessary above the apparatus to ensure clearance for the gripping conveyance means to turn over sheets (a locus or revolution of the sheets).

Furthermore, the apparatus in the drawings is equipped with a stopper member for engaging a processing edge of a sheet bundle at a finishing position when the sheet bundle is conveyed by the second gripping conveyance means to the finishing position. The processing edge of the sheet bundle engages the stopper member so that the posture of the sheet bundle is positioned properly at a reference position for finishing. This makes the correct finishing possible by correcting the posture of the sheet bundle at the finishing unit, even if the position of the sheet bundle becomes misaligned during its conveyance.

Adhesive Unit

The adhesive unit E applies adhesive, such as glue, to the backside edge of the stacked sheet bundle. When doing so, the sheet bundle must be positioned in an inverted posture in a substantially vertical direction. The apparatus of the present invention is capable of retracting the adhesive tray of the adhesive unit E toward the backside of the sheet bundle, away from the conveyance path of the sheet bundle. The apparatus is configured to continue conveying the sheet bundle in a direct line path after applying adhesive. The reference member that touches and controls a processing edge of the sheet bundle is arranged with the adhesive application unit retracted, a complex sheet bundle conveyance path unnecessary. The adhesive application unit E comprises a roller for applying adhesive to the processing edge (the back) of the sheet bundle, and a compact tray for supplying adhesive to the roller. Because the adhesive tray travels along with the adhesive applying roller, the adhesive application unit E may be made compact.

Binding Unit

The binding unit joins the glued sheet bundle to a center position of a cover sheet supplied by the inserter unit B, described above. The binding unit folds the cover sheet to form a booklet for the sheet bundle. When the adhesive application unit retracts from the sheet bundle conveyance path, the cover sheet is supplied from a path that is substantially orthogonal to the sheet bundle conveyance path. The cover sheet is joined with the adhesive applied edge surface of the substantially vertically positioned sheet bundle along a center line of the cover sheet. Folding rollers then fold the cover sheet around the sheet bundle to cover it. The apparatus in the drawings is equipped with backup members and a folding block to neatly press the back cover and shoulders of the cover sheet and inner sheet bundle.

Trimming Unit

The trimming unit is operable to cut the outer sheet edges of the glued back portion of the sheet bundle, to complete the bookbinding process. For that reason, the sheet bundle is gripped by gripping means so the side edges may be sequentially cut by the cutter member. Non-limiting, any known cutting mechanism may be utilized.

Storing/Stacking Unit

The storing/stacking unit stacks sheet bundles that have been made into booklets. Storing/stacking units are known in the field of bookmaking and any known storing/stacking unit may be used.

The following will explain the configuration of each of the units described above.

Image Printing Unit A

As can be seen in FIG. 1A, the image printing unit A comprises a printing drum 101, such as an electrostatic drum; a sheet supply cassette 102 for supplying sheets to the printing drum 101; a printing head 103, such as a laser, for forming images on the printing drum 101; a developer 104; and a fixer 105. The sheet supply cassette 102 supplies sheets to a sheet supply path 106. The printing drum 101 is arranged in the sheet supply path 106. A latent image is formed by the printing head 103 on the printing drum 101, and toner ink is affixed by the developer 104. After the toner image formed on the printing drum 101 is transferred to the sheet by the fixer 105, the sheet is discharged from a discharge outlet 107.

As can be seen in FIG. 1A, a duplex path 108 is used to turn over a sheet printed with images on one side so that the opposite, unprinted, side can be conveyed again to the printing drum 101 for printing. Also shown in the drawing is a high-capacity cassette 109. This unit supplies large volumes of general use sheets to the main unit. Incidentally, a sheet hopper 110 equipped inside the high-capacity cassette 109 is configured to rise and lower according to the volume of sheets stacked thereupon. A feeding apparatus 120 that feeds paper document originals is equipped. Originals are stacked on the original feeding apparatus 120. This apparatus sequentially feeds one original at a time to a reading unit where an image of the original is converted into a photoelectric image that is forwarded to a data storage unit at the print head 103. On the other hand, if an external device, such as a computer or word-processor wherein the original is in the form of electronic data, is connected to the data storage unit, the data storage unit may receive original data from a processor assembly within the external device. Although the drawings disclose a laser printer device comprising the image printing unit A, the present invention is not limited to that device and may employ any printing method known, e.g., an ink jet, silk-screen, and offset printing apparatus.

Inserter Unit B

Sheets sequentially formed with images are conveyed to a discharge outlet 107 of an image printing unit A. Normally, a discharge stack is prepared at the discharge outlet 107. With this invention, a sheet conveyance, i.e., a bookmaking apparatus connected to the discharge path 107, is inserted into path 501. An inserter unit B is mounted to the sheet conveyance in path 501. The inserter unit B comprises one or more trays for stacking sheets (shown in the drawing as a two-tiered stacking tray 201); pickup means 202 for separating sheets on the stacking tray 201 into single sheets; and a sheet supply path 203 for guiding sheets from the pickup means 202 to the sheet conveyance in path 501.

Sheets stacked on the stacking tray 201 are sequentially conveyed to the sheet conveyance mechanism in path 501 between sheets conveyed out from the discharge outlet 107 of the image printing unit A. Specifically, after the final sheet of a series of sheets has been discharged from image printing unit A, a sheet is supplied from the stacking tray 201. Special sheets, such as thicker sheets or coated sheets, may be prepared as cover sheets and loaded in the stacking tray 201. Upon receipt of a control signal from the bookmaking apparatus, a sheet on the stacking tray 201 is conveyed to the sheet conveyance mechanism in path 501. Although a two-tiered stacking tray 201 may be supplied, making it possible to prepare in advance different types of cover sheets, cover sheets from only the selected stacker are conveyed to the sheet conveyance mechanism.

Stacking Tray Unit C

As shown in FIG. 1A, the sheet conveyance mechanism in path 501 traverses the central area of the apparatus. The leading end of the sheet conveyance mechanism 501 is connected to the discharge stacker unit 502. When a sheet from the image printing unit A is not going to undergo the bookmaking process, it is conveyed to and stored in the discharge stacker unit 502.

A stacking tray unit C for stacking in a bundle a series of sheets formed with images is arranged above the sheet conveyance mechanism in path 501. A bundle conveyance mechanism unit D is also arranged above the sheet conveyance in path 501 for conveying a sheet bundle from the stacking tray unit C to an adhesive application unit E position. A branching discharge path 301 is established on the sheet conveyance mechanism in path 501. This discharge path 301 is configured to discharge a sheet substantially horizontally above the sheet conveyance mechanism in path 501. Arranged on the discharge path 301 are a feed roller 302 and sheet sensor 303.

Tray means 305 are disposed below a discharge outlet 304 of the discharge path 301 forming a predetermined level therewith. Sheets are stacked and supported on the tray means 305 from the discharge outlet 304. Although tray means 305 may be fixedly disposed to the apparatus frame F1, F2, the tray means 305 may be disposed according to the embodiments illustrated the accompanying figures and as described below.

After a predetermined number of sheets has been stacked, the tray means 305 is configured to move toward a finishing position direction of a next process along with the sheet bundle. The tray means 305 is configured to rise and lower between a stacking position for stacking sheets (hereinafter referred to as a raised position) and a lowered position (hereinafter referred to as a lowered position) that is a predetermined distance below the raised position. The tray means 305 is configured to rise and lower so that stacked sheet bundles may be conveyed without disturbing their aligned state and to provide a compact conveyance mechanism. It is preferable that the tray means 305 be as compact and as light-weight as possible. The tray means shown in the drawings is configured so that the length of the tray member is shorter than the length of a sheet conveyance direction in order that the leading ends of sheets hang outside of the tray member.

Aligning means 314 (FIG. 4) comprising aligning members 315*a* and 315*b*, described below, are disposed on the tray means 305 for aligning a sheet width direction (the front and back directions of FIG. 1A, but it is necessary to bend the sheet to arch it in the conveyance direction when aligning the width of a sheet. For that reason, the tray means 305 is configured with a fixed support unit 305*a* (FIG. 2) and a movable support unit 305*b* (FIG. 2). A drive motor M1 (FIG. 3) is supplied to move the movable support unit 305*b* to optimum positions.

As shown in FIG. 2, the tray means 305 is mounted to be able to rise and lower on the apparatus frame F1 and F2, as described below. As mentioned above, the tray means 305 comprise fixed support unit 305*a* and the movable support unit 305*b*. A plate member 306 is also comprised. The plate member 306 is arranged below a discharge outlet 304 (FIG. 1B).

Figure 3:
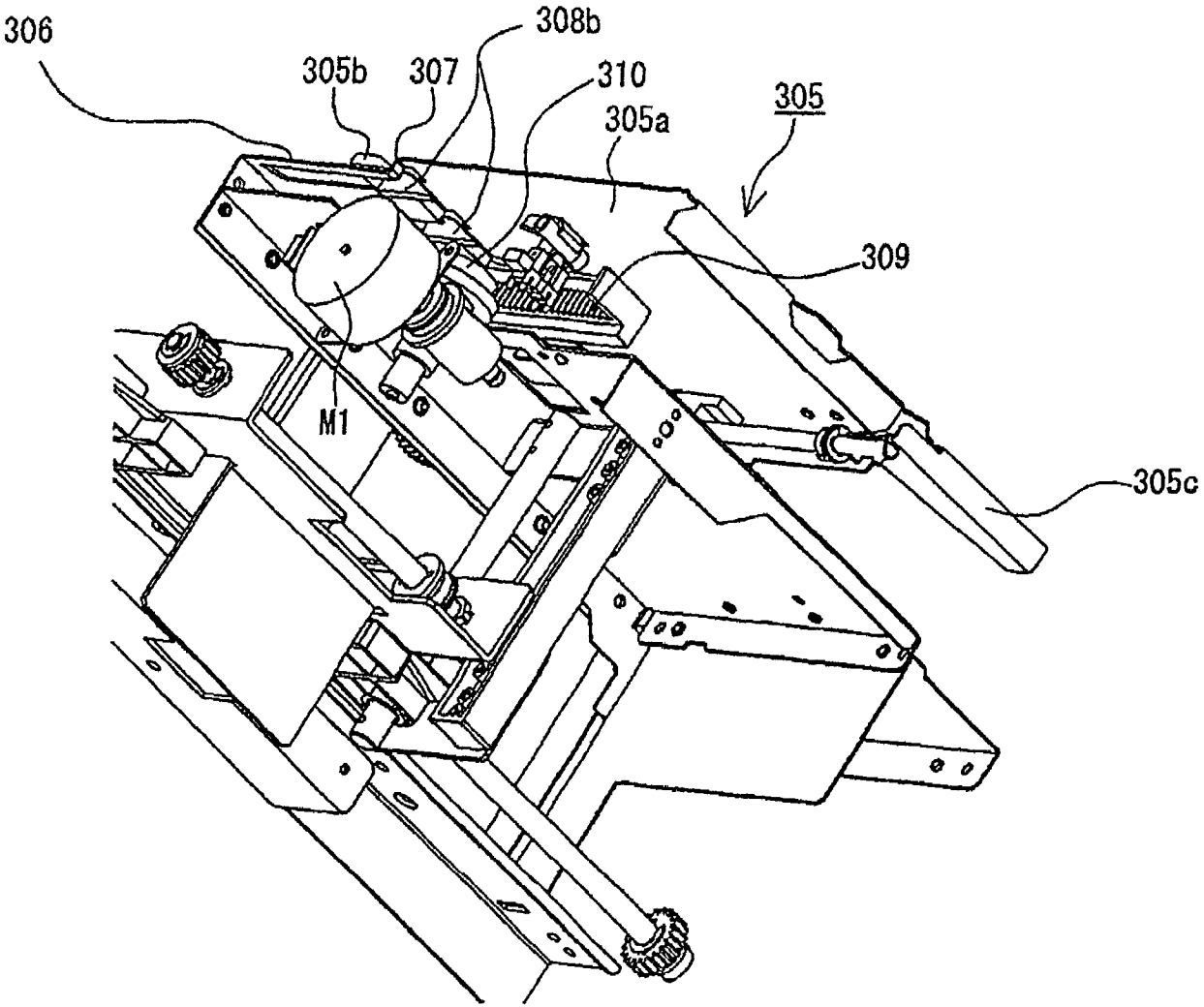
FIG. 3 is a perspective view of a tray means drive from the backside of the apparatus according to the apparatus of FIG. 1A.

Still referring now to FIG. 2, the fixed support unit 305*a* supports sheets and is formed on an upstream side of the plate member 306 in the direction of sheet discharge (trailing end side of sheets). At the upstream side thereof, a level 307 (FIG. 3) is established and a lever-shaped, movable support plate is arranged at this level 307. The movable support unit 305*b* is formed on this movable support plate. Comb-teeth-shaped slit grooves 308 (FIG. 5) are formed on the plate 306, and a projection 308*b* (FIG. 3), formed on the movable support unit 305*b*, mates with these grooves. The slit groove 308 (FIG. 5) and projection 308*b* (FIG. 3) are configured to move in the front and back directions in the direction of sheet discharge. A rack 309 (FIG. 3) established on a backside of the plate 306 (the backside that supports sheets) and a pinion 310 established on the tray member 306 are mated on the movable support unit 305*b*, as shown in FIG. 3. A drive motor M1 is connected to the pinion 310.

Specifically, the movable support unit 305*b* is slidably supported in the sheet discharge direction on the fixed support unit 305*a*. The movable support unit 305*b* slides in the sheet discharge direction by drive means composed of the rack 309, the pinion 310 and the drive motor M1.

As shown in drawings, at least the fixed support unit 305*a* of the tray means 305 is obliquely arranged. A first aligning means 311 (FIG. 1B) is arranged on the tray means 305 for abutting and aligning trailing edges of sheets. Although first aligning means 311 may comprise a projecting wall integrally formed on the tray, aligning means 311 may, as illustrated in FIG. 1B, be formed as an inverted L shape (in the sectional view) separate from the tray member to prevent misalignment, for example by rattling, because of the movable configuration of the tray in up and down directions.

A guide member 312 is established above the tray means 305 for guiding a sheet from the discharge outlet 304. The guide member 312 is composed of a plate-shaped member positioned above the discharge outlet 304 to guide sheets from the discharge outlet so that they are conveyed along the tray without being thrown about, and to guide sheets when they are conveyed to the first aligning means 311 by a forward and reverse drive roller, described below.

The guide member 312, composed of a plate-shaped member is supported at its base end by a rotating shaft 313. This rotating shaft 313 is connected to a stepping motor, not shown. Stepping control of this motor controls the movement of the guide member 312 between a position retracted above the tray, a position for guiding a sheet from the discharge outlet, positioned above the discharge outlet, and a position for guiding a sheet on the tray to the first aligning means 311.

Forward and reverse drive rollers 113 configured to rise and lower are arranged downstream of the guide member 312. The forward and reverse roller 113 functions as an auxiliary conveyance means and rotates in the sheet discharge direction (forward rotation direction) at a position where the roller 113 contacts a sheet advancing into the tray means (the fixed support unit 305*a*) from the discharge outlet 304, and rotates in a reverse direction (reverse rotation direction) after an estimated or predetermined amount of time to allow the trailing end of the sheet to separate from the discharge outlet 304 to move the leading end of the sheet toward the first aligning means 311. For that reason, the forward and reverse roller 113 is supported by an arm member (bracket) that allows the roller shaft to freely rotate and is connected to a forward and reverse drive motor. This arm member is configured to retract from the sheet to a position above the tray by the operation of a one-way clutch and the rotating direction of the motor.

Aligning means 314 and pressing means 320 are arranged on the tray means 305, described above, for aligning the sheet sides. The aligning means 314 are composed of aligning members 315*a* and 315*b* that are paired left and right for positioning the side edges of a sheet at a reference position that is at a right angle to the direction of sheet discharge. For that purpose, the left and right aligning members 315*a* and 315*b* can move toward a center of the sheet in the width direction the same amounts to perform alignment on center point reference, or one aligning member can be stationary while the other aligning member can move in the sheet width direction a predetermined amount to perform alignment with reference to one side. Either method is known in the art. These structures are well known, and thus are summarized.

Figure 4:
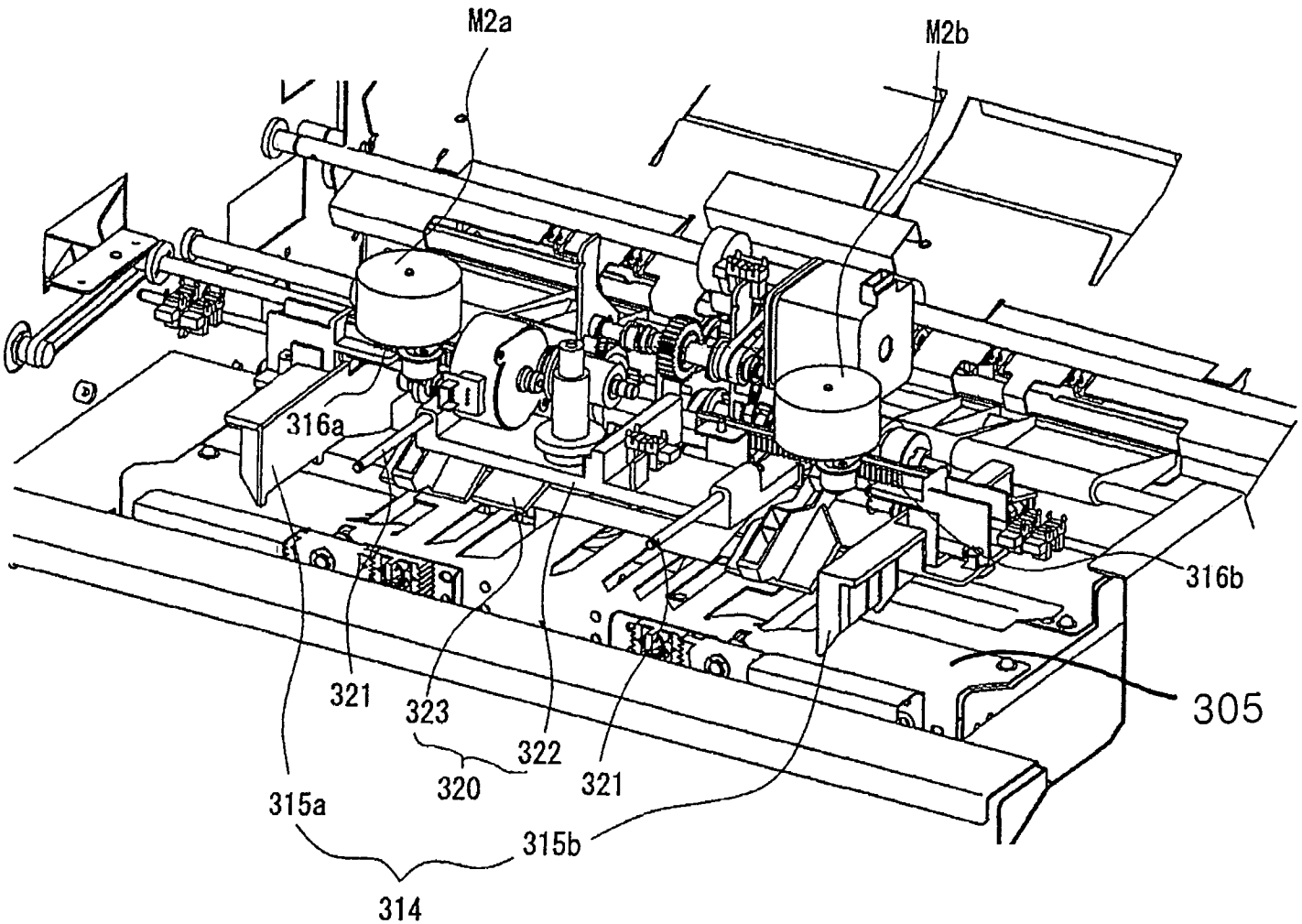
FIG. 4 is a perspective view of aligning means according to the apparatus of FIG. 1A.

As can be seen in FIG. 4, the right- and left-paired aligning members 315*a* and 315*b* are slidably supported on a over-hanging shaft fastened to the apparatus frame F1 and F2. They are arranged at the boundary between the fixed support unit 305*a* and the movable support unit 305*b* that compose the tray means 305. In operation, the leading end of the sheet engages and hangs downward from the movable support unit 305*b* to form a bend in the sheet. The left and right aligning members 315*a* and 315*b* are arranged to be positioned at this bend in the sheet. Racks 316*a* and 316*b* are disposed on the pair of aligning members 315*a* and 315*b*, and a pinion of a motor M2*a* and a pinion of a motor M2*b* are connected to each of these members 315*a* and 315*b*. Motors M2*a* and M2*b* may be comprised of stepping motors. The rotation of the motors in reciprocating directions cause the aligning members 315*a* and 315*b* to either advance, or separate from, a sheet center by the same amount. Motors M2*a* and M2*b* move the alignment members 315*a* and 315*b* to a preset start position according to the sheet width size.

Furthermore, tray means 305 is arranged with a sheet pressing member 320 (FIG. 4). The sheet pressing means 320 (hereinafter referred to as "pressing means 320") presses the leading end of sheets advancing into the tray, and the movable support unit 305*b*, described above, controls the bending of the sheet, while the aligning members 315*a* and 315*b* act to prevent sheets aligned by the aligning means 314 from becoming misaligned.

The embodiments disclosed herein disclose the pressing member 320 configured to move according to the size of the sheet due to the relationship of the movable support unit 305*b* being configured to move its position according to the size of the sheet. In other embodiments, the pressing means 320 may be configured by a weighted piece that hangs downward in a ramp shape above the tray.

Still referring to FIG. 4, a pair of guide shafts 321 is mounted to the apparatus frame F1 and F2 along the direction of sheet discharge. A slide member 322 is matingly supported to slide along the guide shaft 321. A plurality of pressing pieces 323 are arranged to press sheets downward into the tray on the slide member 322. Note that the slide member 322 and a drive mechanism, not shown, are equipped with a rack on the slide member 322 side. A drive motor fastened to the apparatus frame may be connected to the rack via a pinion. In other embodiments, the slide member 322 may be fastened to the apparatus frame via a structure that includes a pair of pulleys, wires or belts.

Note that wing-shaped auxiliary trays 305*c* are established on the left and right sides of the fixed support unit 305*a* that support sheet sides (both sides) that project outside of the fixed support unit 305*a* on the tray means 305. This is to make the fixed support unit 305*a* that configures the tray means narrower than the width of sheets. Furthermore, auxiliary trays 305*c* cause the sides of the sheets to protrude outside of the tray so that the gripping means, described below, can grip the corners of the sheet.

Figure 5:
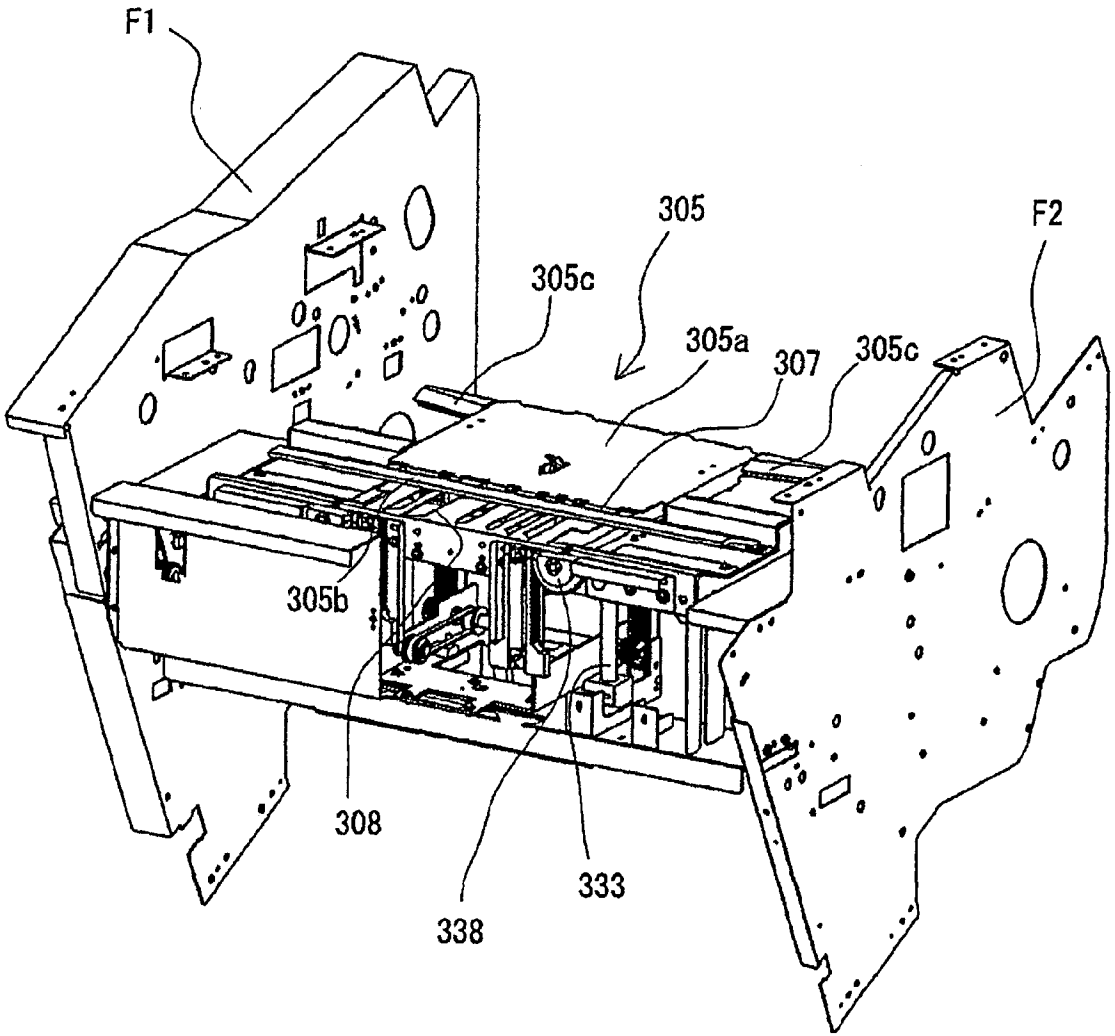
FIG. 5 is an overall view of a stacking tray unit according to the apparatus of FIG. 1A.

Specifically, as shown in FIG. 5, the auxiliary tray 305*c* of the paired left and right wings are arranged at the trailing end side of the direction of sheet discharge of the fixed support unit 305*a* for the tray means 305, and the movable support unit 305*b* is arranged on the leading end side. The auxiliary tray 305*c* and movable support unit 305*b* support the entire length of the width direction of the sheet, and the fixed support unit 305*a* supports the central portion of the sheet.

Bundle Conveyance Mechanism Unit

Sheets formed with images are sequentially picked up from the discharge outlet 301 (FIG. 1B) on the tray means 305 described above, and are aligned at a predetermined position on the tray by the first aligning means 311 and the paired left and right aligning members 315*a* and 315*b* (FIG. 4). The sheet bundle on the tray is then conveyed to a later finishing process.

In one embodiment of the present invention, tray means 305 move to a conveyance position that lowers a predetermined amount from a raised position where sheets are stacked. The following will explain the elevator structure of the tray means 305.

As shown in FIG. 6, the fixed support unit 305*a* that comprises the tray means 305 includes the plate member 306. The lever-shaped movable support unit 305*b* is movably mounted in the sheet discharge direction to the fixed support unit 305*a*. A bracket 330 is fastened to the backside (the reverse side) of the fixed support unit for auxiliary tray assemblies 305*c*. The following disclosure is applicable to the structure and operation of an auxiliary tray assembly 305*c* disposed on the left and right sides of fixed support unit 305*a*. A shaft 331 is rotatably supported on this bracket 330, and the auxiliary tray 305*c* is integrally mounted to one end of the shaft 331. A fan-shaped gear 338 is fastened to the other end of the shaft 331.

The fixed support unit 332 (hereinafter referred to as the "tray assembly 332") having the structure described above, is matingly supported to slide on the apparatus frame F1, F2 by operation of the left and right pair of guide shafts 333 (FIG. 6). Accordingly, still referring to FIG. 6, the tray assembly 332 is slideably supported on the apparatus frame F1, F2 allowing the tray assembly to slide in an up and down direction. A drive gear 335 is connected to the leading end of a drive shaft 334, the other end of drive shaft 334 is rotateably mounted along with an elevator motor M3 to the apparatus frame F1 (FIG. 5). The drive gear 335 is mated to the rack 336 mounted on the tray assembly 332.

Therefore, when the elevator motor M3 rotates, the drive gear 335 rotates thereby moving the rack 336 upward or downward, and the tray assembly 332 rises or lowers. The tray assembly 332 lowers in the downward direction with the clockwise direction rotation of the drive gear 335 at the position shown in the drawing. The tray assembly 332 rises with the counterclockwise direction rotation of the drive gear 335. Racks 337 are provided in a pair on the left and right on the apparatus frame F1, F2. The racks 337 mesh with the fan-shaped gears 338 so the rotation of the shaft 331, interlocked with the up and down action of the tray assembly 332, rotates the auxiliary tray 305*c*.

When the tray assembly 332 is lowered from the position shown in FIG. 6, right side fan-shaped gear 338 rotates in a clockwise direction, causing the attached auxiliary tray 305*c* to rotate in the clockwise direction, separating from the stacked sheets. Note that limit switches, not shown, are arranged at an upper limit position and a lower limit position on the tray assembly 332 and transmit position signals to a control unit of the drive motor M3.

The raised position of the tray assembly 332 is set to a position for stacking sheets from the discharge outlet 301, as shown in FIG. 1B, and the lowered position is set to a conveyance position for handing over a sheet bundle on the tray to a gripping conveyance means. The number 339 (FIG. 6) represents a spring in the drawings. Gripping conveyance means (hereinafter referred to as first gripping conveyance means) 401 (FIG. 17) for gripping a sheet bundle on a tray simultaneously with the lowering of the tray assembly 332 to its conveyance position are provided.

A first gripping conveyance means is provided at the position of the auxiliary tray 305*c* to grip both edges of sheets after the auxiliary tray 305*c* moves to a retracted position. As shown in FIG. 2, horizontally oriented guide rails 408 are paired left and right on the frame F1 and F2 on the left and right that compose the apparatus frame F.

The guide rails 408 are arranged in positions that are paired on the left and right sides. A frame 409 is matingly supported to move along these guide rails 408. The entire side frame 409 is supported to move in the left and right directions of FIG. 2 along the guide rail 408 with the frame structure F that integrates the left and right frames and bottom frame. A movable frame 410 (FIG. 18) that rises and lowers in a vertical direction is guidingly supported to move in up and down directions of the drawing on the side frame 409. A rack 411 is integrally formed on the movable frame 410. A drive motor M8 fastened to the side frame 409 is mated to the rack 411. Therefore, the side frame is mounted to the apparatus frames F1 and F2 to move on the guide rails 408 in the horizontal direction.

Figure 18:
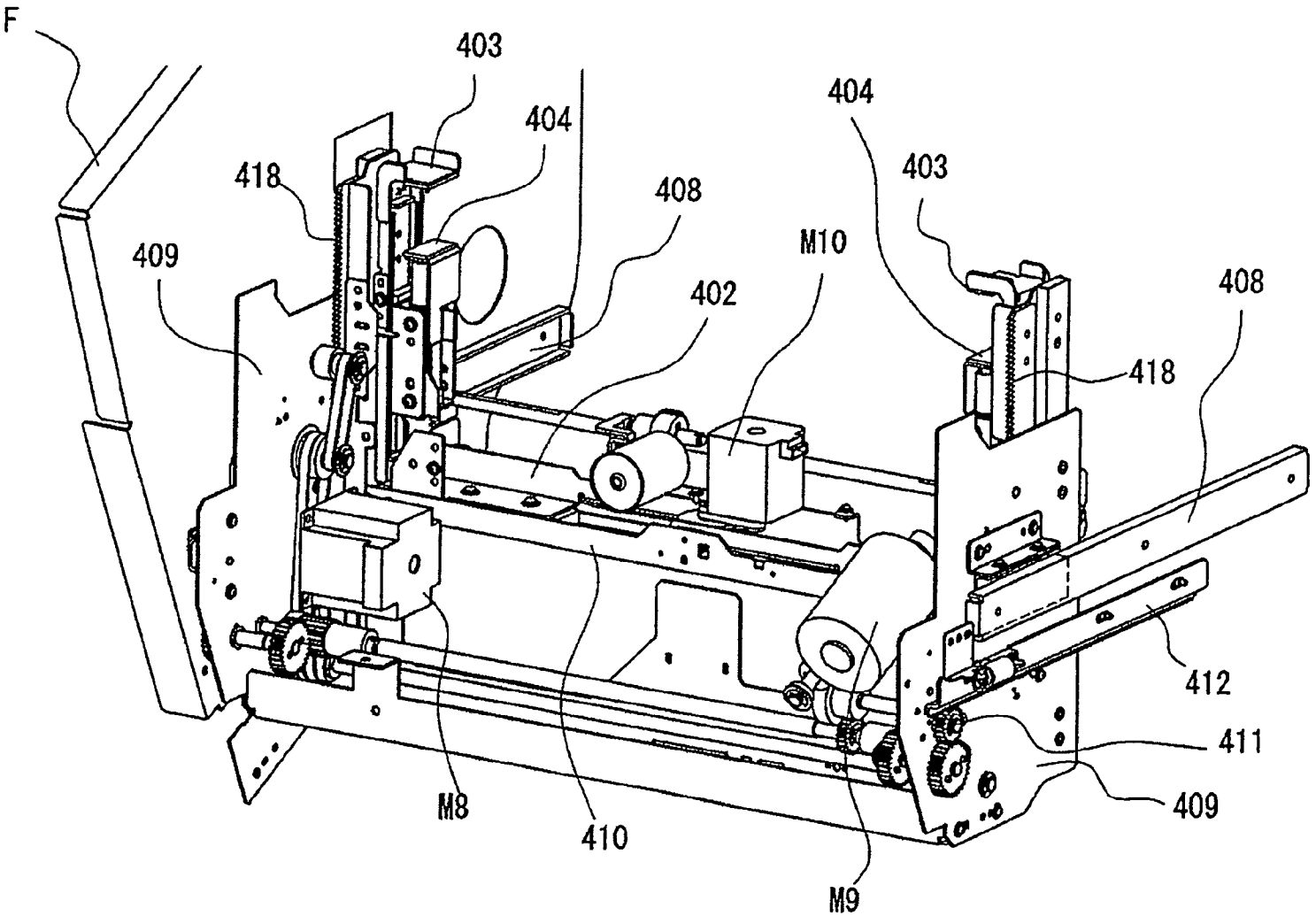
FIG. 18 is a perspective view of the backside of the apparatus of FIG. 2.

Still referring to FIG. 18, a drive motor M9 mounted on the frame 409, and a pinion 411 connected to that motor mate with the guide rails 408 and horizontally-arranged rack 412 for the side frame 409. Rotation of the drive motor M9 moves the side frame 409 in a horizontal direction along the guide rail 408. The movable frame 410 is movably mounted in a vertical direction (in up and down directions of FIG. 2) on the side frame 409. The movable frame 410 moves in a vertical direction by the drive motor M8 provided on the side frame 409.

Still referring to FIG. 2, a clamp support frame 402, paired on the left and right sides, is mounted on the movable frame 410. An upper clamper 403 and a lower clamper 404 (FIG. 18) are mounted to the clamp support frame 402. The clamp support frame 402 is supported by the movable frame 410 (FIG. 18) to move in the left and right directions of FIG. 2. The rack 413 (not shown), pinion 414 (not shown) and the support frames 402 on the left and right sides are connected to the pinion come together and separate. This structure is well know in the art and is not shown, but as an example, the left and right side clamp support frames 402 on the bottom of a movable frame structured in a chassis shape may be guidingly supported to slide on guide rails, and a rack 413 can be provided on these clamp support frames 402. This rack is connected to the pinion 414 provided on the movable frame 410 (FIG. 18) and the drive motor M10. This is mated so that the left and right clamp support frames 402 may move in opposite directions with the rotation of the pinion 414.

Upper and lower clampers are mounted to each clamp support frame 402. An elastic pad, such as one made of rubber, is integrally mounted to the clamp support frame 402 on the upper clamper 403. The upper clamper 403 is configured to move in up and down directions to engage and separate from the sheet bundle on the tray assembly 332 by operation of the drive motor M8 of the movable frame 410 (FIG. 18).

On the other hand, the lower clamper 404 may be mounted to a plunger 405 that is slidably mounted to the clamp support frame 402. The lower clamper 404 is composed of an elastic pad, such as one made by rubber. This plunger 405 may internally house an elastic spring, and is mounted to move in up and down directions on the clamp support frame 402. The plunger 405 is integrally equipped with the rack 406. The pinion 407 meshes with the rack 406, and a drive motor M4 is connected to this pinion 407 interposed by a transmission shaft 415. Note that the pinion 407 is movably mated in the shaft direction on the transmission shaft 415. When the clamp support frame 402 (FIG. 2) moves in the left or right directions, the pinion 407 also moves along the transmission shaft 415.

Still referring to FIG. 2, controlling drive motor M10 to draw the left and right support frames 402 toward and away from each other, the upper and lower clampers move to positions that engage the corners of the sheets on the tray assembly 332. By rotatingly driving the drive motor M8, the upper clamper 403 engages the upper surface of the sheet bundle, and by rotatingly driving the drive motor M4, the lower clamper 404 engages the lower surface of the sheet bundle. Furthermore, by rotatingly driving the drive motor M9 while the upper and lower clampers are gripping a sheet bundle, the sheet bundle is moved horizontally in the right direction of FIG. 2.

Figure 17A:
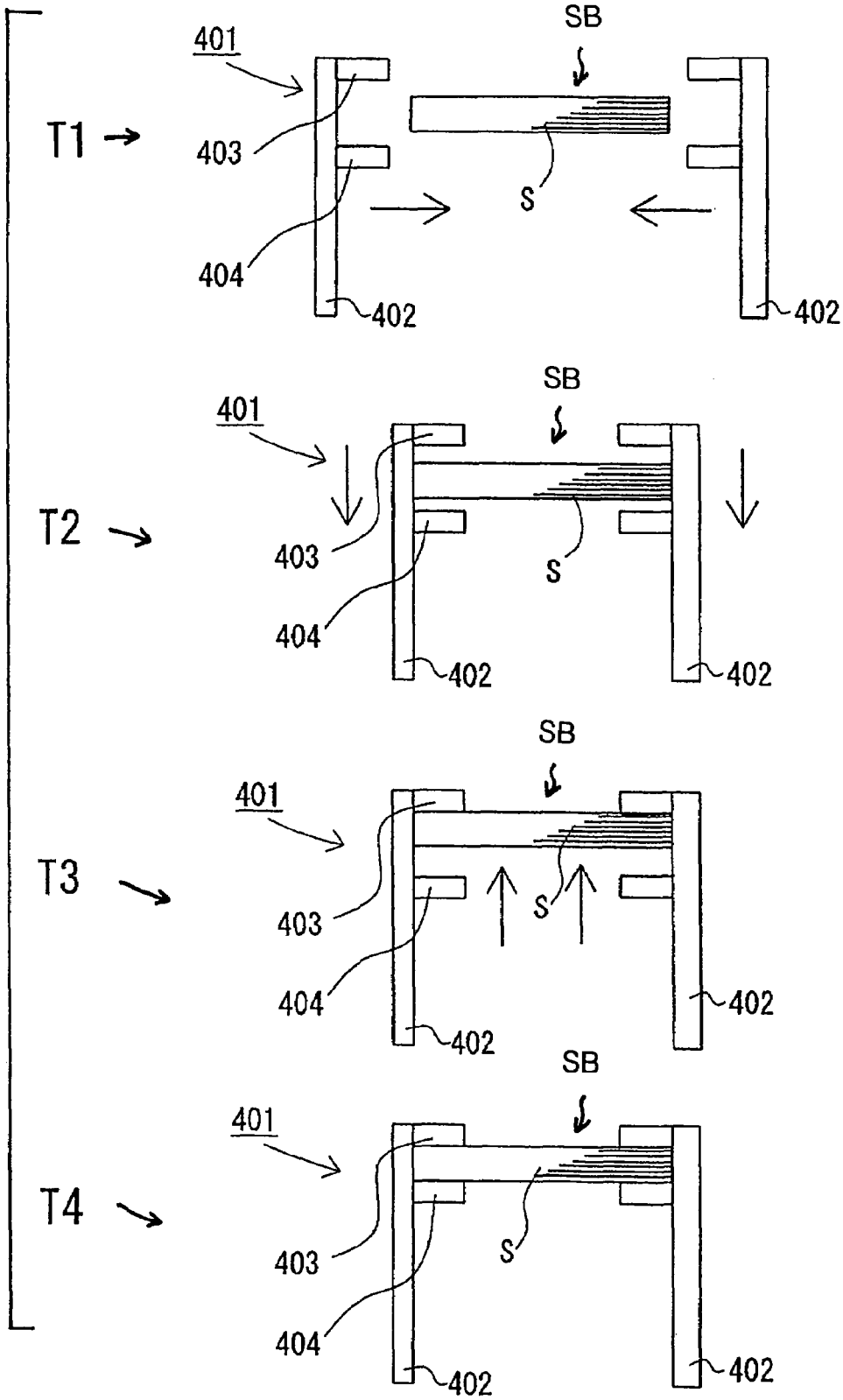
FIG. 17A illustrates operational positions of the gripping conveyance means.

In this manner, the tray assembly 332 may move downward from a stacking position (a raised position) to a conveyance position (a lowered position), and at the same time, the first gripping conveyance means lowers with the tray assembly 332 while the sheet bundle on the tray is gripped by the upper clamper 403 and the lower clamper 404 (FIG. 18). At this conveyance position, the sheet bundle is taken over from the first gripping conveyance means 401 (FIG. 17A) to the second gripping conveyance means 420 (FIG. 17D).

Figure 7:
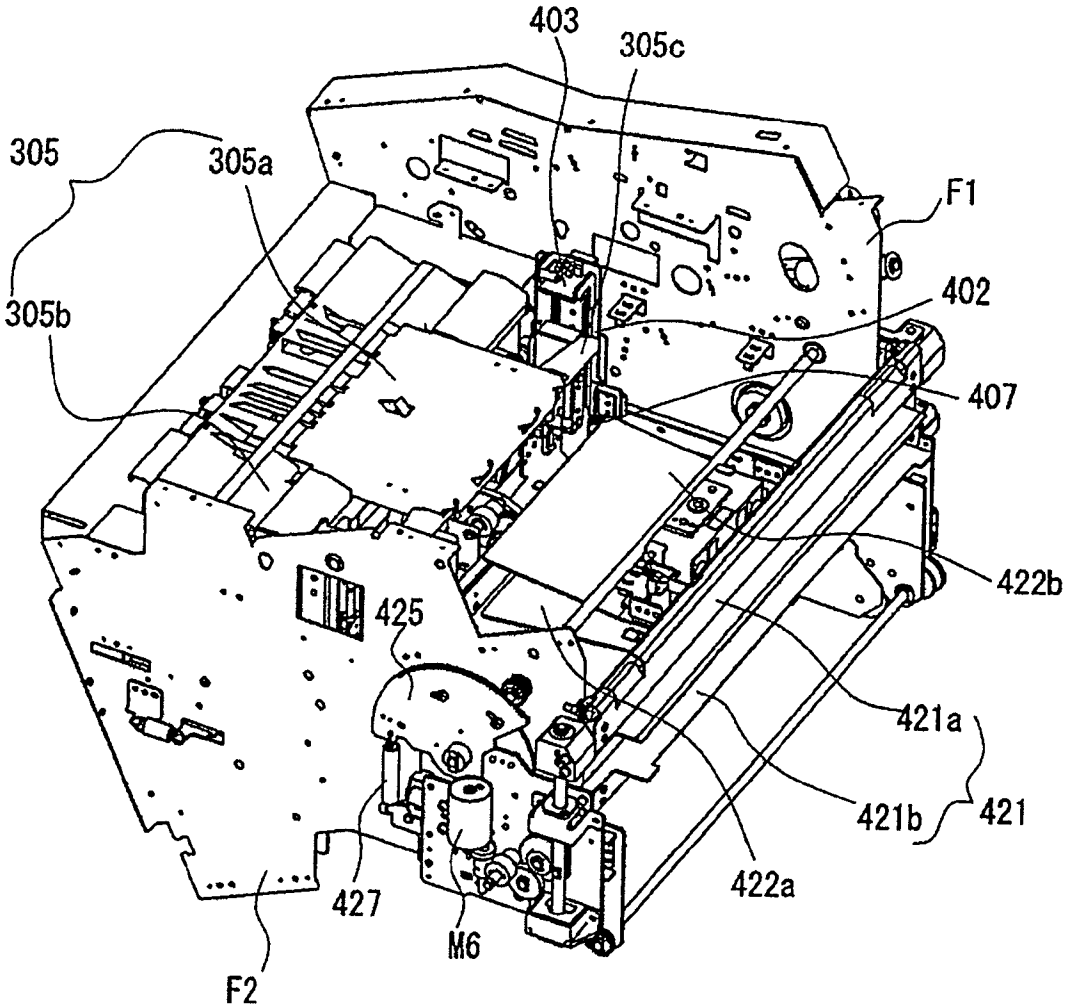
FIG. 7 is a perspective drawing of a sheet stacking apparatus of the apparatus of FIG. 1A.

The second gripping conveyance means 420 turns the sheet bundle received at a substantially horizontal posture from the first gripping conveyance means 401 approximately 90 degrees so that the sheet bundle is vertical, then moves to the processing position of a next process. For that reason, the second gripping conveyance means 420 is disposed on the right and left side frames F1 and F2 at a position adjacent to the tray assembly 332, as shown in FIG. 7, and are composed of a main clamper 421 and sub-clamper 422. The main clamper 421 is composed of an upper clamper 421*a* and a lower clamper 421*b* for gripping the entire length of the edges of a sheet bundle fed from the tray assembly 332. The sub-clamper 422 guides the sheet bundle to the main clamper 421, and is composed of upper and lower sub-clampers 422*a* and 422*b* for gripping a central area of a sheet bundle at the same time. The sub-clamper 422 is rotatably supported by the main clamper 421. Hereinafter, reference to main clamper 421 may refer to the assembly comprising both upper clamper 421*a* and a lower clamper 421*b*.

Figure 8:
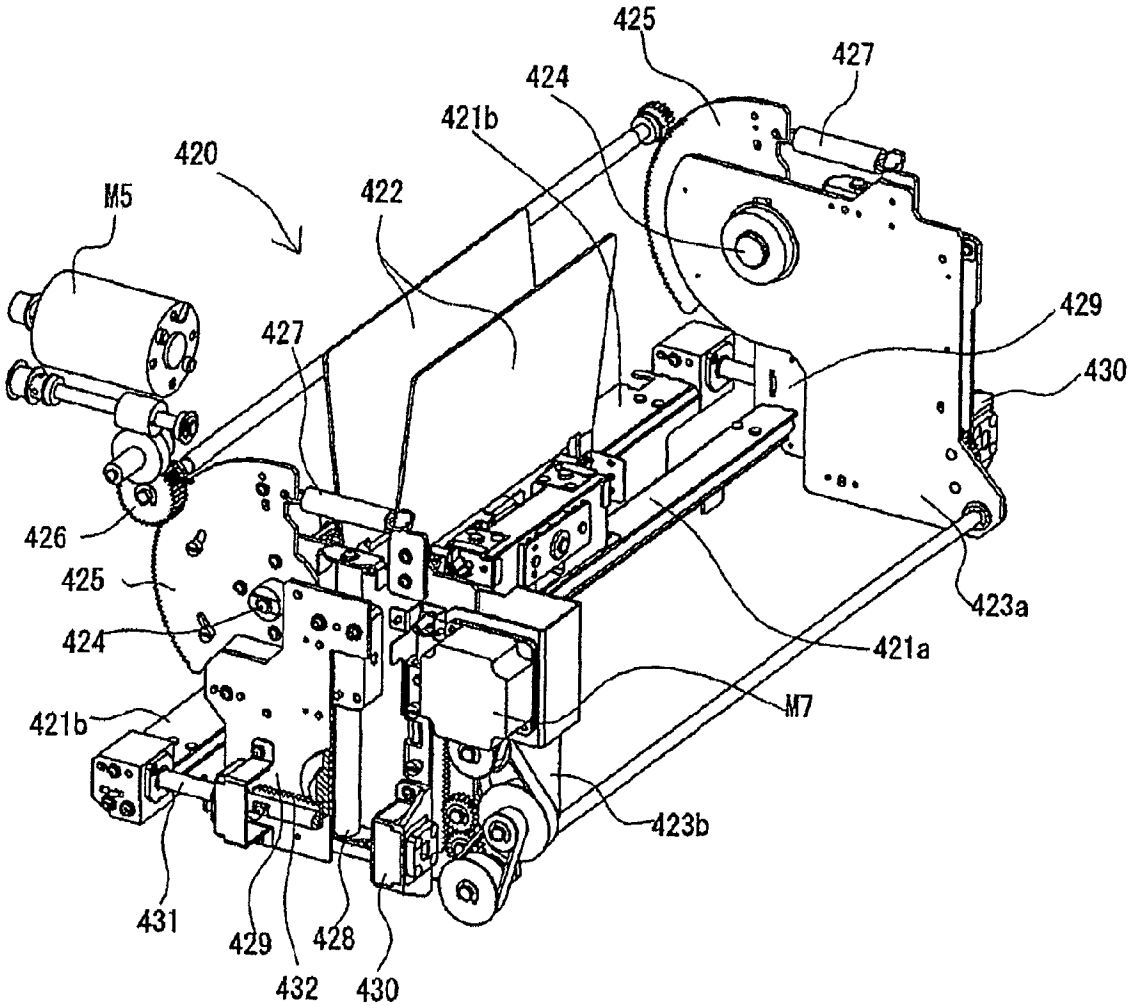
FIG. 8 is a structural view of a bundle conveyance mechanism unit according to the apparatus of FIG. 1A.

Main clamper 421 and the sub-clamper 422 are turnably mounted to the apparatus frames F1 and F2 to turn after gripping the sheet bundle to change the sheet bundle to a vertical posture. FIG. 8 illustrates second gripping conveyance means 420. The left and right side frames 423*a* and 423*b* are rotatably mounted to the apparatus frame F by a rotating shaft 424. Fan-shaped gears 425 are integrally fastened to the left and right side frames. A turning motor M5 and a pinion 426 connected to that motor are mated to the fan-shaped gears 425 on the apparatus frames F1 and F2. Rotation of the motor M5 rotates the left and right fames around the rotating shaft 424. Return springs 427 (FIG. 8) apply tension to fan-shaped gears 425.

Guide rails 428 are disposed in a pair, in up and down directions on the right and left side frames 423*a* and 423*b*. Movable side frames 429 are mated to these guide rails 428. The main clamper 421 and the sub-clamper 422 are mounted to the movable side frames 429. A fixed clamper 421*a* that composes the main clamper 421 is fastened to the left and right movable side frames 429, and the main clamper 421*a* is mounted to a rod 431 that fits in the bearing 430. A rack 432 is provided on the rod 431, and the pinion 433 connected to the drive motor M6 (FIG. 10A) is mated to the rod.

Figure 9:
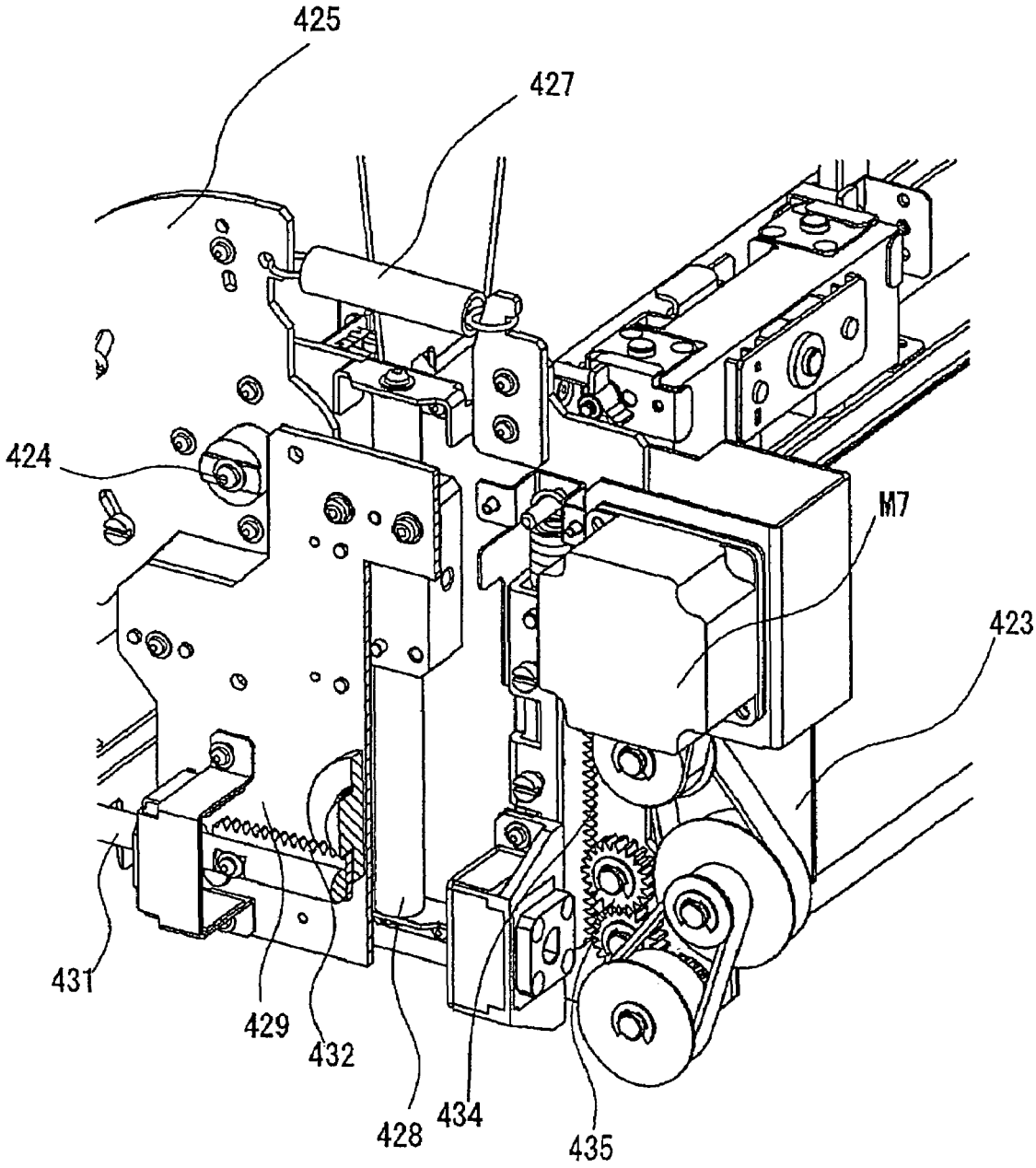
FIG. 9 is an expanded view of a portion of the bundle conveyance mechanism unit according to the apparatus of FIG. 8.

The movable side frame 429 is provided in greater detail in FIG. 9 to facilitate the disclosure. Actually, the rack 434 in the drawing is integrally formed. A pinion 435 of the drive motor M7 mounted to the fastened side frame 423 is mated to this rack 434. Therefore, the movable side frame 429 of the clamper unit, rotatably mounted to the apparatus frame F of the fastened side frame 423, moves in an up and down directions by operation of the drive motor M7. A fastened clamper 421*a* and movable clamper 421*b* are mounted to the side frame 429.

Figure 10A:
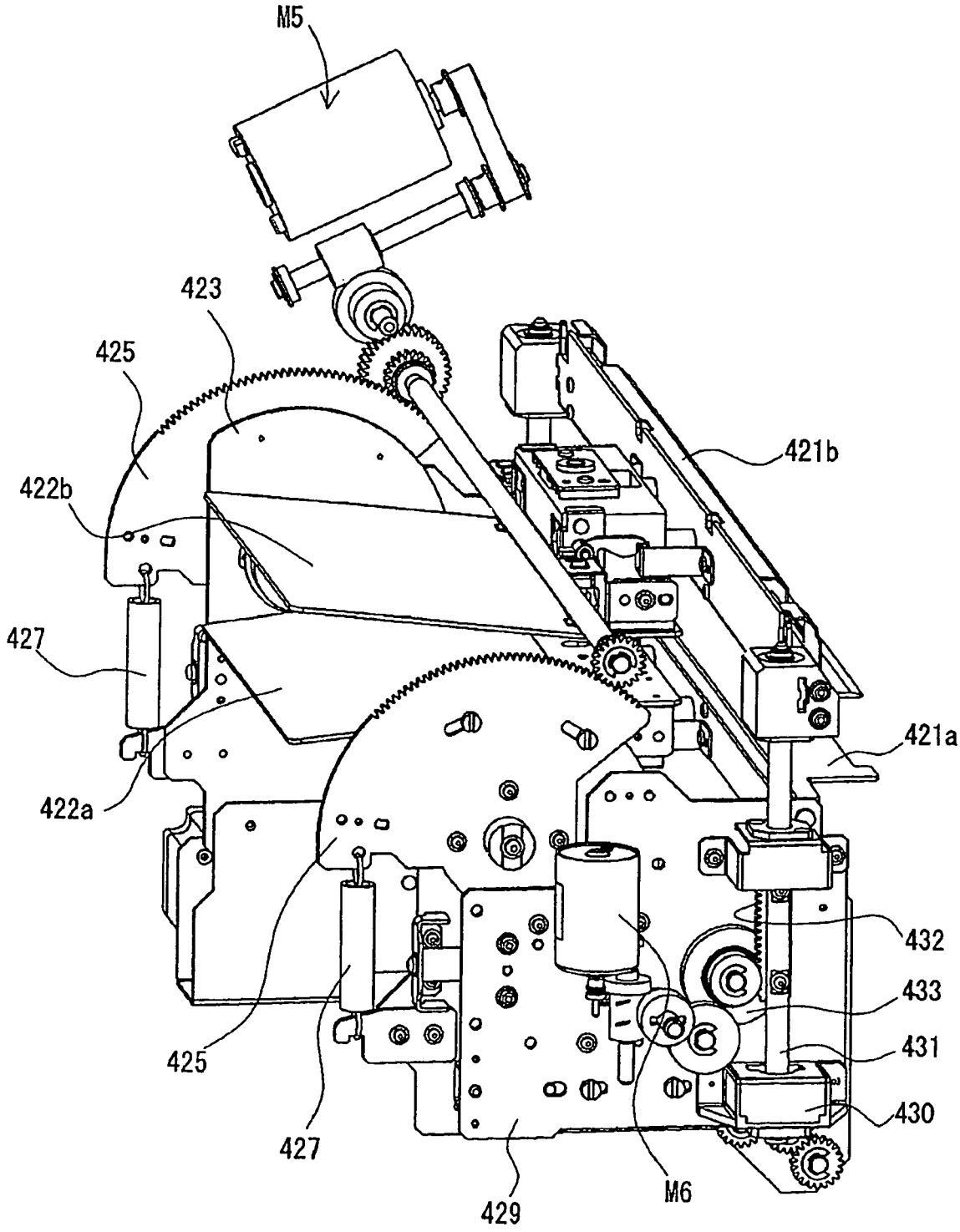
FIG. 10A is an overall view of a bundle conveyance mechanism unit according to FIG. 8 and is a perspective view of the apparatus as seen from a horizontal direction.
Figure 10B:
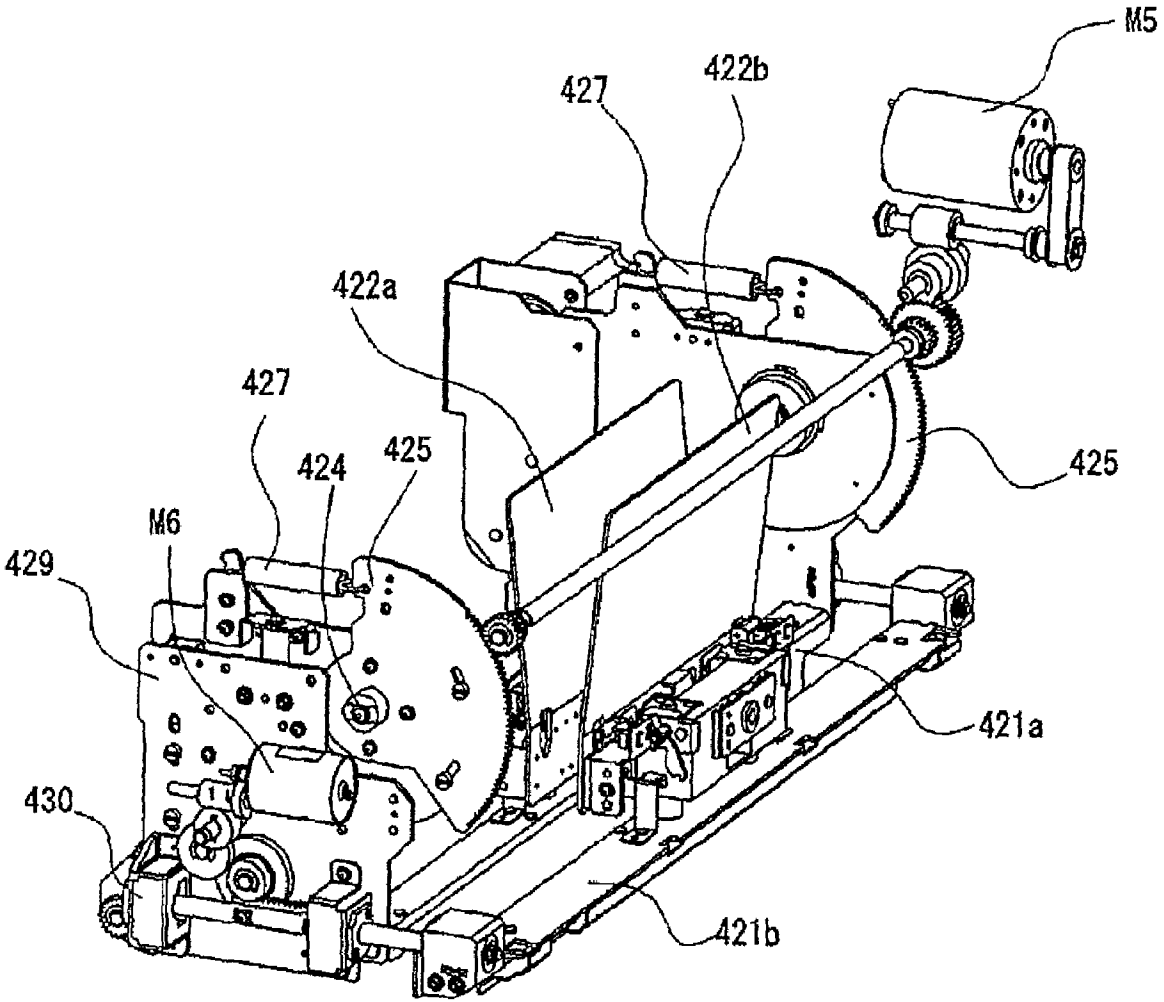
FIG. 10B is an overall view of the bundle conveyance mechanism unit according to FIG. 8 and is a perspective view of the apparatus after rotating the gripping conveyance means.

FIG. 8 is a view of the structure of the main clamper 421; FIG. 9 is an expanded view of the essential parts; FIG. 10A is an operational view of the state where a horizontally-oriented sheet bundle is handed over from the first gripping conveyance means 401 (the direction of the arrow indicating the upward direction); and FIG. 10B is an operational view of the state where the gripping means is rotated approximately 90 degrees around the rotating shaft 424 to change the posture of the sheet bundle to a substantially vertical state.

The following will describe the structure of the sub-clamper 422. In the state where the sheet bundle is handed over from the first gripping conveyance means 401, shown in FIG. 10A, a bottom side sub-clamper 422*a* is mounted to a fastened main clamper 421*a* and an upper sub-clamper 422*b* is mounted to the movable main clamper 421*b*.

Figure 11:
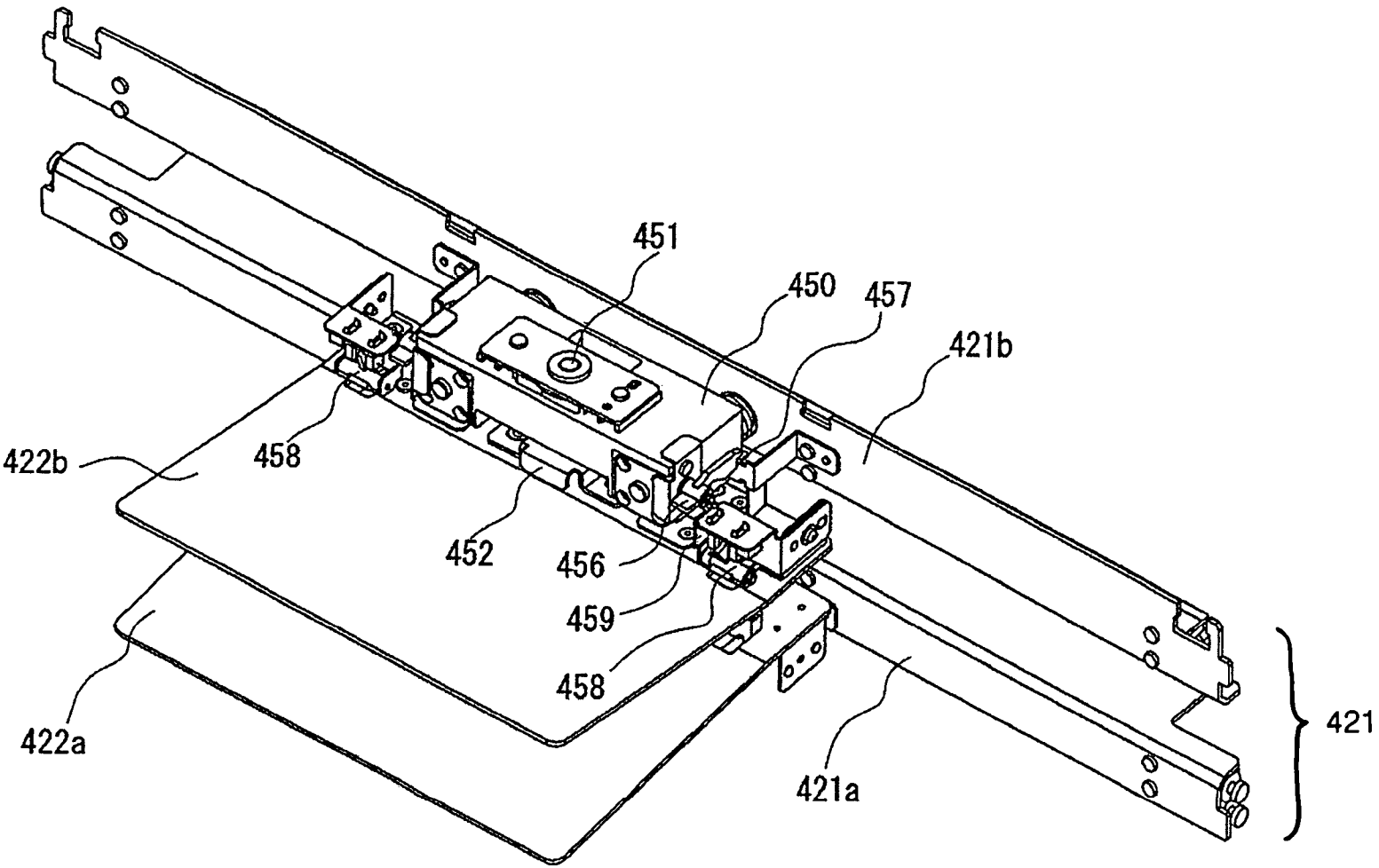
FIG. 11 is a perspective view of the configuration of a second gripping conveyance means according to the apparatus of FIG. 1A.

As shown in FIG. 11, this sub-clamper 422*a* has a guide plate shape to guide a sheet bundle from the first gripping conveyance means 401 to the main clampers 421*a* and 421*b* and at the same time is structured to grip a central area of the sheet bundle. The mounting configurations of the upper and lower sub-clamps 422*a* and 422*b* are the same. The description will focus on the structure of the upper side sub-clamper 422*b*. A bracket 450 is mounted to the main clamper 421*b*. An upper clamper 422*b* is mounted to a shaft 315 supported on the bracket 450, interposed by a mounting seat 452. In the same way, the lower clamper 422*a* is rotatably mounted by a shaft on a fixed main clamper 421*a*.

Figure 12:
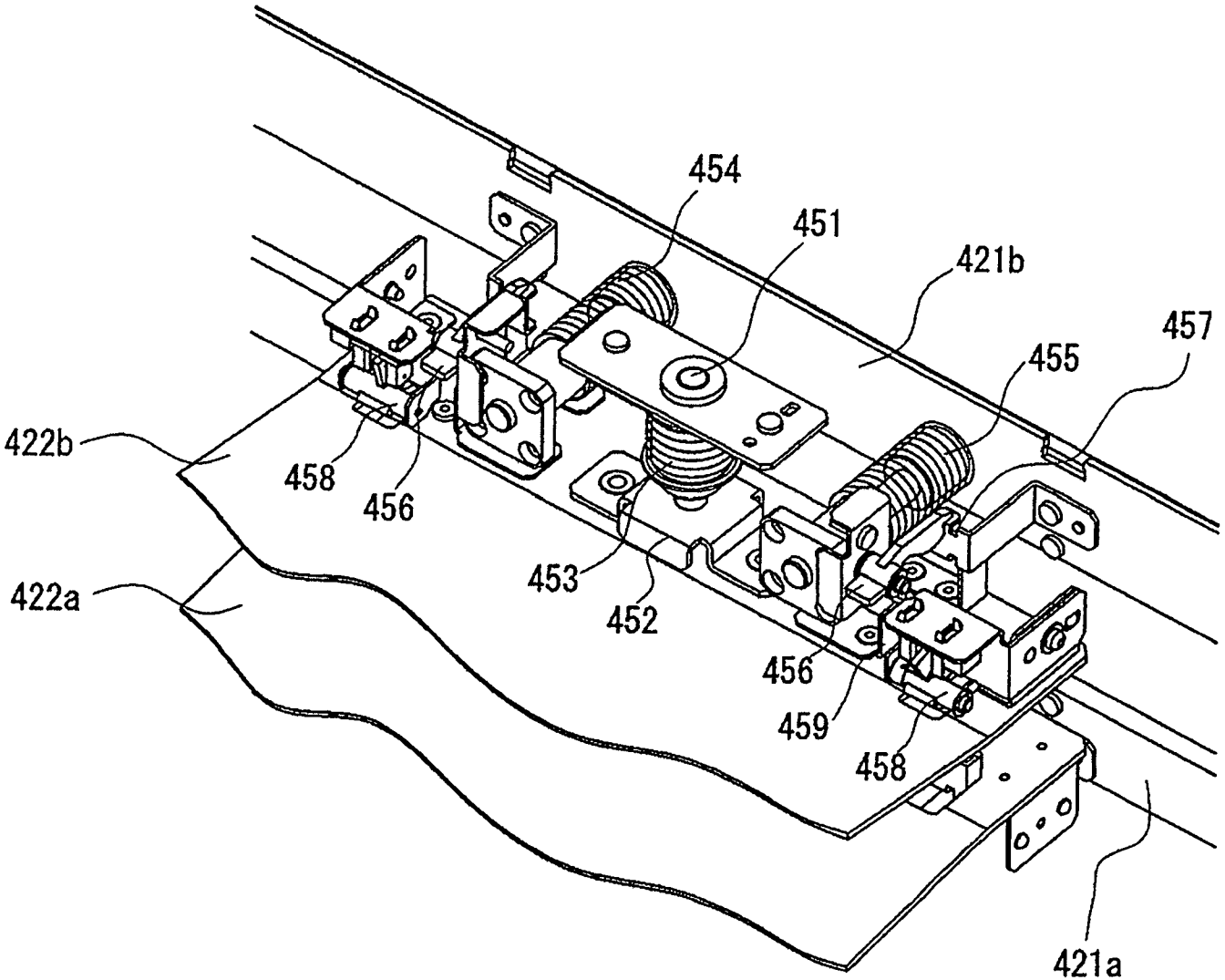
FIG. 12 is a detailed perspective view of the apparatus of FIG. 11.

A stock spring 453 is interposed between the mounting shaft 451 and the mounting seat 452. As shown in FIG. 12, springs 454 and 455 that maintain the posture of the sub-clamper 422*b* are disposed around the shaft 451. Therefore, the springs 454 and 455 positioned right and left sandwiching the shaft 451 to maintain the posture of the sub-clamper 422*b*. A lock claw 456 is also provided.

This lock claw 456 is equipped on the sub-clamper 422*b* side, and is configured to engage and separate from the engaging groove 457 formed on the bracket 450 on the main clamper 421*b* side. When engaged, the sub-clamper 422 checks rotation around the shaft 451 using detection sensor 451 for detecting the clamped state.

The drive motor M6 (FIG. 10A), described above, moves the main clamper 421's movable clamper 421*b* toward gripping the sheet bundle, and the sub-clampers 422*a* and 422*b* approach each other to engage the sheet bundle. After gripping the sheet bundle, the main clampers 421*a* and 421*b* further approaches while the spring 453 applies pressure. At that time a lock releasing piece 459 unlocks the lock claw 456. This causes the lock claw 456 to separate from the engaging groove 457 and the sub-clampers 422*a* and 422*b* to rotate freely around the shaft 451. Just prior to or afterward, the main clamper 421 grips the sheet bundle.

Figure 13:
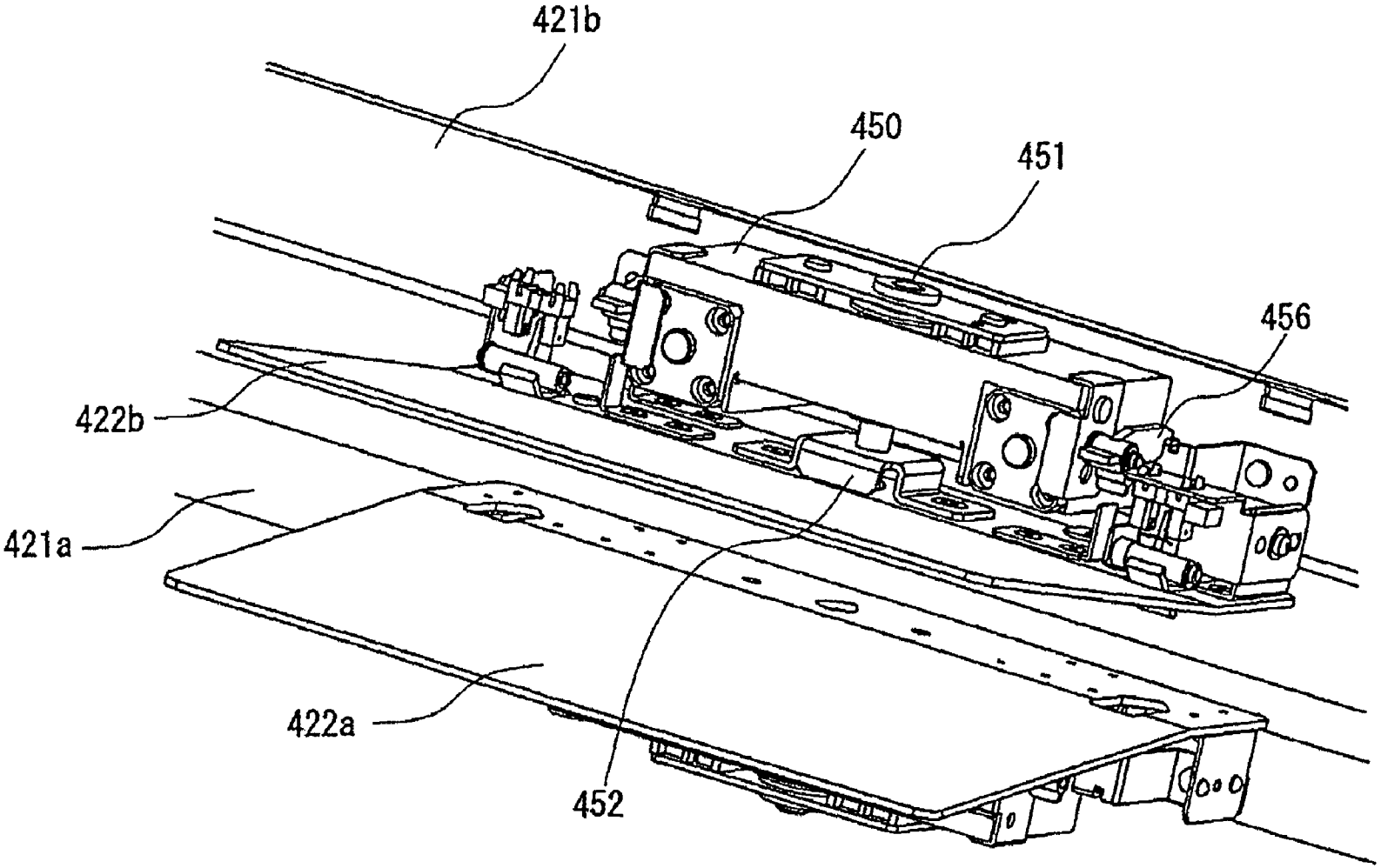
FIG. 13 is another perspective view of the apparatus of FIG. 11.
Figure 14:
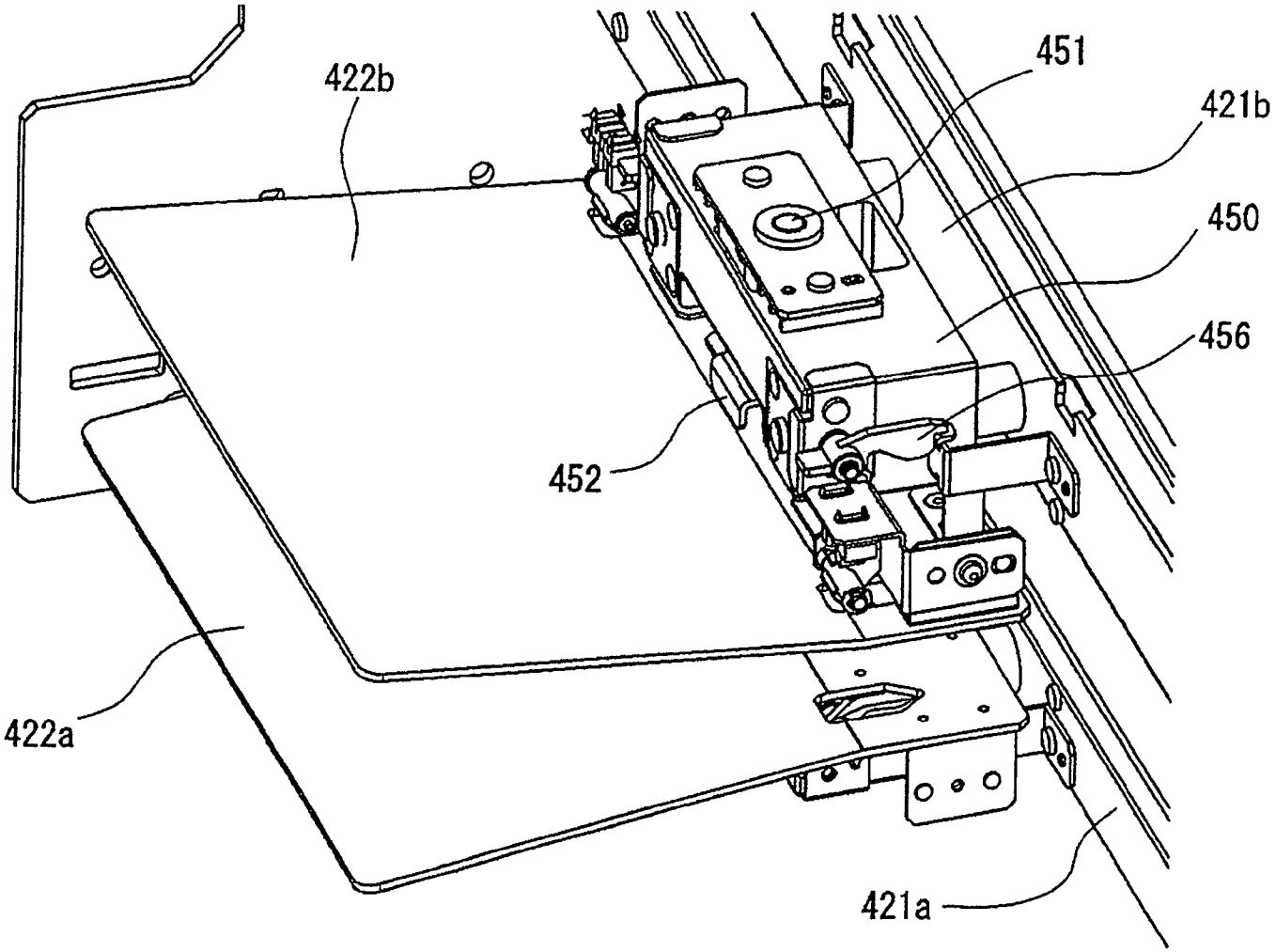
FIG. 14 is another perspective view of the gripping conveyance means of FIG. 11.

Specifically, FIGS. 12-14 show sub-clampers 422*a* and 422*b* rotatably mounted to the main clamper 421, and at the same time, the sub-clampers 422*a* and 422*b* provide a guide plate function for guiding a sheet bundle to the main clamper 421. Until the sheet bundle is sandwiched by the main clamper 421, the lock claw checks the rotation of the sub-clampers 422*a* and 422*b*. After the sheet bundle is gripped by the main clamper 421, the sub-clamper 422*a* is configured to rotate. Note that the sub-clamper 422*a* is able to rotate to correct the posture of a biased sheet bundle, as described below.

Individual drive means are not used for the clamping action of the main clamper 421 and the sub-clampers 422*a* and 422*b*. Rather, the clamping action of the main clamper 421 executes the clamping action of the sub-clampers 422*a* and 422*b*. For the structure to enable that, the sub-clampers 422*a* and 422*b* are mounted to each of the main clampers 421 that are capable of approaching and separating from each other, interposed by the spring 453. With the approaching action of the main clampers 421, the sub-clampers 422*a* and 422*b* nip the sheet bundle, then the main clampers 421 grip the sheet bundle while the action of the spring 453 urges.

Conversely, to release, the main clampers 421 withdraw from the sheet bundle, and the sub-clampers 422*a* and 422*b* also withdraw from the sheet bundle. Then, the main clampers 421 release the sheet bundle and while the sub-clampers 422*a* and 422*b* are gripping the sheet bundle, they rotate around the shaft 451 when the main clampers 421 release the sheet bundle. The sub-clampers 422*a* and 422*b* simultaneously maintain the sheet bundle posture without rotating when the main clampers 421 are gripping. A positioning member 436 (FIG. 15A) is configured as an integrally formed projection comprising a gripper disposed on the main clampers 421*a* and 421*b*. The following will explain its structure and its action.

Figure 15A:
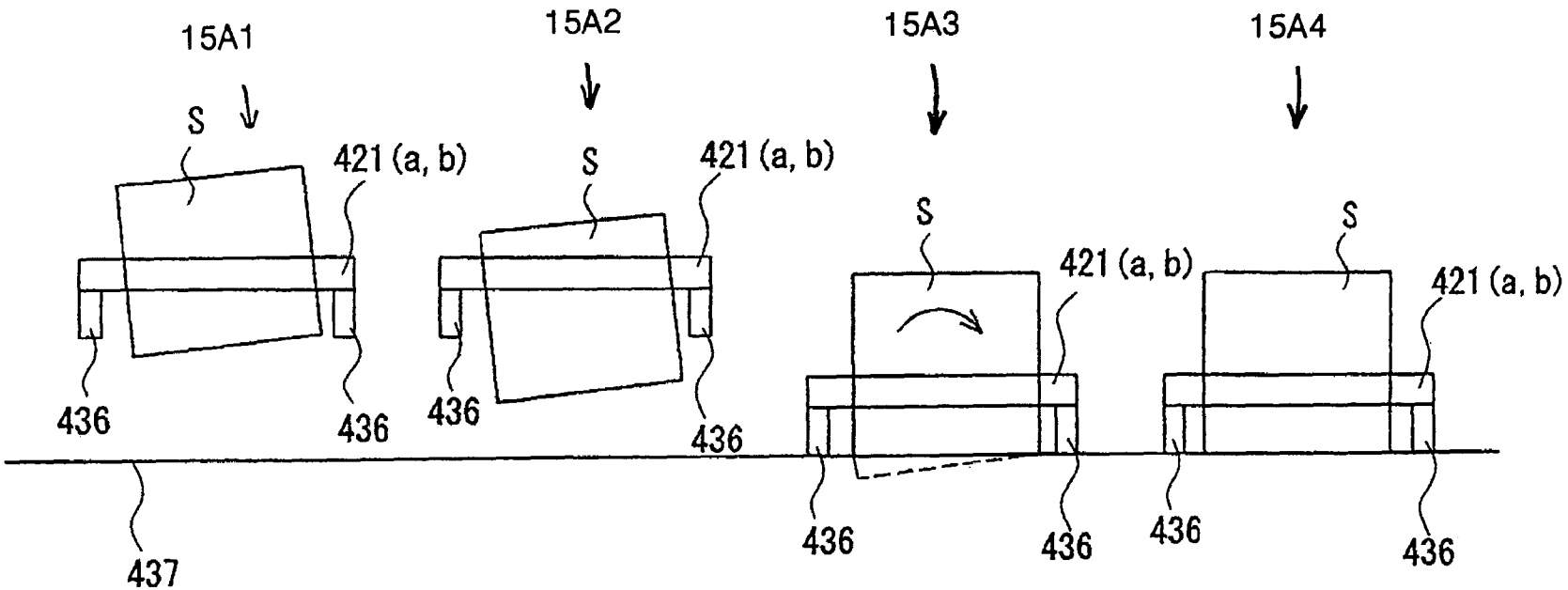
FIG. 15A illustrates posture correction positions of the gripping conveyance means of FIG. 11.
Figure 15B:
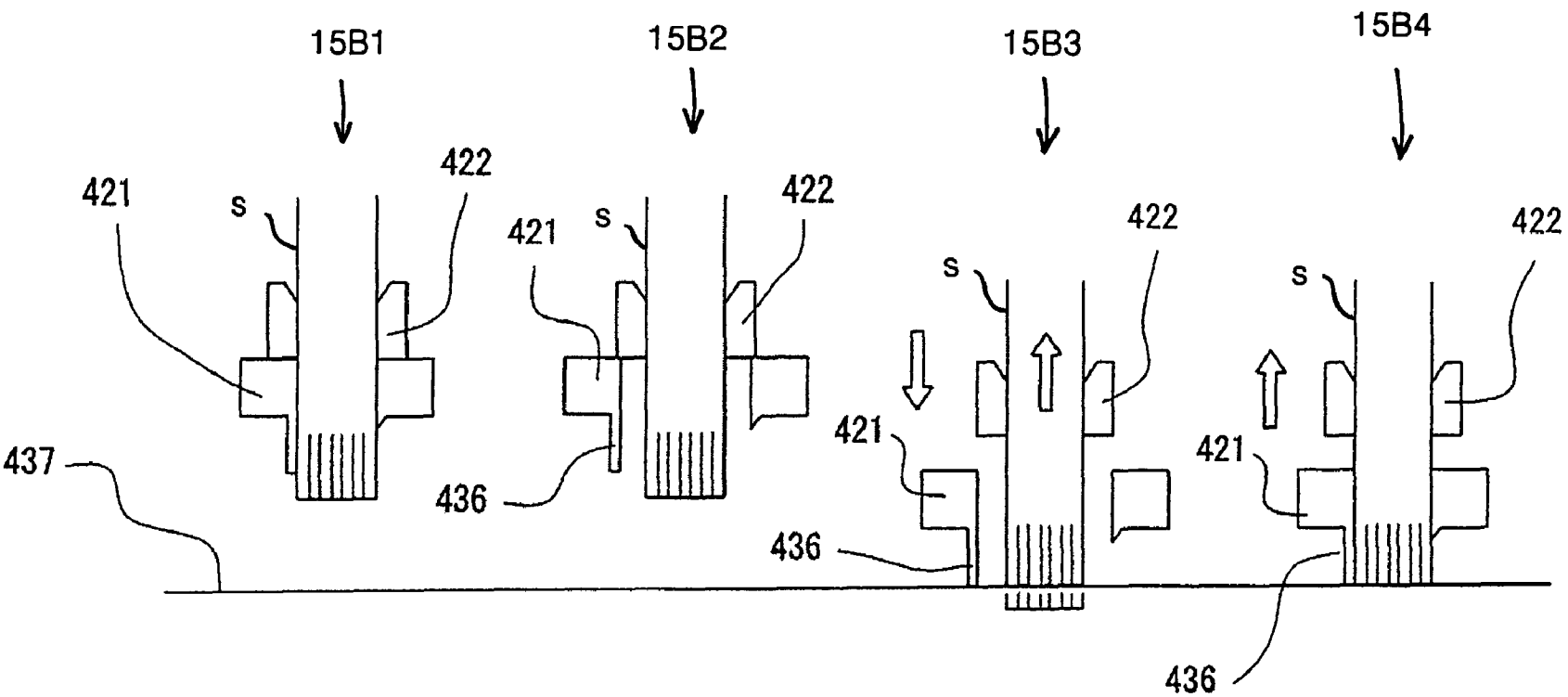
FIG. 15B illustrates additional posture correction positions of the gripping conveyance means of FIG. 11.

FIGS. 15A and 15B show operational states of the gripping conveyance means 420. FIG. 15B is viewed from a position rotated 90 degrees to the right or left of FIG. 15A. Accordingly, states 15A1 of FIGS. 15A and 15B1 of FIG. 15B are the same states. Similarly, 15A2 and 15B2, 15A3 and 15B3, and 15A4 and 15B4 are also the same states. States 15A1 and 15B1 show handing a sheet bundle SB from the first gripping conveyance means 401 to the main clampers 421 and sub-clampers 422, the movable clamper 421*b* acting by operation of the drive motor M6 to grip the sheet bundle SB, which, at this time is being gripped slightly askew.

The sheet bundle SB is gripped by both the main clampers 421 and sub-clampers 422 in the state 15A1, and the sheet bundle SB received at a substantially horizontal posture from the first gripping conveyance means 401 is rotated approximately 90 degrees to be substantially vertically oriented.

Next, 15A2 and 15B2 refer to an operation state wherein the drive motor M6 operates to shift each clamper from a first gripping position to a slightly loosened second gripping position. At this time, the main clamper 421 is positioned at a non-engaged releasing position from the sheet bundle SB, and the sub-clampers 422 are positioned at an operating position where they grip the sheet bundle SB. Therefore, the sheet bundle SB separates from the main clampers 421 and is supported by the springs 454 and 455. The sheet bundle SB is then in a state near a processing position therebelow under its own weight.

Next, 15A3 and 15B3 refer to an operation state wherein the drive motor 7 (see FIG. 8) operates to move the sheet bundle SB to a processing position. A reference member 437 that engages and regulates an edge of the sheet bundle is provided at the processing position. Therefore, the sheet bundle SB posture is corrected by touching its processing edge against the reference member 437. When a positioning member 436 of the main clampers 421*a* and 421*b* touches the reference member 437, the drive motor M7 stops. A sensor, not shown, may detect that the main clampers 421*a* and 421*b* has touched the reference member and generate a signal to control, i.e., stop, the drive motor M7.

Next, 15A4 and 15B4 illustrate a state wherein the sheet bundle SB and main clampers 421*a* and 412*b* touching the reference member. At that time, the drive motor M6 rotates in the gripping position and the movable gripper grips the sheet bundle. Therefore, in the state of 15A4 and 15B4, the sheet bundle SB is securely gripped by the main clampers 421*a* and 421*b* and the sub-clampers 422*a* and 422*b* (FIG. 14) and its posture is maintained. Next, the drive motor M7 rotatingly drives in a direction opposite to the previous direction in order to move the sheet bundle SB in an upward direction, where the gripper conveyance means 420 is returned to the state of 15A1 and is ready for the next process.

The following will explain the operations of each unit according to the states shown from S1 to S11 in FIGS. 16A-16D. S1 shows a sheet S conveyed from the discharge path 107 to the tray means 305, and placed in a stack. First, a signal for a job from the bookmaking system is obtained. The inserter unit B recognizes the size of the conveyed sheet. To recognize the size of a sheet S, either a size signal of the sheet formed with images is received from the image printing unit A, or a size detection sensor can be arranged in the discharge path 107 for detection. Another alternative is to use a method for an operator to input the paper size on an operation panel. Furthermore, the size may be determined based on the length direction of sheet discharge in order to control the operation of the motor M1 and to move the movable support unit 305*b* to a predetermined position and stop it at that position. Similarly, a drive motor, not shown, moves the pressing piece 323 to a predetermined position.

The movable support unit 305*b* and pressing piece 323 are preset at positions where sheets can be securely aligned in the width direction by the aligning means 314 with the leading edge of the sheet hanging downward to form a bend in the sheet S, and the rotating shaft 313 can securely execute the operation to convey the leading edge of the sheet S to a first aligning member 311.

Sheet S is conveyed from the sheet supply path 203, and at that time, the sheet is guided by the guide member 312 to the fixed support unit 305*a* positioned above the discharge outlet 304. The rotating shaft 313 idles above the tray, and the aligning members 315*a* and 315*b* idle at the outer side in the direction of sheet width. Then, at S2, as the sheet advances into the tray, the rotating shaft 313 lowers to a position to touch the sheet on the tray, and helps the sheet advance into the tray by rotating in the clockwise direction. At S3, the rotating shaft 313 rises as the leading edge of the sheet advances into the tray. The guide member 312 moves to a position to guide the sheet along the top of the tray, shown in the drawing.

Next, the rotating shaft 313 lowers to a position to touch the sheet on the tray, and rotates in reverse in a counterclockwise direction to move the trailing edge of the sheet (the right side of the drawing) toward the first aligning means 311. The guide member 312 guides the sheet. At the state of S5 in the drawing, after an estimated amount of time for the leading edge of the sheet to arrive at the first aligning means 311, the rotating shaft stops. At S6, the guide member 312 retracts above the tray, and at S7, the rotating shaft 313 retracts in an upward direction.

Figure 16A:
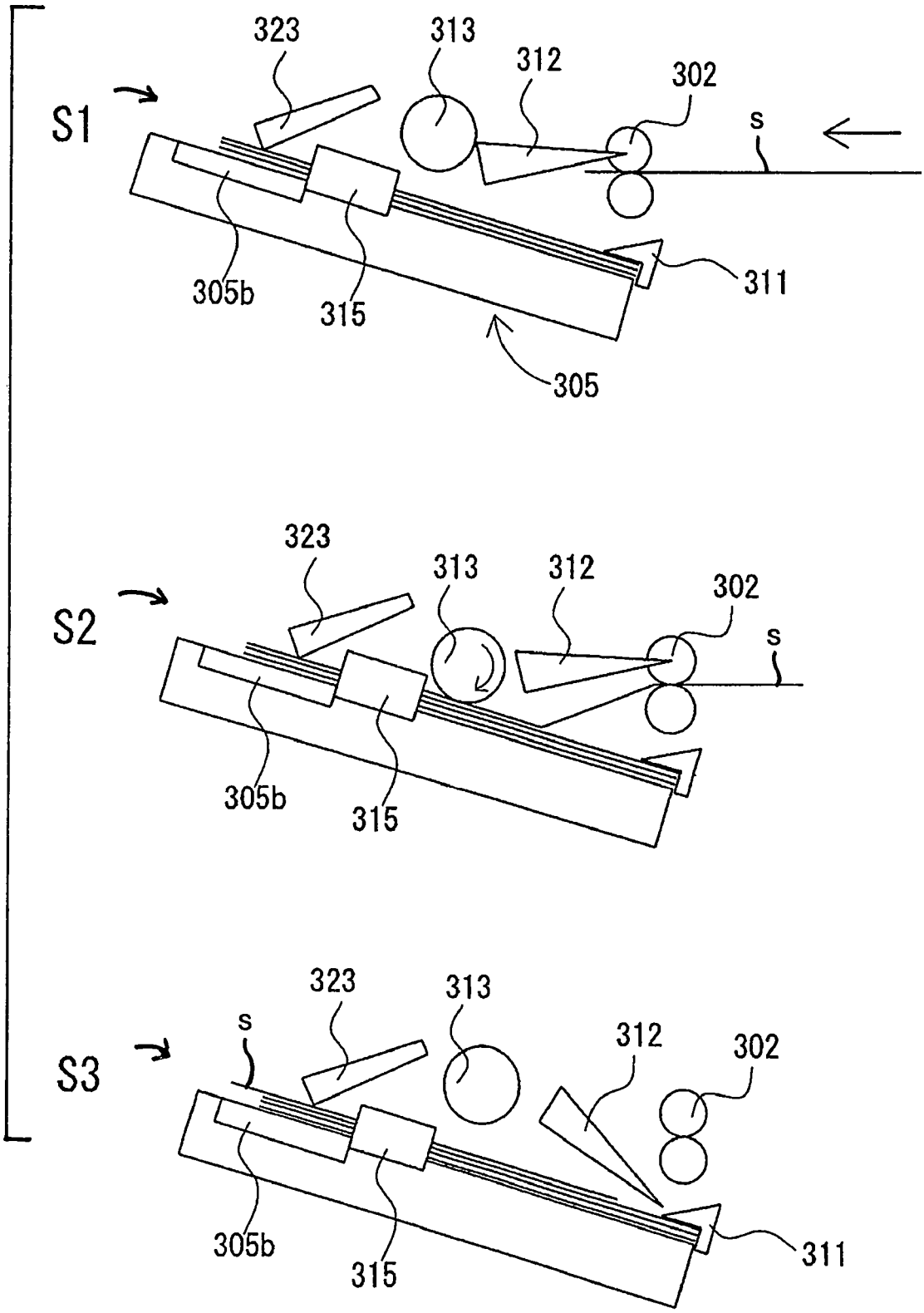
FIG. 16A illustrates sheet stacking operations according to the apparatus of FIG. 1A.
Figure 16B:
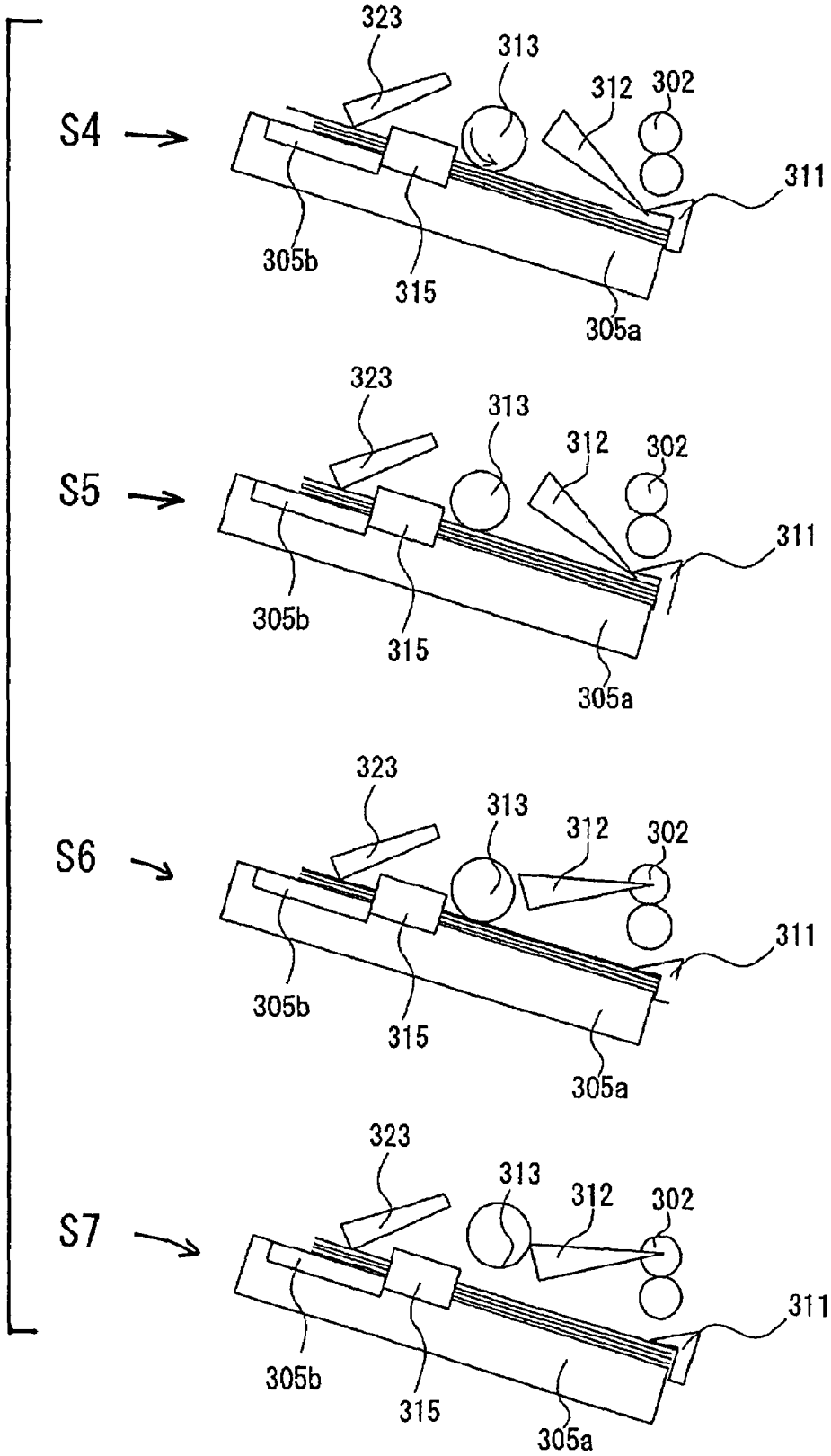
FIG. 16B illustrates additional sheet stacking operation according to the apparatus of FIG. 1A.
Figure 16C:
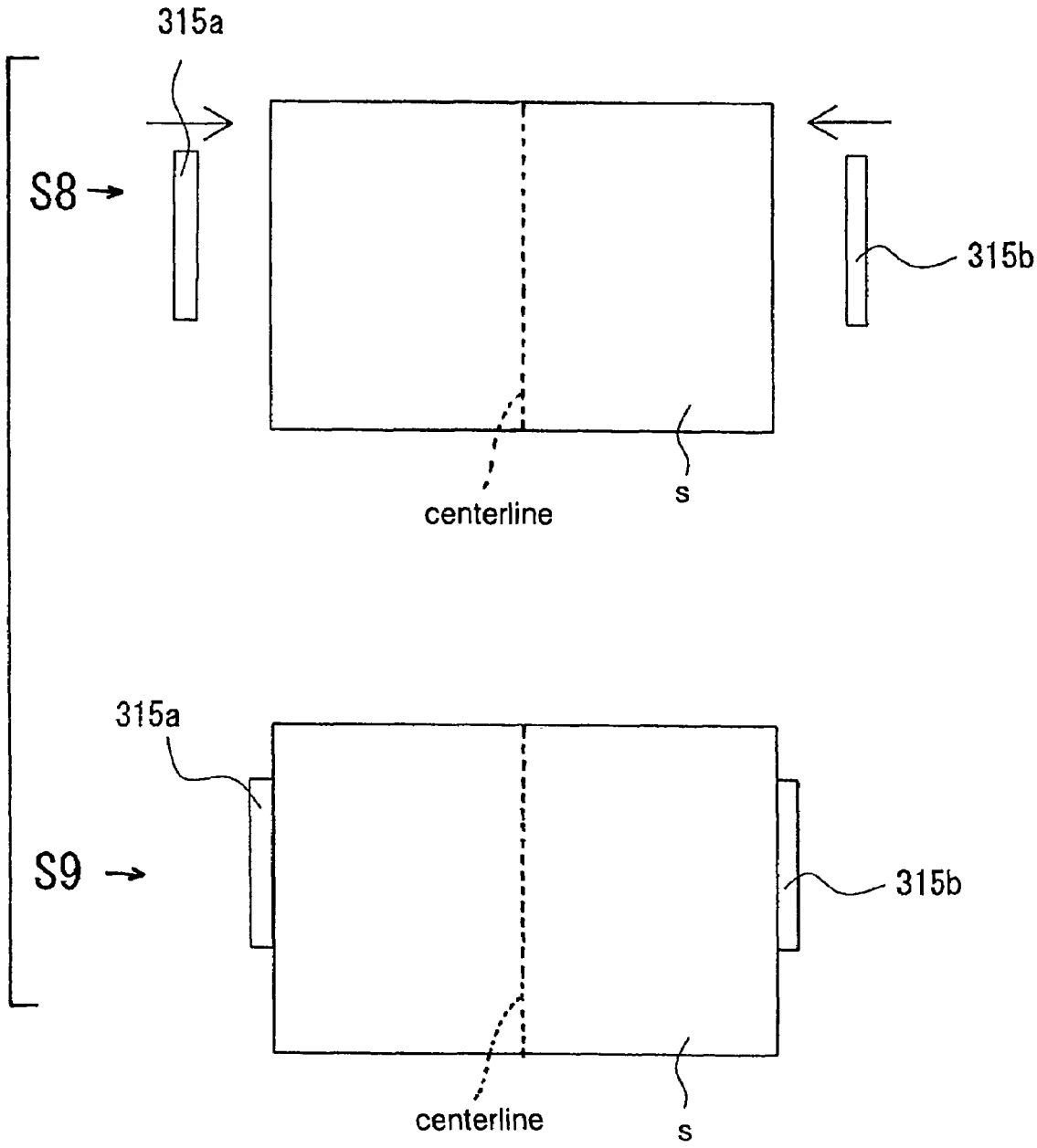
FIG. 16C illustrates operating positions of aligning members.
Figure 16D:
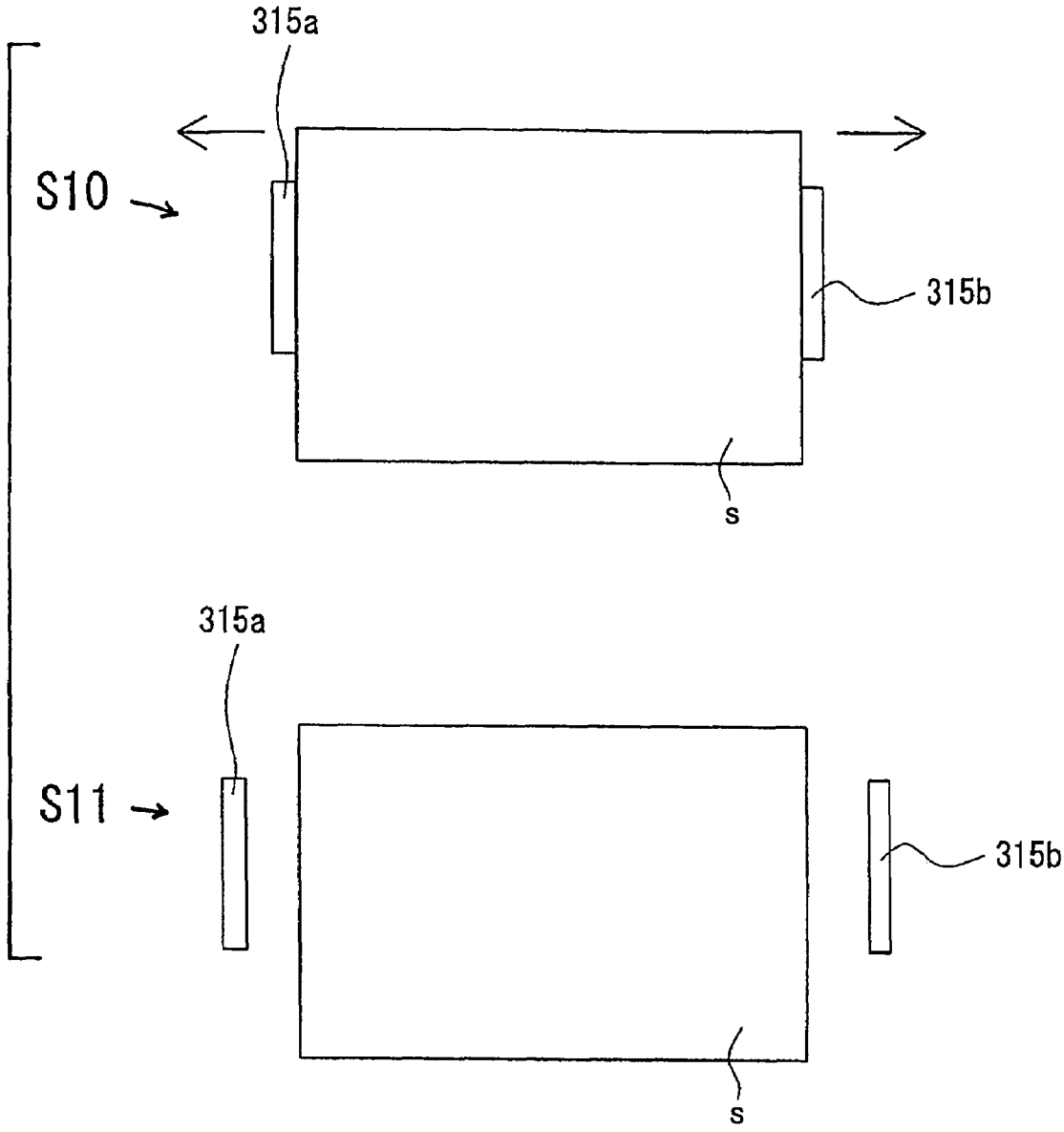
FIG. 16D illustrates additional operating positions of aligning members.

In this state, the sheet is supported by the fixed support unit 305*a* and movable support unit 305*b* of the tray. The sheet is placed in a free state, other than by being pressed by the pressing piece 323. At state S7 (FIG. 16A), and after idling at a state S8 (FIG. 16C), the left and right aligning members 315*a* and 315*b* engage the sides of the sheet (FIG. 16C state S9) by operation of the drive motors M2*a* and M2*b* (FIG. 4), to move the sheet S in a width direction based on a center line. Referring now to FIG. 16D, the aligning members 315*a* and 315*b* move in the direction of the arrows from a state S9 i.e., after width aligning the sheet at S10, to return to the idling state at S11.

Repeating the steps of the operations from S1 to S11 for each sheet S stacks sheets from the discharge outlet 304 onto the tray means. At this time, the trailing edge of the stacked sheets are at the first aligning means 311 and the left and right sides of the sheets are positioned and aligned at the left and right aligning members 315*a* and 315*b* so the sheets are neatly stacked. In this way the pages of a series of sheets are stacked in page order, and upon receiving an end signal from the image printing unit A, the stacking process is completed.

Next, the inserter unit B uses a stack conveyance mechanism unit to convey the sheet bundle to the next process. FIGS. 17A to 17E show the operations of the first gripping conveyance means 401, from states T1 to T18. In FIG. 17A, the upper clamper 403 and lower clamper 404, disposed on the left and right sides positioned at the side edges of sheets on the tray means 305, move to a position that is compatible with the sheet size, by operation of the drive motor M10 (FIG. 2) and rack 413. Next, the clamper 403 positioned above the top surface of a sheet moves by the drive motor at the state of T2. At T3, the clamper 403 touches the top surface of the sheet. Around that time, the drive motor M4 moves to above the rack 406, and the clamper 404 positioned at the bottom surface of the sheet rises to touch the bottom surface of the sheet. Note that at this time the tray assembly 332 lowers by operation of the drive motor M3, and with the action of the fan-shaped gears 338, the auxiliary tray 305*c* moves to a position retracted from the sheets. Consideration is given not to interfere with the gripping action of the clamper 404.

Figure 17B:
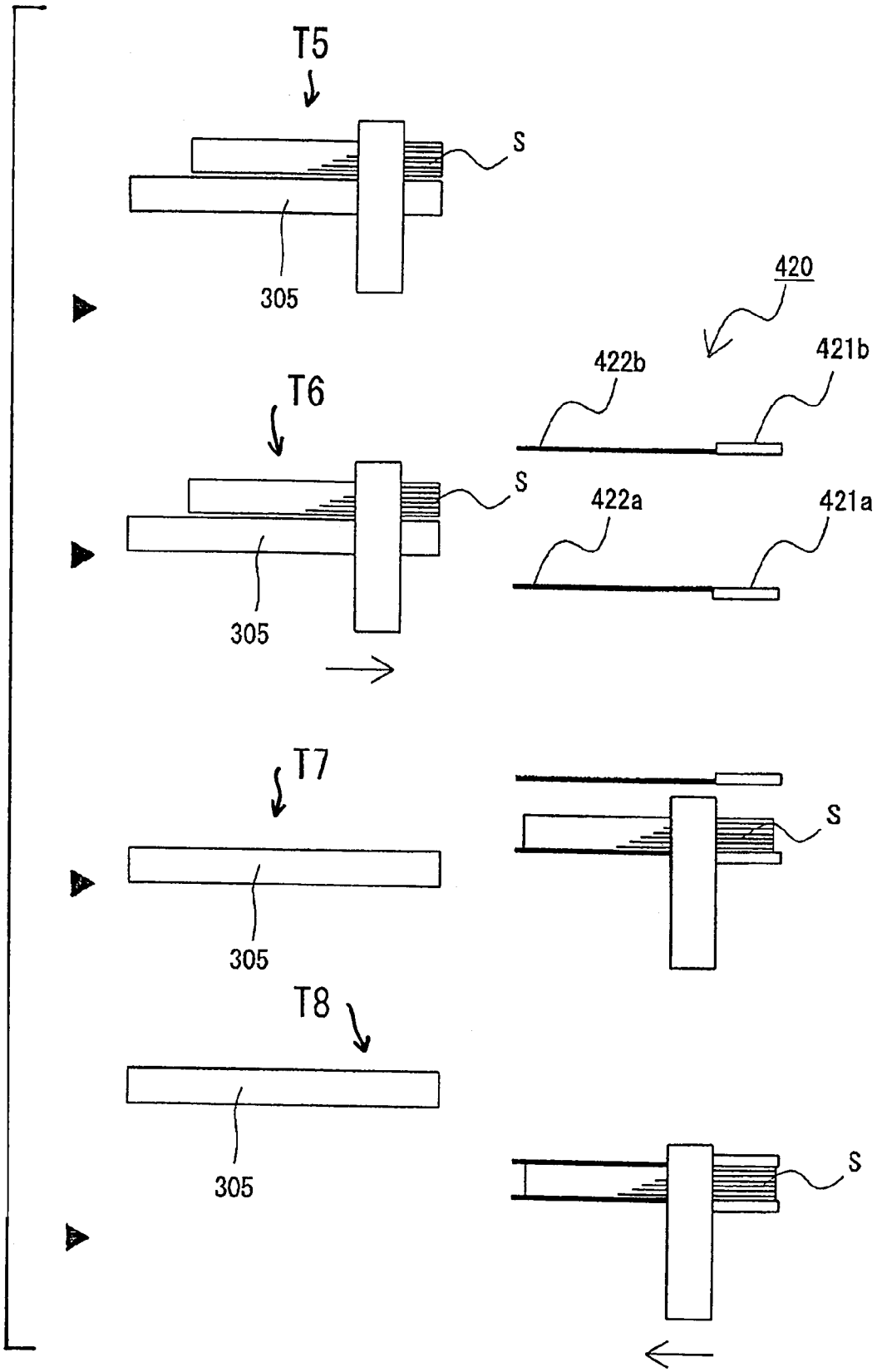
FIG. 17B illustrates additional operational positions of the gripping conveyance means.
Figure 17C:
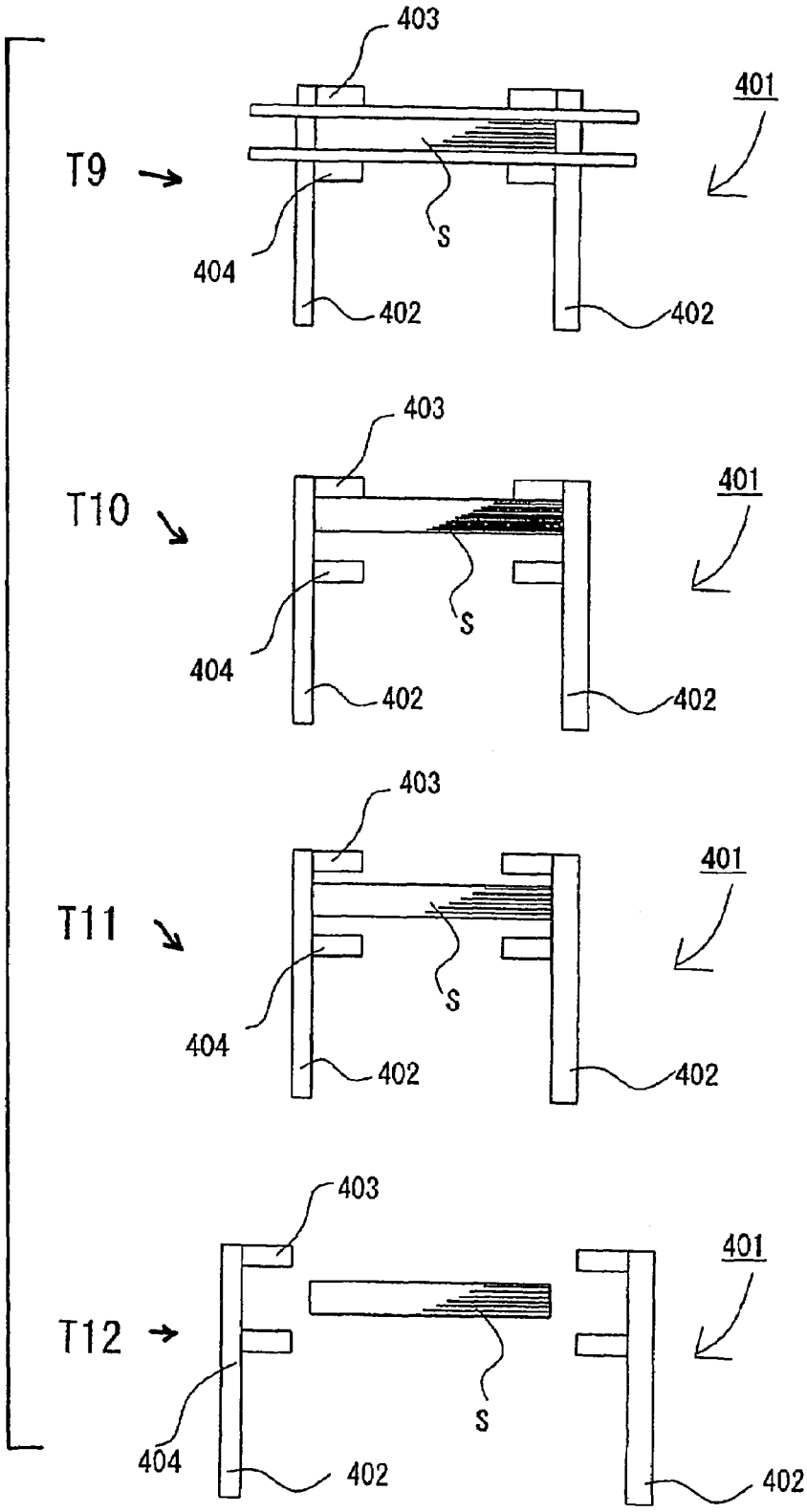
FIG. 17C illustrates additional operational positions of the gripping conveyance means.
Figure 17D:
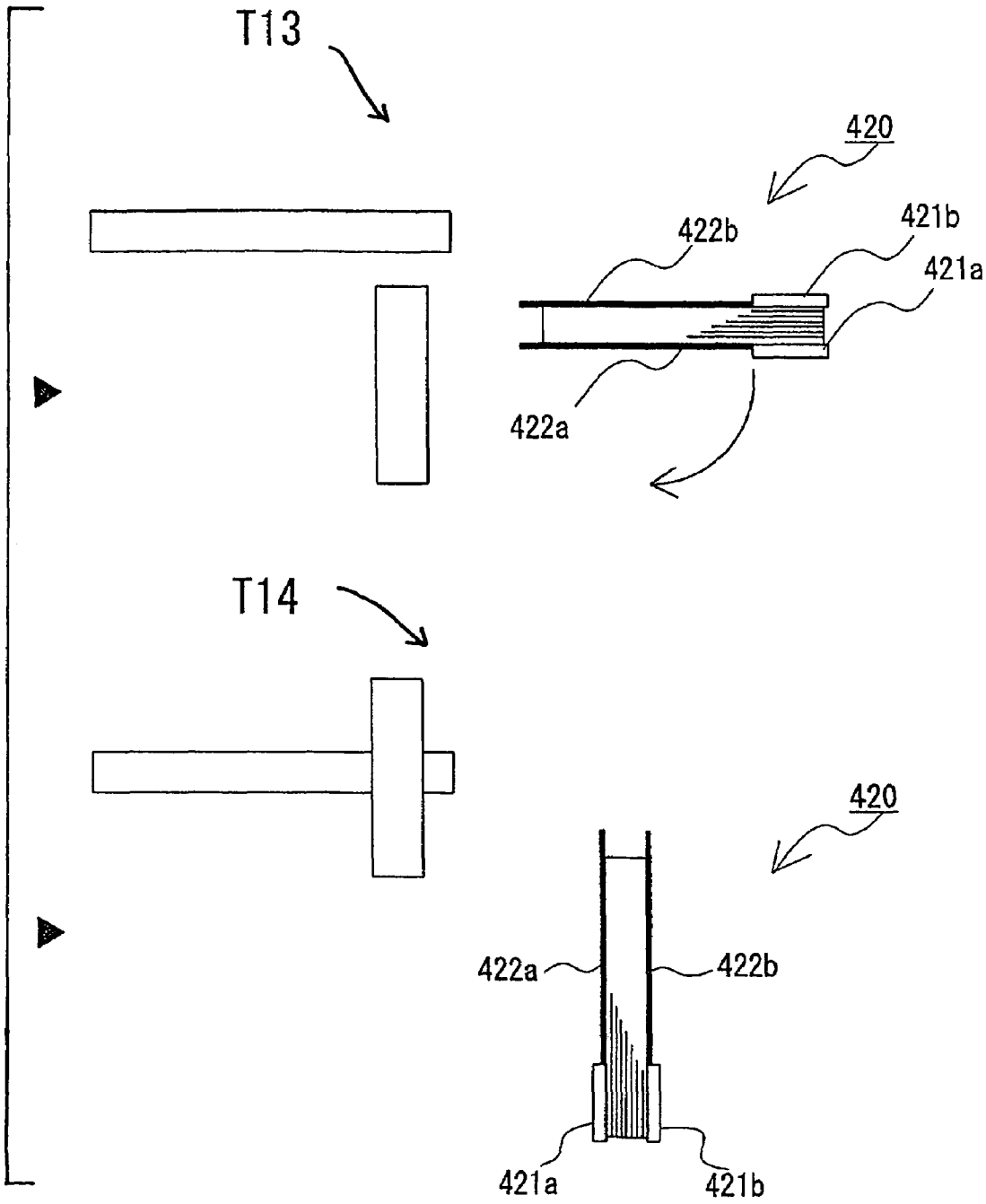
FIG. 17D illustrates additional operational positions of the gripping conveyance means.
Figure 17E:
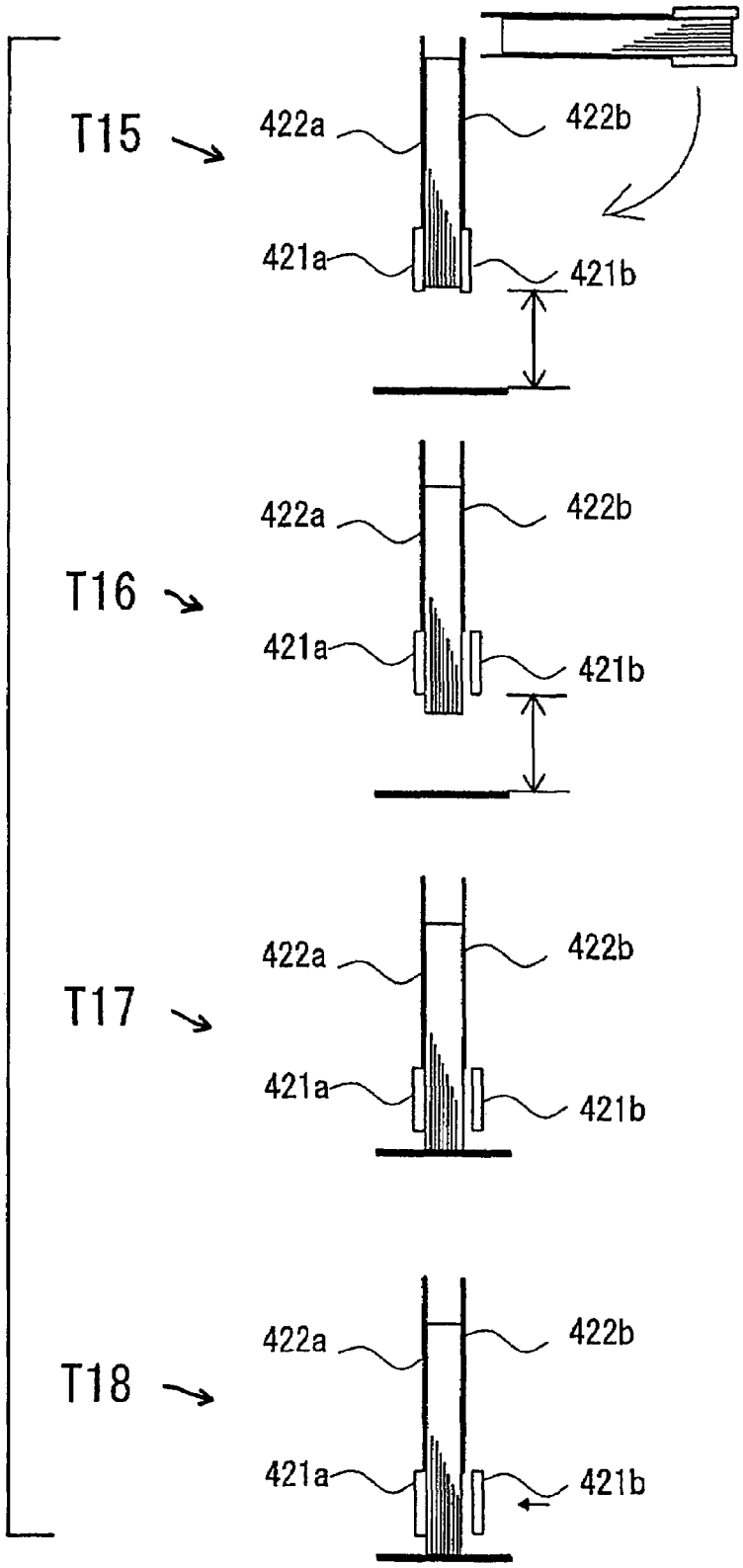
FIG. 17E illustrates additional operational positions of the gripping conveyance means.

Next, T5 to T8 of FIG. 17B shows the elevator action of the tray assembly 332. At T5, sheets are in a stacked and stored state, and the tray assembly 332 is at a raised position. At T6, the tray assembly 332 is at a lowered position, where the sheet bundle is at a conveyance position. The rotation of the drive motor M3 rotates the shaft 334 (FIG. 6) in a clockwise direction, lowering the tray assembly 332 from its raised state (T5) to the conveyance position (T6). The right side wing-shaped auxiliary tray 305*c* (FIG. 6) rotates in a clockwise direction with the rotation of the fan-shaped gear 338 by being interlocked with the lowering of the tray assembly, thereby moving auxiliary tray 305*c* to a position disengaged from a sheet bundle. After the movement of the auxiliary tray 305*c*, the first gripping conveyance means 401 (FIG. 17A) executes the operations of T1 to T4, described above. After gripping the sheet bundle, the rotation of the drive motor M1 lowers the first gripping conveyance means 401 from the T5 position (the raised position) to the T6 position (the conveyance position) in synch with the tray assembly 332.

The second gripping conveyance means 420, composed of the main clampers 421 and the sub-clampers 422*a* and 422*b*, idles at the T6 position. The first gripping conveyance means 401 moves in the direction of the arrows in the drawings from the T6 position, and conveys the sheet bundle on the tray assembly 332 toward the second gripping conveyance means 420. The channel-shaped guide rail 402 is guided along a guide rail 408 for the first gripping conveyance means 401 and moves by the drive motor M1 that meshes with the rack 434.

Next, the sheet bundle is conveyed from the tray assembly 332, and the first gripping conveyance means 401 stops at the T7 state. The reverse rotation of the drive motor M3 starts raising the tray assembly 332 toward the raised position. Simultaneous to this, the drive motor M6 (see FIG. 10A) rotates to move the second gripping conveyance means 420 to the fixed clamper 421*a* side that opposes the movable clamper 421*b*.

Then, as shown at T8, the tray assembly 332 recovers to its raised position, and the sheet bundle is gripped by the second gripping conveyance means 420. The first gripping conveyance means 401 starts recovery movement in the direction of the arrow in the drawing. The lower clamper 404 lowers from the state of T9, where it was gripping the sheet bundle simultaneously with the second gripping conveyance means 420 to separate from the sheet surface (the state of T10) for this recovery movement. Next, at T11, the upper clamper 403 rises to separate from the sheet surface, and moves to its initial state of T12.

At the same time as the releasing action of the clampers, the first gripping conveyance means 401 recovers in the horizontal direction from the state of T8 to the state of T13, and then recovers to a vertical direction at T14.

Along with the recovery operation of the first gripping conveyance means 401, the second gripping conveyance means 420 rotates in the clockwise direction with the drive motor M5 in the state shown in FIG. 10A. At this time, the second gripping conveyance means 420 turns the sheet bundle from the state of T13 (a horizontal posture) to a vertical posture in T14. At the state of T15 where the sheet bundle is turned to a vertical posture, a reference member 437 is provided at a finishing position that applies adhesive to the sheet edges.

Then, the drive motor M6 (FIG. 10A) of the second gripping conveyance means 420 rotates in a grip releasing direction to hand over the movable clamper 421*b* from the fixed clamper 421*a*. The main clampers 421*a* and 421*b* separates from the sheet bundle with the releasing of the main clamper 421*b*, and the sub-clampers 422*a* and 422*b* continue to grip the sheet bundle. When this occurs, the sheet bundle is gripped by the sub-clampers 422*a* and 422*b* while the main clampers 421 are disengaged. The sheet bundle falls slightly with the action of the springs 454 and 455, as explained in relation to FIG. 12.

Next, the drive motor M7 rotates to lower the movable side frame 429 a predetermined amount, as shown in FIG. 9. When the second gripping conveyance means 420 lowers to the state of T17, the sheet bundle touches the reference member 437. Any inclination, such as skewing in the sheet bundle gripped by the sub-clampers 422*a* and 422*b* and in contact with the reference member 437, is corrected because the sub-clampers 422*a* and 422*b* are configured to rotate with the shaft 451. After correcting skewing in the sheet bundle, the drive motor M6 (FIG. 10B) rotates in the gripping direction to grip the sheet bundle by the main clampers 421*a* and 421*b* for the second gripping conveyance means 420. The operation of the main clampers 421*a* and 421*b* maintains the posture of the sheet bundle without it rotating.

Adhesive Application Unit

As shown in FIG. 1 and describe above, the second gripping conveyance means 420 is arranged on a substantially vertical path (hereinafter referred to as a first path) 100 for moving the sheet bundle for the adhesive application unit E. The adhesive application unit E applies adhesive to the bottom edges of the sheet bundle gripped by the second gripping conveyance means 420. Referring to FIGS. 19A and 19B, the adhesive application unit E comprises an adhesive tray 61 for containing adhesive; an adhesive roll 62 rotatably mounted to this tray; a drive motor M11 for rotatingly driving the adhesive roll 62; and a drive motor M12 for reciprocating the tray 61 along the sheet bundle.

As shown in FIGS. 19A and 19B, the adhesive tray 61 is formed to be shorter (dimensions) than the bottom edges of a sheet bundle SB. Tray 61 is configured to move along with the adhesive roll 62 along the bottom edges of the sheets. It is also perfectly acceptable to configure an adhesive tray 61 that is tray-shaped and longer than the sheet bundle bottom edge, and to move only the adhesive roll 62 in the left and right directions of the drawing. Therefore, the adhesive roll 62 is composed of an adhesive application member for applying adhesive to the sheet bundle, and this roll may be composed of a porous material, impregnated with adhesive and is formed to build-up a layer of adhesive on its outer circumference.

FIGS. 19A and 19B show the adhesive application unit E of the apparatus of FIG. 1A and the structure of a unitized cover sheet conveyance mechanism. This is detachably incorporated with the apparatus of FIG. 1A. The first path conveys a sheet bundle in the X-X arrow directions of the drawing, and a second path conveys a cover sheet in the Y-Y arrow directions of the drawing. The adhesive tray 61 is arranged above a joining stage 150 (FIG. 1B) with the sheet bundle and cover sheet. Movement of the adhesive tray 61 is guided along the guide rail (rod) 66, and the adhesive tray 61 is linked to a drive motor M11 interposed by a timing belt 65 that is parallel to this rail. Therefore, the adhesive application unit E is reciprocally moved along the bottom edge of the sheet bundle gripped and held at the position by the second gripping conveyance means 420, by operation of the drive motor M11.

The movable side frame 429 mounted with the main clampers 421*a* and 421*b* and sub-clampers 422*a* and 422*b* (hereinafter referred to as the clamper members 420) is configured to move in a vertical direction guided by the guide rail, as described above. The movable side frame 429 is connected to a drive motor M7 interposed by a rack 434 and pinion 435. (See FIGS. 9, 10A and 10B.) Forward and reverse rotations of the drive motor M7, as described above, controls the up and down direction movement of the clamper members 420*a* and 420*b* that grip the sheet bundle.

The following will explain the adhesive dispensing method by the adhesive application unit E to the sheet bundle SB in this configuration, with references to FIGS. 26A, 26B, 27A, 27B and 27C. FIG. 26A shows a plan view of the sheet lower edge S1, which is the adhesive application edge of the sheet bundle SB, and the adhesive application unit E. This shows the adhesive tray 61 that composes the adhesive unit configured to move reciprocally along the guide rail 66 by the drive motor M11. FIG. 26A shows the adhesive unit moving in one direction, and FIG. 26B shows the adhesive unit moving in a return direction.

Figure 27A:
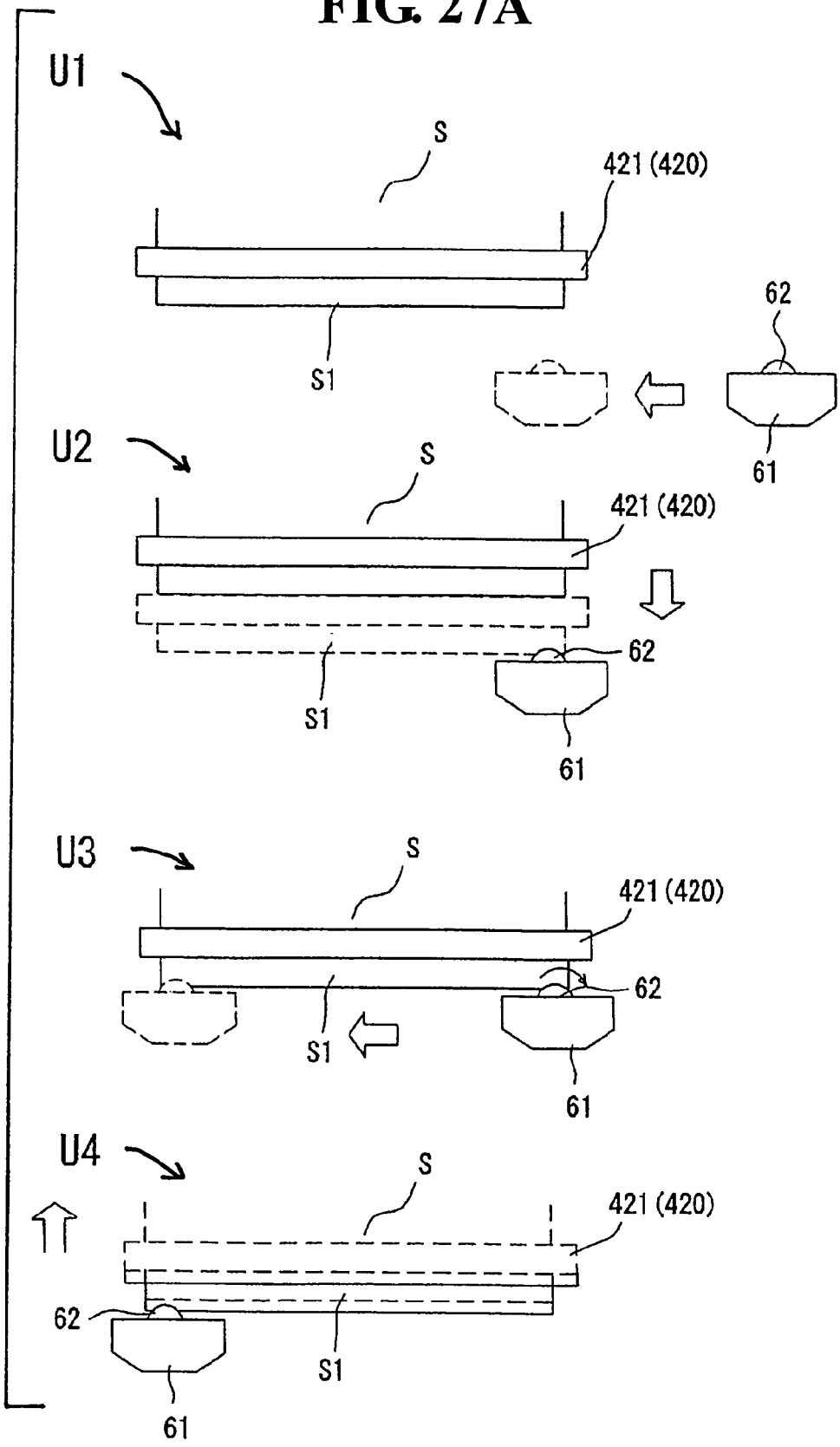
FIG. 27A illustrates adhesive being dispensed in the apparatus of FIG. 19A.
Figure 27B:
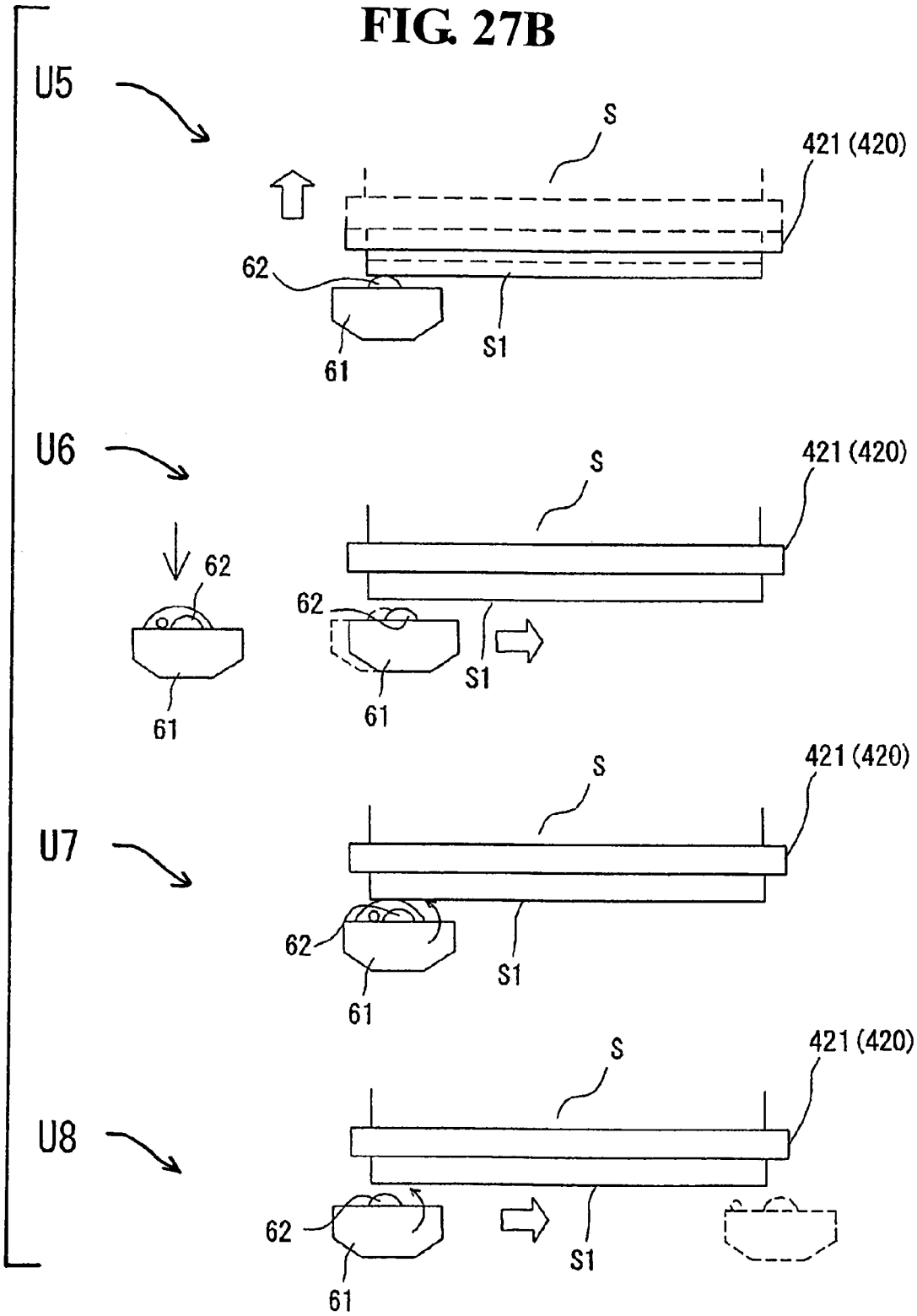
FIG. 27B illustrates adhesive being dispensed in the apparatus of FIG. 19A.
Figure 27C:
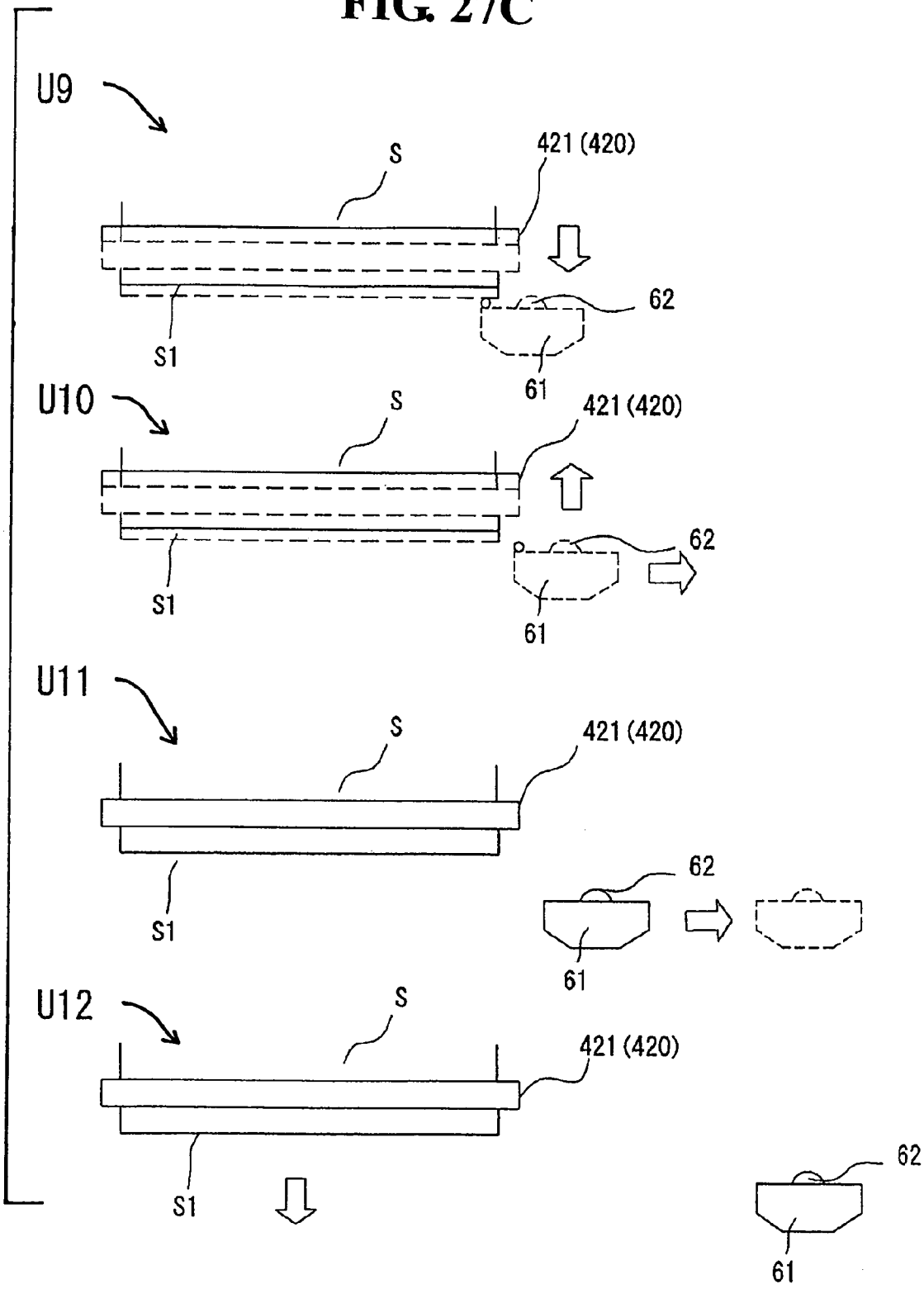
FIG. 27C illustrates adhesive being dispensed in the apparatus of FIG. 19A.

To explain the adhesive method based on FIGS. 27A to 27C, the adhesive roll 62 (adhesive application member) reciprocally moves across the bottom edge S1 of the sheet bundle. In one way the roll surface presses against the sheet bundle and applies adhesive to between the sheets of the edge S1 thereof. Then, in the return path, the adhesive roll uniform applies adhesive to the sheet edge S1 with a minimal gap formed between the adhesive roll surface and the sheet edge S1. In that procedure, the adhesive application unit E moves from its home position (solid line) to the sheet edge (U1). The distance for the movement to the sheet edge is calculated from the home position, according to the sheet size above.

Next, U3 illustrates the drive motor M7 operating to lower the clamper members 421 a predetermined amount from an idling position (U1). The drive motor M7 is composed of a stepping motor for the movement amount of the clamper members. The movement amount is controlled by controlling the motor pulse from the initial position (home position) of the clamper members 420. Of particular note, in the outward path of the adhesive application unit E, the bottom side edge S1 of the sheet bundle and the surface (the outer circumference) of the adhesive roll 62 are touching each other. Specifically, the clampers 420 lower to a position where the bottom edge S1 of the sheet bundle overlaps the adhesive roll 62 fastened on the adhesive tray slidably supported on the guide rail 66.

This overlap amount is set according to the pressing force of the sheet edge and adhesive roll. The pressing force between the two is set to deform and open the sheet edges and allow adhesive to be applied between the sheets. The overlap amount in the outward path of the adhesive application unit E is preset, but it is acceptable to vary the overlap amount according to the thickness of the sheet bundle. In such a case, the overlap amount should be made greater as the thickness of the sheet bundle increases, to increase the pressing force. Note that sheet thickness detection will be described below.

With the positional relationship between the sheet bundle and the adhesive roll, the adhesive roll 62 moves from one end of the sheet bundle (the right end) to the other end thereof. The adhesive roll 62 rotates in the direction of the arrow in the drawings. The adhesive roll 62 and the adhesive application unit E stop when the adhesive roll 62 reaches the other end (left end) of the sheet bundle in the state of U4. Then, the clamp member 420 of the second gripping conveyance means rises to return to its home position (see the state of U5 in FIG. 27B). Next, the drive motor M7 rotates again to lower the clamper members 420 to a position where a minimal gap is formed between the bottom edge S1 of the sheet bundle and the adhesive roll 62. The amount of movement is controlled by controlling the pulses of the drive motor, as described above. The gap formed between the bottom edge S1 of the sheet bundle and the surface of the adhesive roll 62 is set to a degree that a built-up layer of adhesive formed on the surface of the adhesive roll touches the bottom edge S1, and is set to an optimum value found by experimentation of adhesive amounts adhering to a sheet side. After setting these conditions, the adhesive roll 62 recovers by moving to the state of U6.

The adhesive application operation forms an adhesive layer having a uniform thickness on the sheet bundle edge at the same time as applying adhesive between the sheets by forming a gap between the sheet bundle edge and the adhesive roll after the adhesive application operation. Because an excessive amount of adhesive adheres to the left and right edges of the sheet bundle edge, it is necessary to process the edges.

U7 shows the processing of the sheet bundle edges. After applying adhesive in the outward and return passes, the adhesive application unit E returns to the sheet bundle edges to remove the excess adhesive layer. A knife edge roll reduces the layer of adhesive at the edges. Next, the adhesive application unit E moves to the other end to remove excessive adhesive at that other end. The adhesive application unit E completes the application of adhesive with the above operations and returns to its home position (the states of U11 and U12), and grips the sheet bundle accordingly. The clamper members 420 also return to their home position.

Note that this explanation has focused on forming a minimum gap (without any contact between the sheet bundle bottom edge and adhesive roll) between the sheet bundle bottom edge S1 and adhesive roll surface for the adhesive dispensing operation in the return path of the adhesive application unit E. However, it is also acceptable for both the sheet bundle bottom edge S1 and adhesive roll surface to be in contact with less contact pressure than that of the outward path. In that case, the adhesive application unit E can apply adhesive between the pages of sheets at the outward path, and form a substantially uniform adhesive layer on the edge surface (the back portion) of the sheet bundle at the return path.

Cover Sheet Conveyance Mechanism

Referring to the system shown in FIG. 1A and the cover-sheet conveyance mechanism of FIGS. 28A-28F, the sheet supply path 203 of the inserter unit B is connected to the sheet conveyance in path 501, and the discharge path 301 is connected to the stacking tray unit C. A cover sheet conveyance path (hereinafter referred to as a second path) 200 is connected to the sheet conveyance in path 501 interposed by a path switching piece 201, leading a cover sheet from the inserted B to the second path 200. This second path 200 meets to intersect the first path 100. The sheet bundle from the first path and the cover sheet from the second path join at an upside-down T shape.

This second path 200 is configured by an upper conveyance guide 63 and lower conveyance guide 64 that oppose each other at a predetermined gap in up and down directions. The upper conveyance guide 63 is separated into a first upper conveyance guide 63*a* at the right side and a second upper conveyance guide 63*b* at the left side. These left and right side conveyance guides are configured to open separately. A joining stage 150 (FIG. 1B) is formed as an intersection space at an intersection of the first path 100 and the second path 200. The sheet bundle and cover sheet join at substantially upside-down T at this stage.

A first aligning means 130 for positioning a cover sheet supply direction; a second aligning means 135 for positioning a cover sheet supply right angle direction; and an offset conveyance means 140 for feeding a cover sheet aligned by the first and second aligning means 130 and 135 to the joining stage 150 (FIG. 1B) are arranged on the second path. The cover sheet is set on the joining stage by (1) arranging the first and second aligning means at an upstream side of the joining stage 150 (FIG. 1B) in the second path, (2) aligning a cover sheet conveyance direction and a direction that is orthogonal thereto, and (3) accurately feeding such aligned cover sheet a predetermined distance by operation of the offset conveyance means 140. Both the first aligning means 130 and the second aligning means 135 shown in the drawings are dually employed by the following one unit mechanism.

Figure 23:
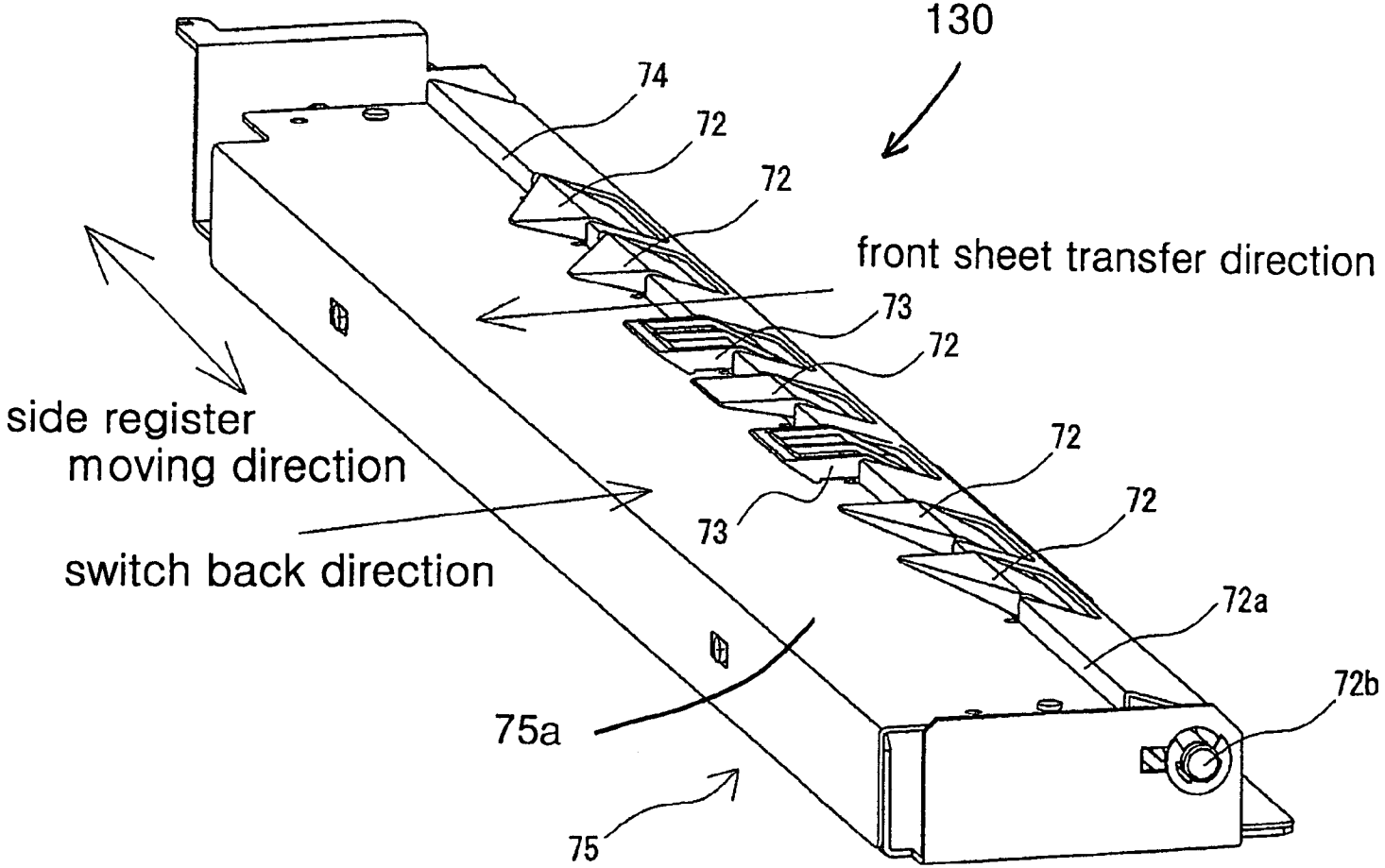
FIG. 23 is a perspective view of a portion of the apparatus of FIG. 22.
Figure 28A:
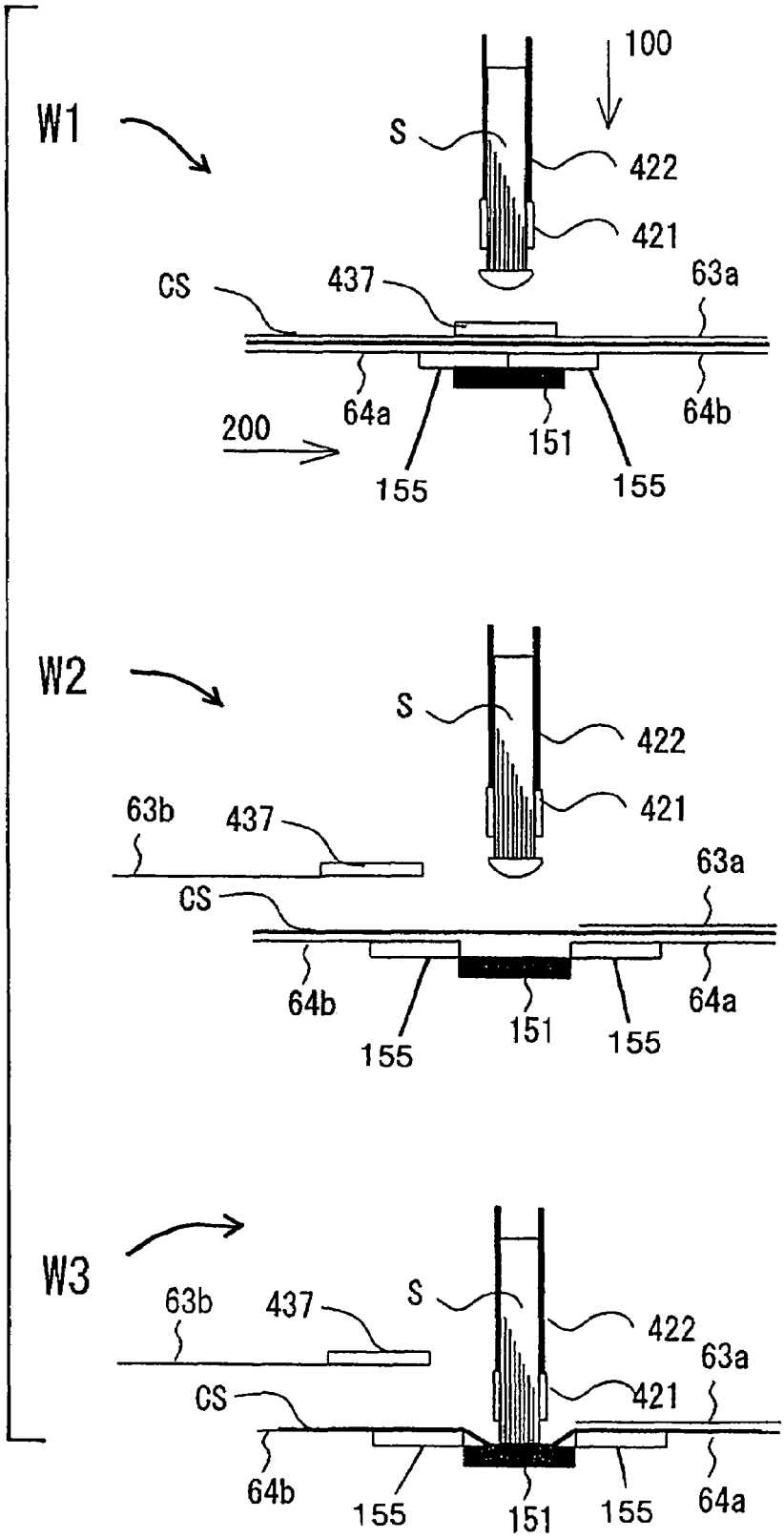
FIG. 28A illustrates a series of positions in the folding of a sheet bundle and cover sheet in the apparatus of FIG. 1A.
Figure 28B:
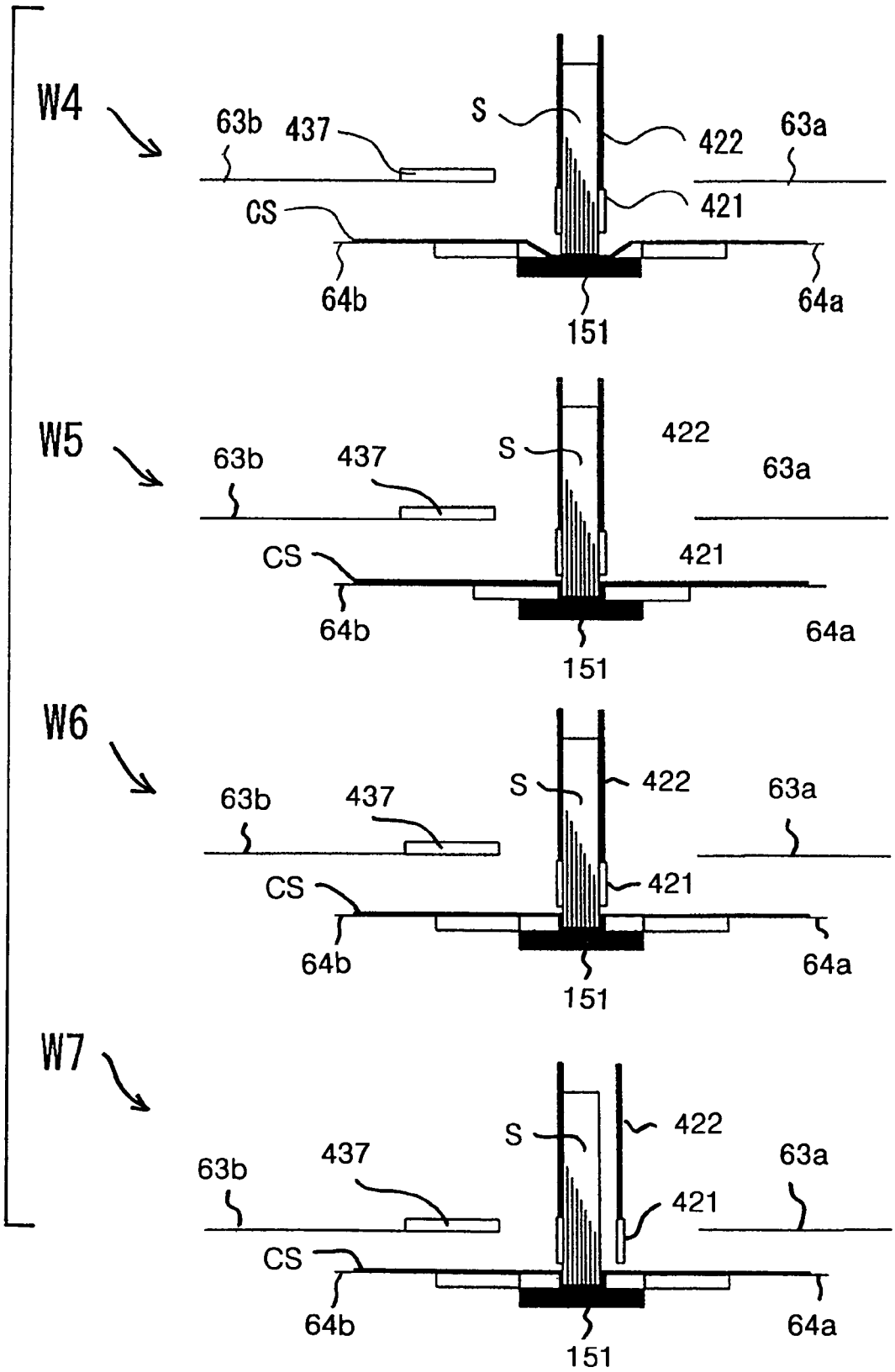
FIG. 28B illustrates additional positions in the folding of a sheet bundle and cover sheet in the apparatus of FIG. 1A.

An aligning unit 75, (FIG. 24), is provided at a branching point of the discharge path 301 (FIG. 1A) and the second path 200 (FIG. 28A). Referring to FIG. 23, the aligning unit 75 is provided a stopper member 72, and a level wall 72*a* that engages a sheet edge. This aligning unit 75 has the positional relationship shown in the drawings with the cover sheet conveyance direction (the direction of the arrow). An upper paper guide 72*b* is integrally mounted, as shown in FIG. 23. The aligning unit 75 is mounted to move on the fixed frame 76 in left and right directions of the drawing.

Figure 24:
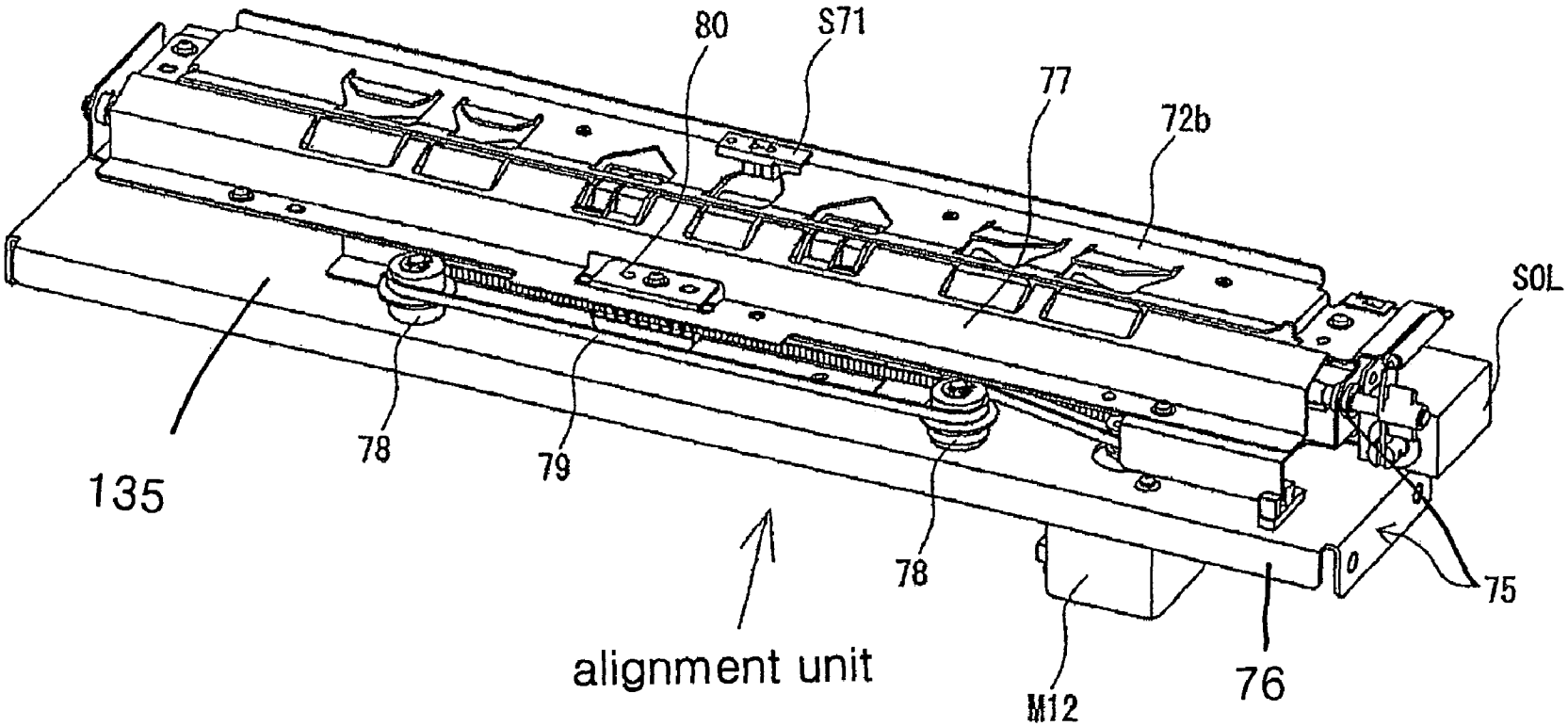
FIG. 24 is another perspective view of a portion of the apparatus of FIG. 22.

Specifically, a guide rail, not shown, is equipped on the fixed frame 76, and the aligning unit 75 matingly moves on this rail. A stepping motor M12 (FIG. 24) that is capable of both forward and reverse drives is equipped on the fixed frame 76, and the aligning unit 75 and motor M12 are connected. In FIG. 24, reference number 79 represents a transmission belt and 78 represents its pulley. The transmission belt 79 and aligning unit 75 are fastened by a fastening member 80. Therefore, the drive of the drive motor M12 moves the aligning unit 75 in left and right directions of the drawing. The letters LS represent a limit sensor in the drawings.

As shown in FIG. 23, there is a plurality of stoppers 72 that are configured to rotate freely around a shaft 72*b*. The stoppers 72 that nip and hold a cover sheet therebetween with a step 75*a* of the aligning unit at a position shown in the drawings, and rotate in a clockwise direction of the drawing around the shaft 72*b* stand to engage the edge of a sheet with the step wall 72*a*. SOL in FIG. 24 represents the operating solenoid. The stoppers 72 (FIG. 23) are arranged in the sheet conveyance path and guides a cover sheet when the operating solenoid SOL is off and in a downward posture. When the solenoid SOL is turned on, the stoppers assume a standing position causing a switchback and engage and stop the cover sheet being fed in reverse. When the stoppers 72 switch from a standing position to a downward position in a state where they are engaging and stopping a cover sheet, they nip the sheet edge.

Figure 20A:
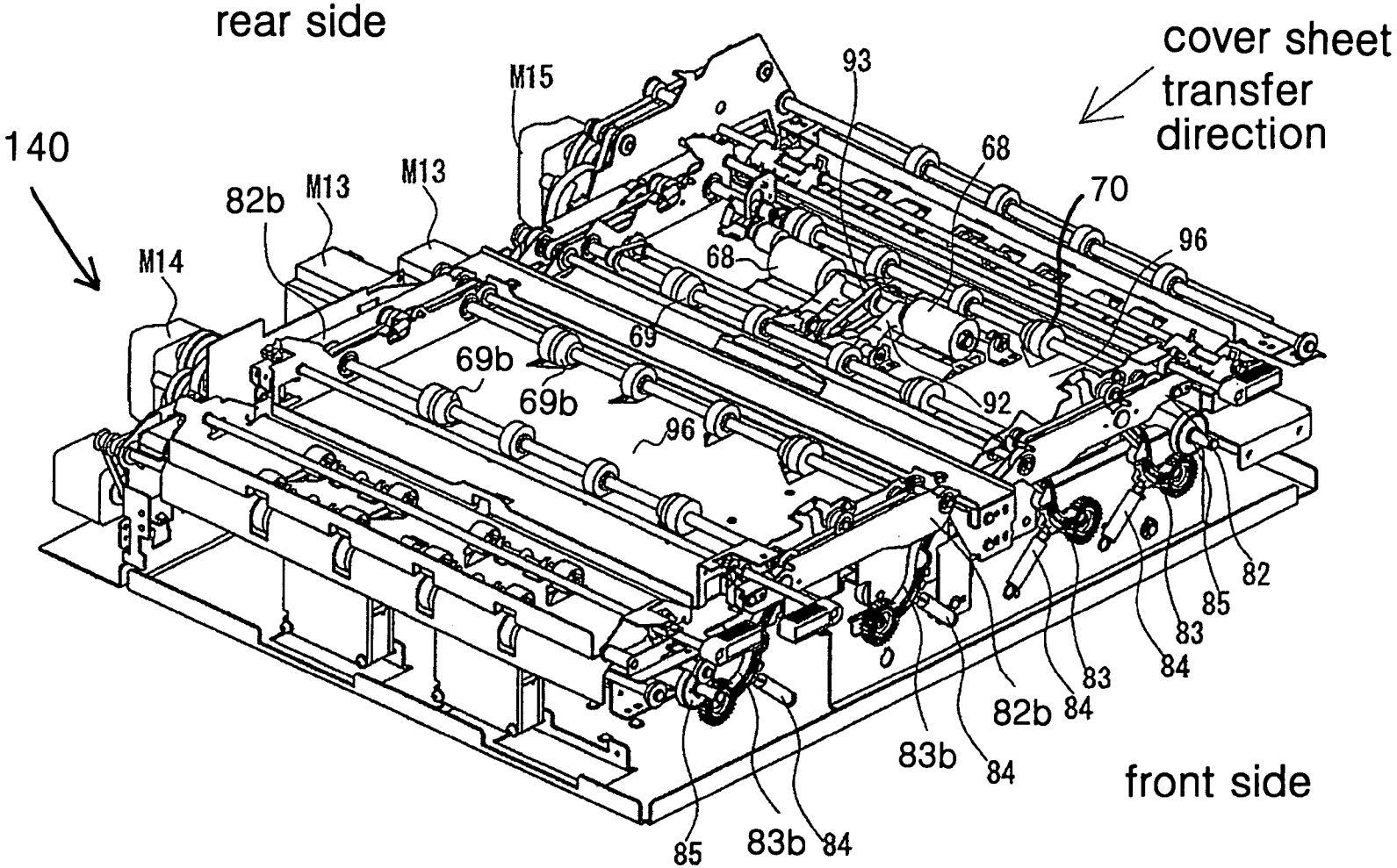
FIG. 20A is a view of the cover sheet conveyance mechanism of FIG. 19A, and is a perspective view of the entire mechanism.
Figure 20B:
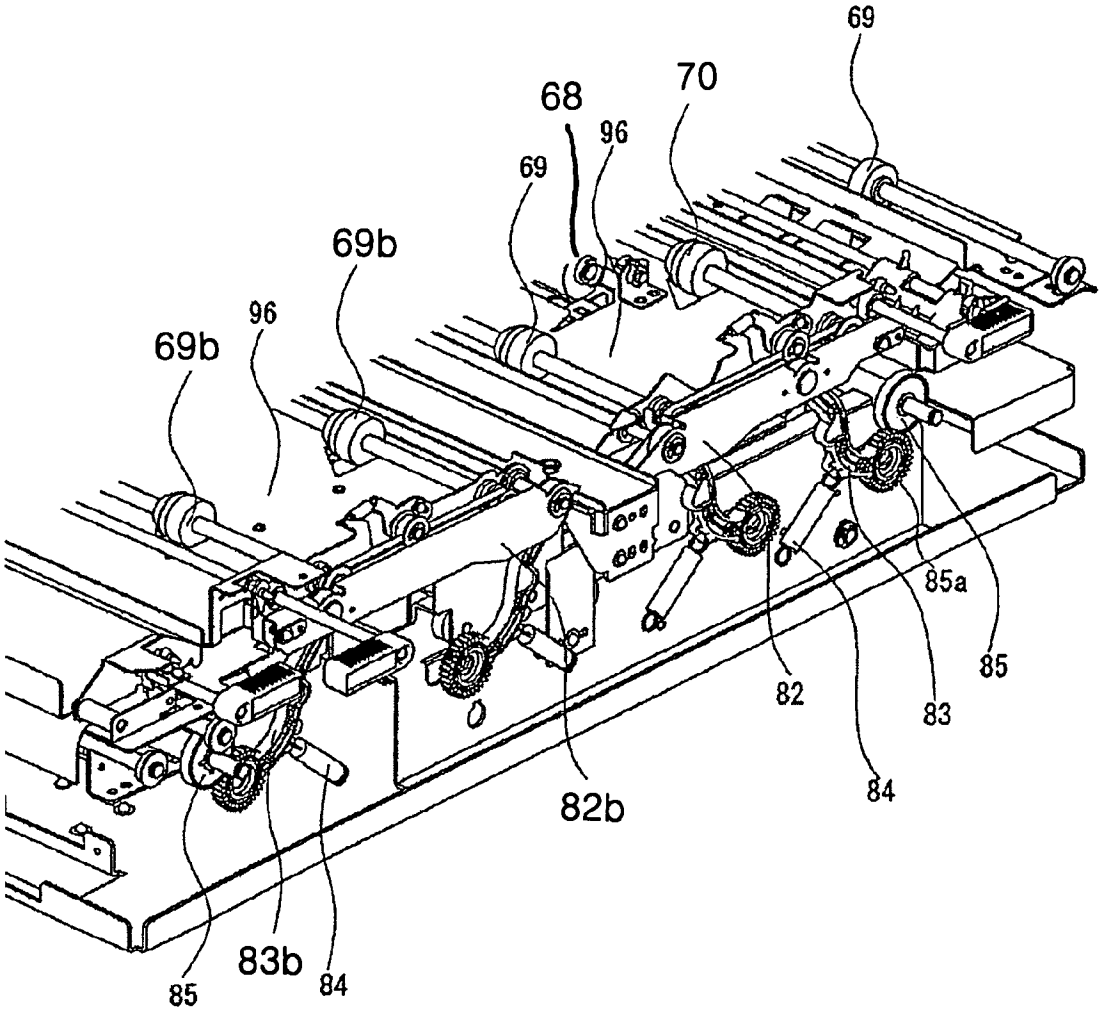
FIG. 20B is a partially expanded view of the cover sheet conveyance mechanism of FIG. 19A.
Figure 21:
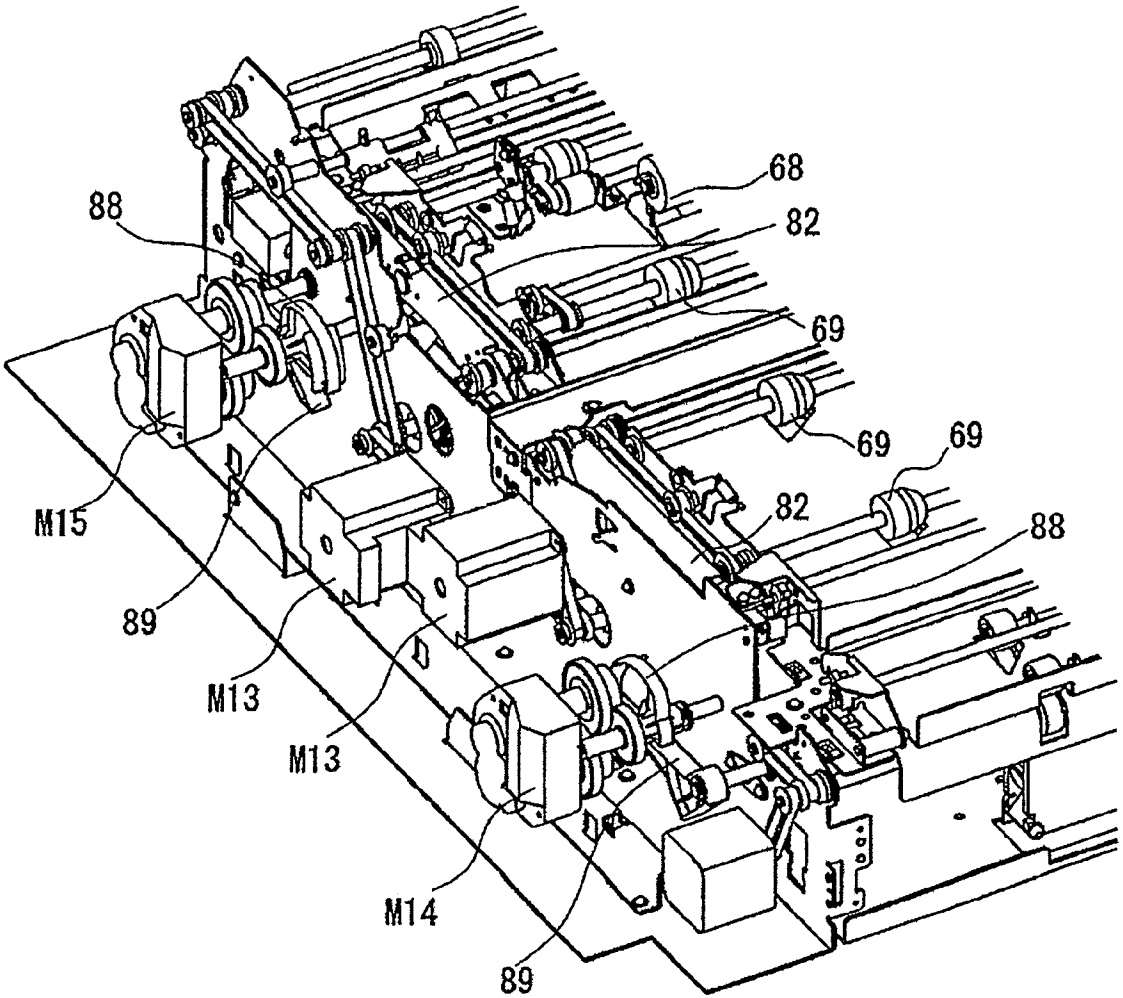
FIG. 21 is a perspective view of a portion of a backside of the apparatus of FIG. 20A.
Figure 22:
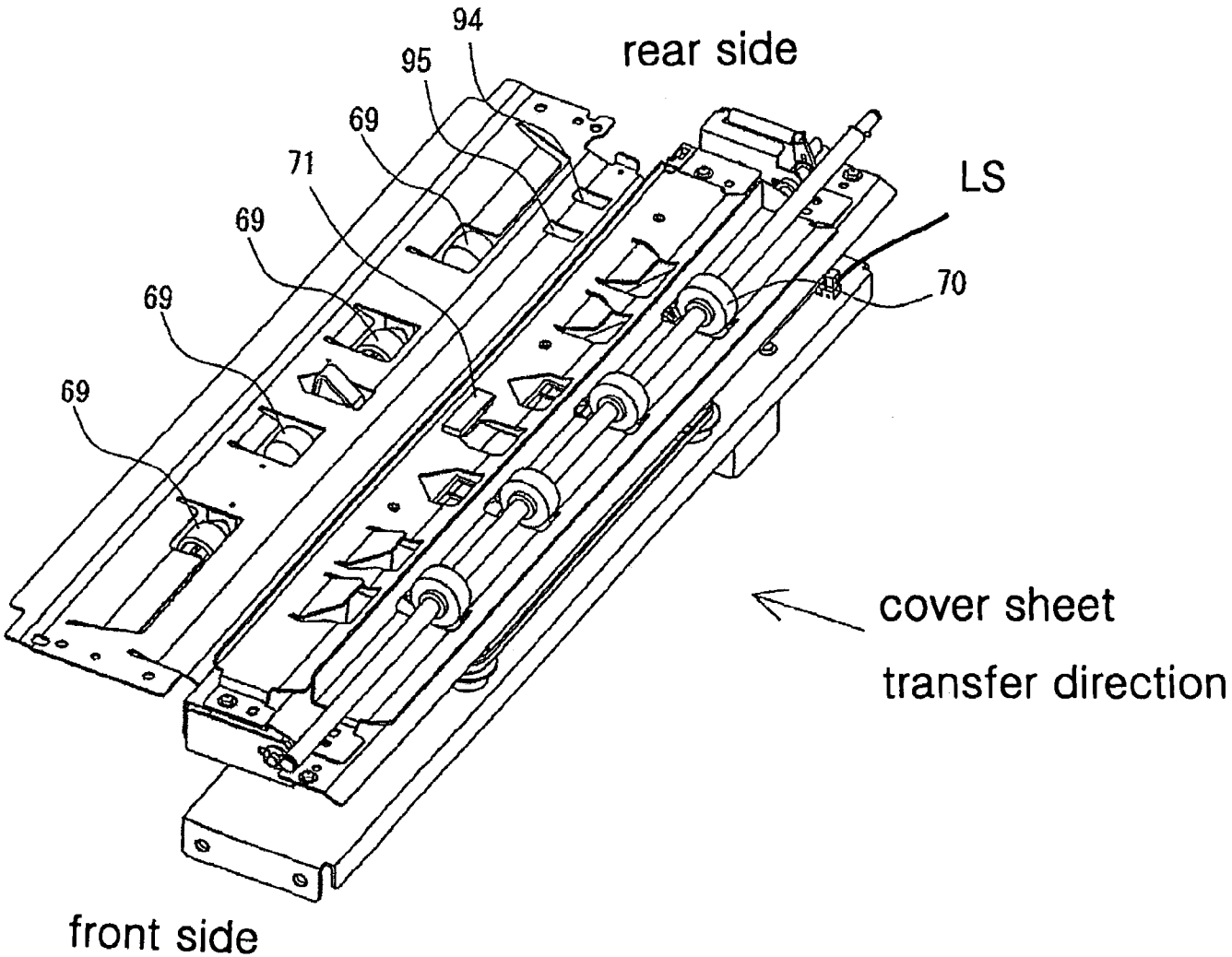
FIG. 22 is a perspective view of an aligning unit according to the apparatus of FIG. 19A.

A reverse rotating roller 68 (FIG. 20A) is equipped at a downstream side of the aligning unit on the second path. This roller 68 is arranged to rise and lower to a position that engages a cover sheet and a position that is retracted therefrom and not engaged with the cover sheet, and is mounted to a swinging support arm 92 (FIG. 20A). A drive motor M13 (FIG. 20A) is connected to the roller 68 to move the cover sheet in a supply direction and an opposite direction. This drive motor M13 is connected to a base edge portion of the support arm 92 interposed by a spring clutch that raises the support arm 92 with a forward rotation, and moves it to a position retracted from the sheet. With a reverse rotation of this motor, it lowers the support arm 92 to a position where it engages the sheet, and is configured to rotate the roller 68 in reverse. 93 in the drawing represents a transmission belt. In FIG. 24, S71 is sensor for detecting a leading edge of the sheet. It generates a timing signal for controlling the drive motor M13 to switchback the sheet.

Also, as shown in FIG. 19A, a plurality of conveyance rollers in two rows are arranged on the first upper conveyance guide 63*a*, and conveyance rollers (entrance rollers) are arranged at an upstream side of an aligning unit 75 on the second path. These conveyance rollers 69 compose an offset conveyance means, described below, and convey a sheet aligned by the aligning unit 75 a predetermined amount.

FIGS. 25A-25D shows the status of operations, to explain the structure and its operations. As can be seen at U1, a leading edge of the cover sheet (hereinafter referred simply to as a sheet) advanced into the second path is detected by the sensor S71, and the sheet is conveyed by conveyance rollers 70 and the conveyance rollers 69. At that time, the cover sheet advances inward with the stoppers 72 of the aligning unit in a downward state, and the reverse rotation rollers 68 placed in a state retracted from the path. After a time delay in order for the leading edge of the sheet to pass through the aligning unit 75, sensor S71 generates a signal causing the conveyance rollers 70 and conveyance rollers 69 to retract from the sheet. (U3) The retracting structure of the conveyance rollers 69 and 70 is described in further detail below.

Then, the reverse rotation rollers 68 lower to a position to engage the sheet (U4) and at the same time, all conveyance rollers engaged with the sheet retract to a position upward from the sheet (U5). The reverse rotation rollers 68 are driven to move the sheet in a direction opposite to the supply direction. At this time, the stoppers 72 assume a standing position by the operation solenoid SOL. Then, the trailing edge of the sheet engages the stoppers 72. Immediately thereafter, simultaneously with the stopping of the reverse rotation rollers 68, the rollers are separated from the sheet. Note that the timing for stopping the reverse rotating rollers 68 is calculated using a signal generated where the sensor S71 detected a trailing edge of the sheet.

Then, the power to operate solenoid SOL is cut to allow the stoppers to return to their initial posture (U7). Then, the trailing edge of the sheet is nipped by the step portion (plate) 75*a* of the aligning unit 75 and the stoppers 72. In this state, when the drive motor M12 is started, the aligning unit 75 moves in a direction that is orthogonal to the sheet supply direction, and moves to the sheet nipped by the stoppers 72 at the same time.

Figure 25A:
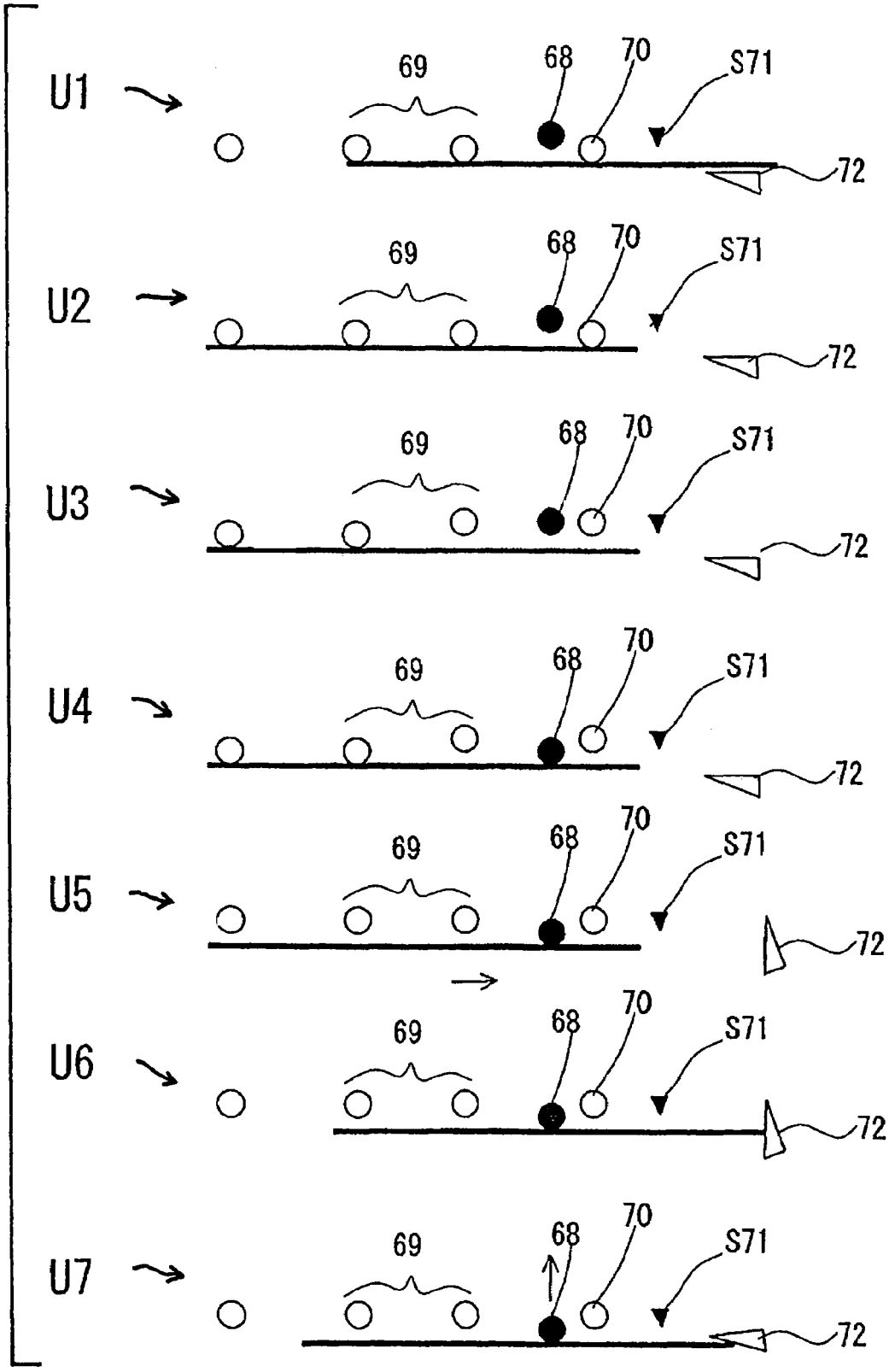
FIG. 25A illustrates operational states of the cover sheet conveyance of the unit of FIG. 19A.
Figure 25B:
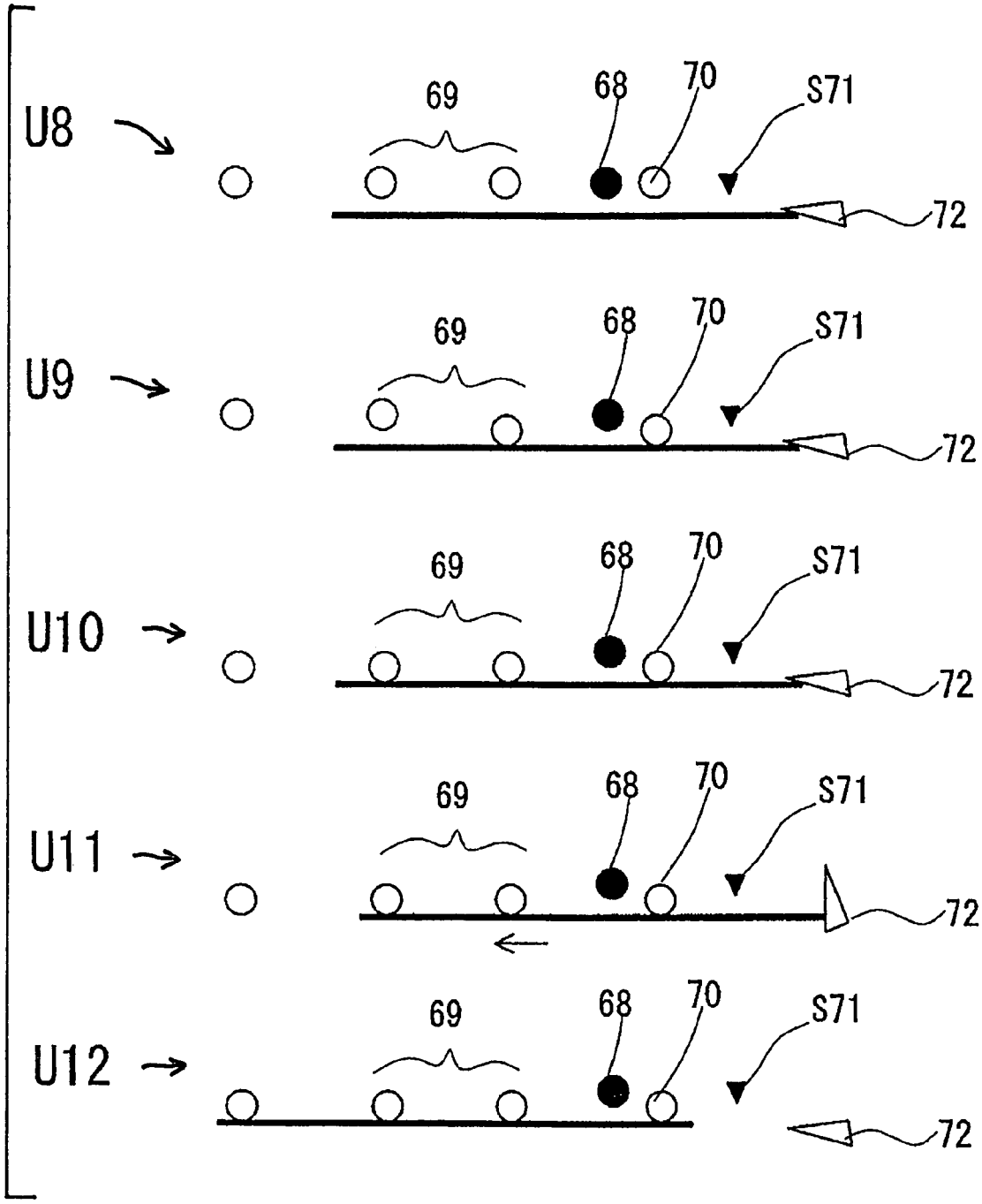
FIG. 25B illustrates additional operational states of the cover sheet conveyance of the unit of FIG. 19A.
Figure 25C:
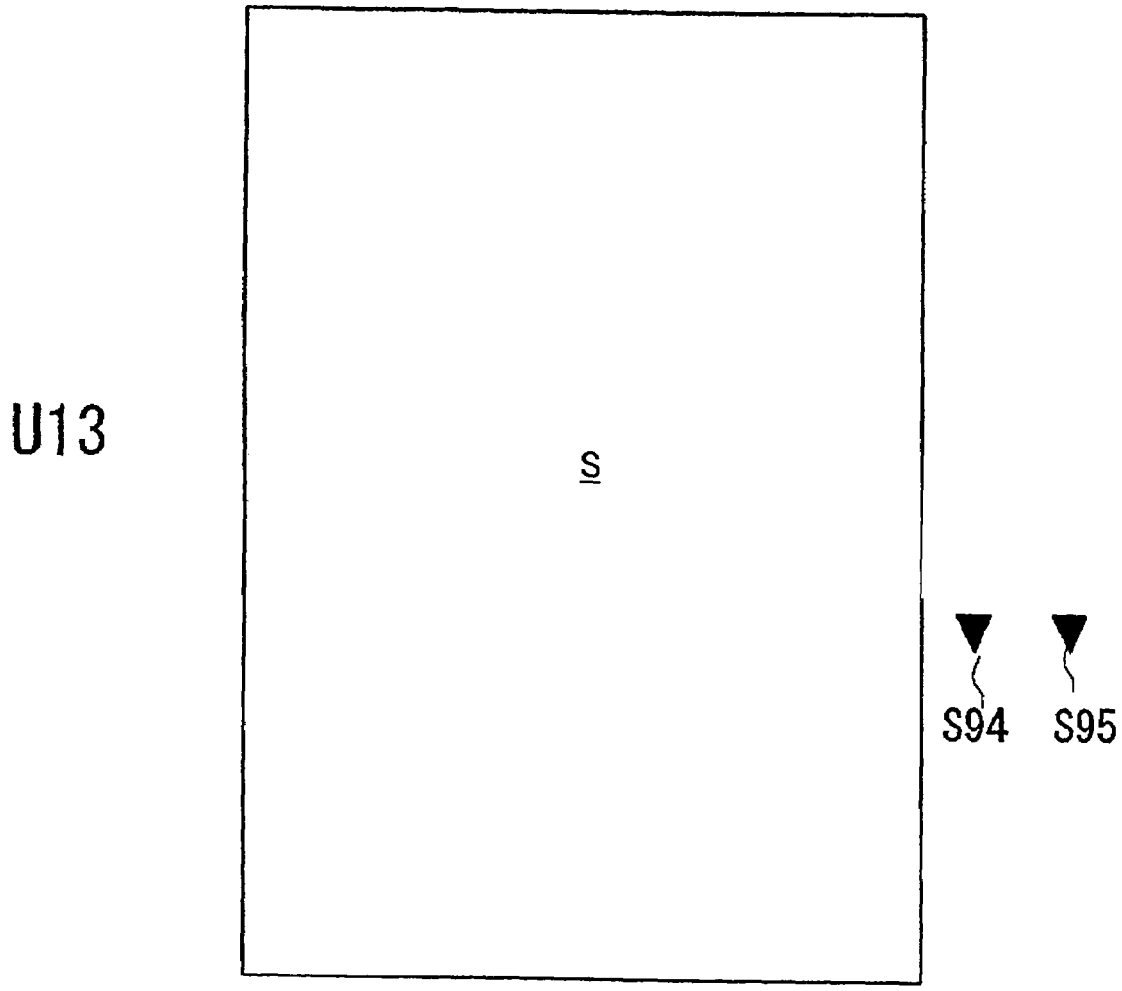
FIG. 25C illustrates a state of cover sheet conveyance of the unit of FIG. 19A.
Figure 25D:
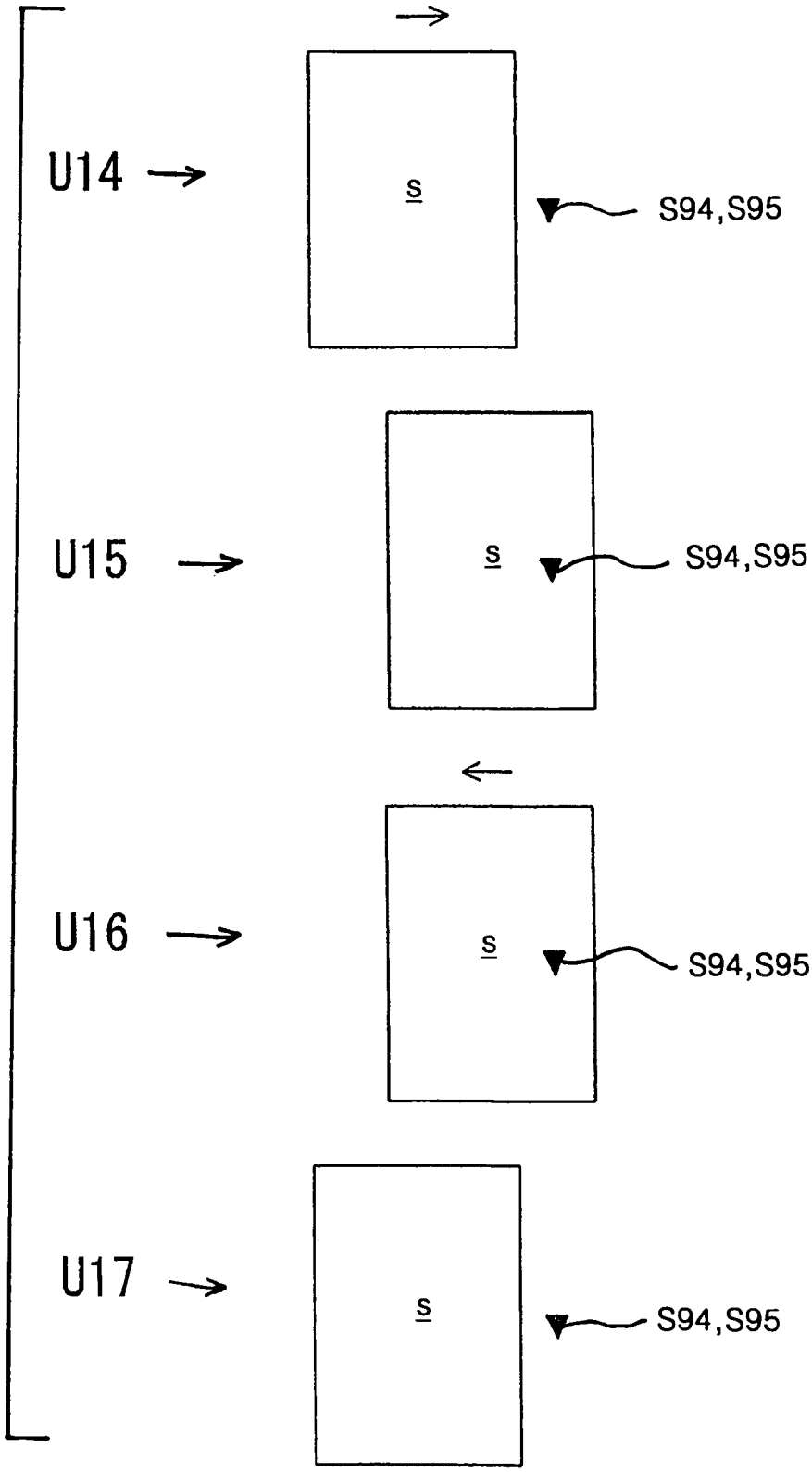
FIG. 25D illustrates additional operational states of cover sheet conveyance of the unit of FIG. 19A.

As shown in FIG. 25C, a plurality of sensors S94 and S95 are arranged in a direction orthogonal to the sheet supply on the fastened frame 76 that movably supports the aligning unit 75. Thus, for example, as shown in FIG. 25D, when the sensor S94, S95 is turned OFF (U14), the aligning unit 75 moves to move the sheet S in the sensor direction, and by moving a predetermined amount after the sensor S94, S95 is turned ON, the position of the sheet S in the horizontal direction can be calculated (U15). When the sensor S94, S95 is turned ON (U16), the aligning unit 75 moves in the opposite direction, and by moving a predetermined amount after the trailing edge of the sheet S has passed the sensor S94, S95 it turns OFF, the position of the sheet S in the horizontal direction can be calculated.

Referring now to FIG. 25B, after calculating (aligning) the position of the sheet in a direction that is orthogonal to sheet supply, the conveyance rollers 69 and 70 lower to a position to engage the sheet (U9). All conveyance rollers then engage the sheet and only the reverse rotating rollers 68 are placed at a position that is retracted from the sheet (U10). Then, the operation solenoid SOL turns ON again to rotate the stoppers into a standing direction. Then, the conveyance rollers 69 are rotatingly driven (U11). When this happens, the sheet is conveyed to a downstream side of the second path 200, and the stoppers 72 return to their initial, downward posture to be prepared for the next sheet.

Referring to FIG. 20A, the following will explain the elevator mechanism of the conveyance rollers 69 and 70 that touch and convey the sheet as described above. Separated from the sheet and controlled in a non-operating state, Both sides of the conveyance rollers 69 are bearingly supported on a support stay 82 equipped on the upper conveyance guide 63. The support stays 82 are mounted on a plurality of swing arms disposed on the apparatus frame. The conveyance guides 63 and conveyance rollers 69 and 70 are supported to allow them to move up and down substantially parallel with the swinging arm disposed in at least two locations in front and in back of a sheet conveyance direction on each of the right and left sides of the apparatus frame.

The swing arm 83 is connected to a transmission gear 85*a* connected to a drive motor M14 that drives a gear 85 of the pivot unit. The rotation of the motor is operable to control the elevating position of the conveyance guides and conveyance rollers. Note that the drive motor M14 controls the angle of the swing arm 83 at two stages to position the conveyance rollers at a non-operating position slightly retracted from the sheet and the upper conveyance guide at a position greatly separated from the lower conveyance guide. The number 84 represents the recovery spring of the swing arm in the drawings. The conveyance rollers 69*b*, having the same structure as the conveyance rollers 69, are mounted to the second conveyance guide 63*b* by the support stays 82*b*, and this support stay is rockingly supported by the swing arm 83. However, the swing arm 83, positioned at a left side (a downstream side) of the joining stage is configured to rotate in a direction opposite to that of the swing arm 83 positioned on the right side, and the arm rotates with the drive motor M15.

The conveyance rollers 69 of this configuration are connected to the drive motor M13 and controlled by a control CPU, not shown. The control CPU executes the second aligning action that aligns a width direction that is orthogonal to a sheet supply direction of the cover sheet positioned by the stoppers 72. After that is completed, the CPU starts the drive motor M14 to lower the conveyance rollers 69 to a position where they touch the sheet, and then starts the drive motor M13 to convey the cover sheet a predetermined amount toward the joining stage 150 (FIG. 1B).

To control the conveyance rollers 69, the control CPU calculates the cover sheet size (the length in the conveyance direction) and the conveyance amount to match the center of the sheet from the thickness of the sheet bundle conveyed from the first path 100 and the center of the joining stage. The CPU then calculates the number of steps required to drive motor M13. Motor M13 comprises a stepping motor, and based on those calculations supplies power pulses thereto. In this case, either a calculation of the conveyance amount is selected using only the length of the sheet, or a calculation of the conveyance amount is selected using the sheet length and the thickness of a sheet bundle from the first path.

The former calculation does not require detection of the sheet bundle thickness, and it is easier to calculate the conveyance amount, but if the thickness of the sheet bundle differs, the edges of both the cover sheet and sheet bundle will be different when folding them together. Accordingly, the former calculation is best suited to apparatus specifications that require uniform thickness. Although the latter method allows for the possibility of misalignment based upon the detection accuracy of the sheet bundle, this method is suited to apparatus specifications that require bookbinding of a variety of thicknesses. It is also possible to apply a sheet bundle thickness detection method for adjusting the contact pressure such as when gluing as described above for detecting the thickness of a sheet bundle. The conveyance rollers 69 and their controlling means (such as a control CPU as described above) compose the offset moving means.

Joining Mechanism of the Sheet Bundle and Cover Sheet

A joining stage 150 (FIG. 1B) is formed at an intersecting point of the first path 100 and the second path 200. The sheet bundle from the first path and the cover sheet from the second path join at substantially upside-down T. First, at the first path 100, gluing the bottom edge of the sheet bundle gripped by the second gripping conveyance means 420 at the adhesive application unit E is performed, then the adhesive tray 61 retracts to outside of the path. (See U12 described above.) At the same time as this, the cover sheet is set at the joining stage 150 at the second path 200. (See U12, described above.)

Figure 28C:
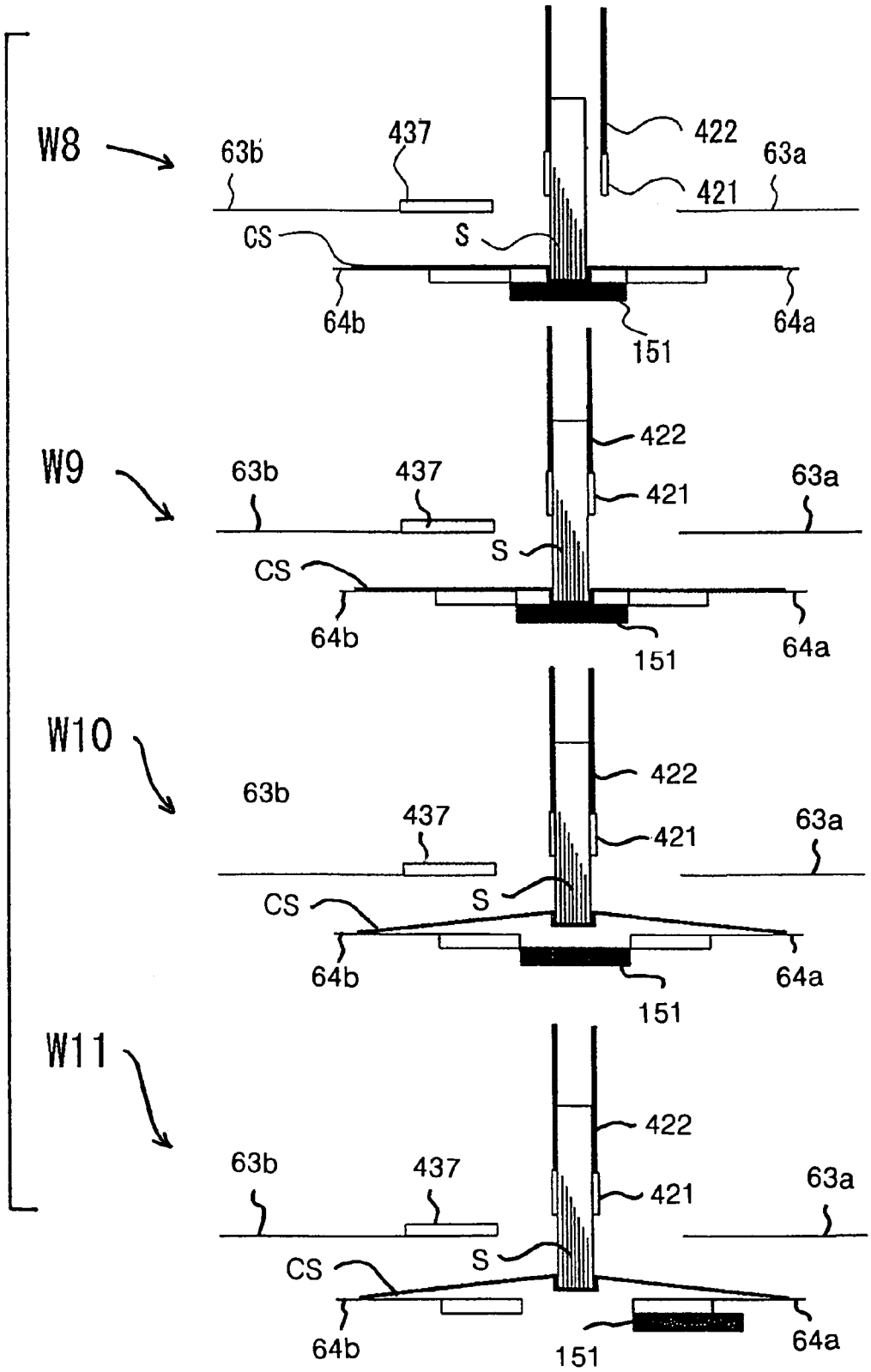
FIG. 28C illustrates additional positions in the folding of a sheet bundle and cover sheet in the apparatus of FIG. 1A.

The following will simultaneously explain the structure and operation for joining the sheet bundle and cover sheet, according to FIGS. 28A, to 28C. In the state indicated by W1, the sheet bundle and cover sheet are set and the sheet bundle is supported by the second gripping conveyance means 420. The number 437 in the drawing represents a reference member. 63*a* is a first upper conveyance and 63*b* is a second upper conveyance guide. A backup member 151 that supports a back surface of the cover sheet CS and a back folding block 155 are equipped at the joining stage 150. The following will explain the structures of the backup member 151 and the back folding block 155.

A drive motor M15 rotates to retract the reference member 437 from the first path that is integrally formed with the guide, when the second upper conveyance guide 64 is freed when in the state of W2 in the drawing. By driving a drive motor M16 to drive the second gripping conveyance means (hereinafter referred to as the main clamper 421), the sheet bundle is conveyed to a downstream side. When the cover sheet CS and sheet bundle SB are joined in the state of W3 in the drawing, the backup member 151 is supporting the cover sheet back surface. There is a gap formed between the backup member 151 and the bottom conveyance guide. The back folding block 155 advances into this gap.

Next, the first upper conveyance guide 63*a* separates from the bottom conveyance guide 64*a* in the same way as the second conveyance guide earlier. The upper side of the cover sheet CS is freed at W4. With the cover sheet free, the cover sheet is folded by the back folding block 155 at W5. This back folding block 155 is configured to open freely to press the sheet bundle shoulders from the position of W4 where the right and left sides of the pair of blocks are separated, and press to form the back of the booklet along with the backup member 151.

Next, the back folding block 155 recovers to its original position from the shoulders of the sheet bundle (W6), and then the main clamper 421 releases from the sheet bundle S. (W7) After releasing, the main clamper 421 retracts to an upstream side of the first path (W8), and the main clamper 421 grips the sheet (W9). Therefore, the main clamper 421 grips the bottom edge of the sheet bundle when joining with the sheet bundle (the operations from W1 to W5), and then grips the central portion of the sheet bundle. In this way, gripping the bottom edge when joining the sheet bundle and cover sheet prevents the sheet bundle from coming apart by the pressure to acts to join the sheets.

After changing the position that the main clamper 421 grips the sheet bundle, and backing up the main clamper 421, the cover sheet is pulled from the backup member 151 (W10). The retracting action of the clamper is pulse controlled by the drive motor M7. After pulling the cover sheet CS, the backup member 151 retracts fro the first path to the state of W11.

Figure 28D:
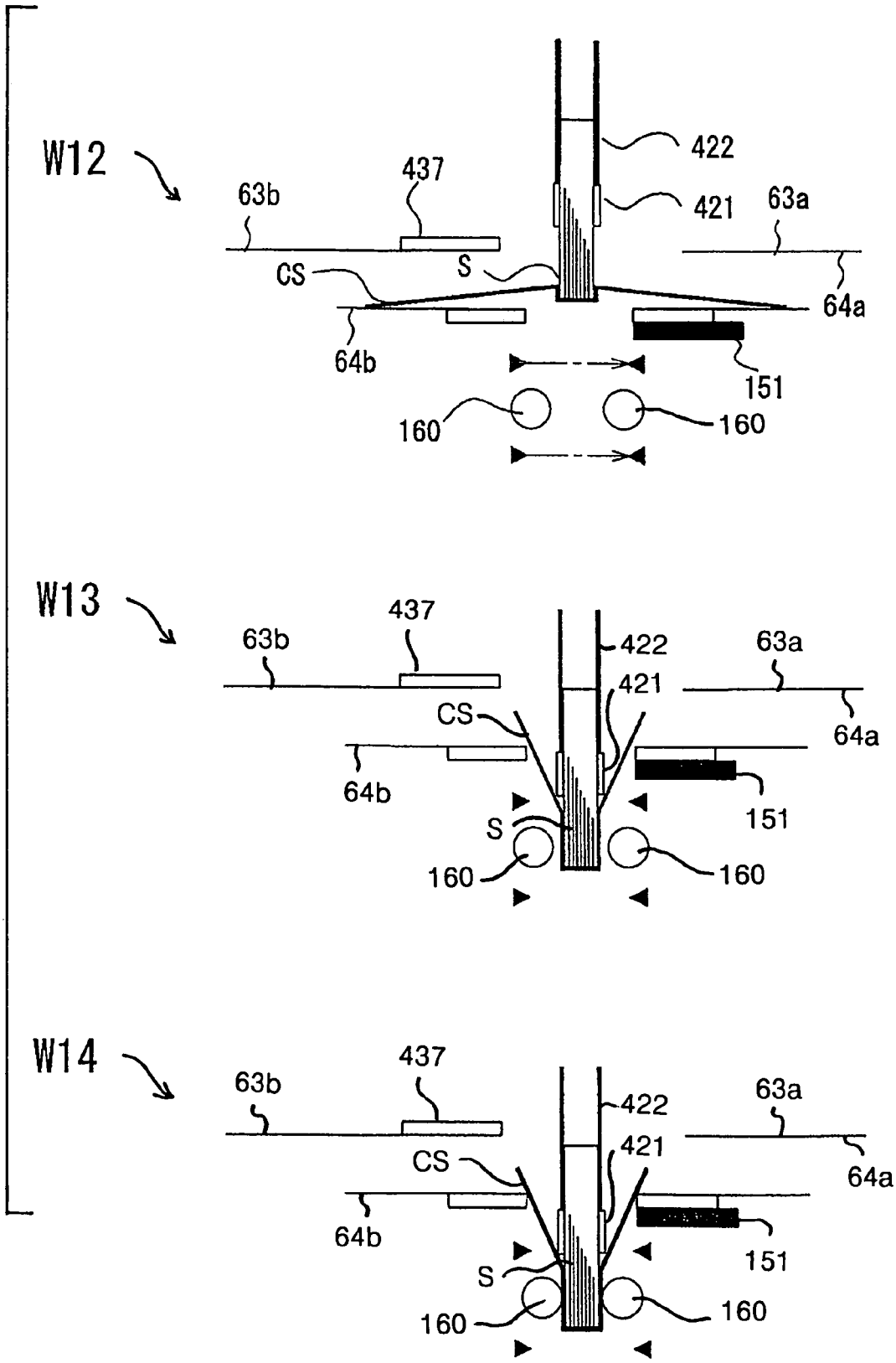
FIG. 28D illustrates additional positions in the folding of a sheet bundle and cover sheet in the apparatus of FIG. 1A.
Figure 28E:
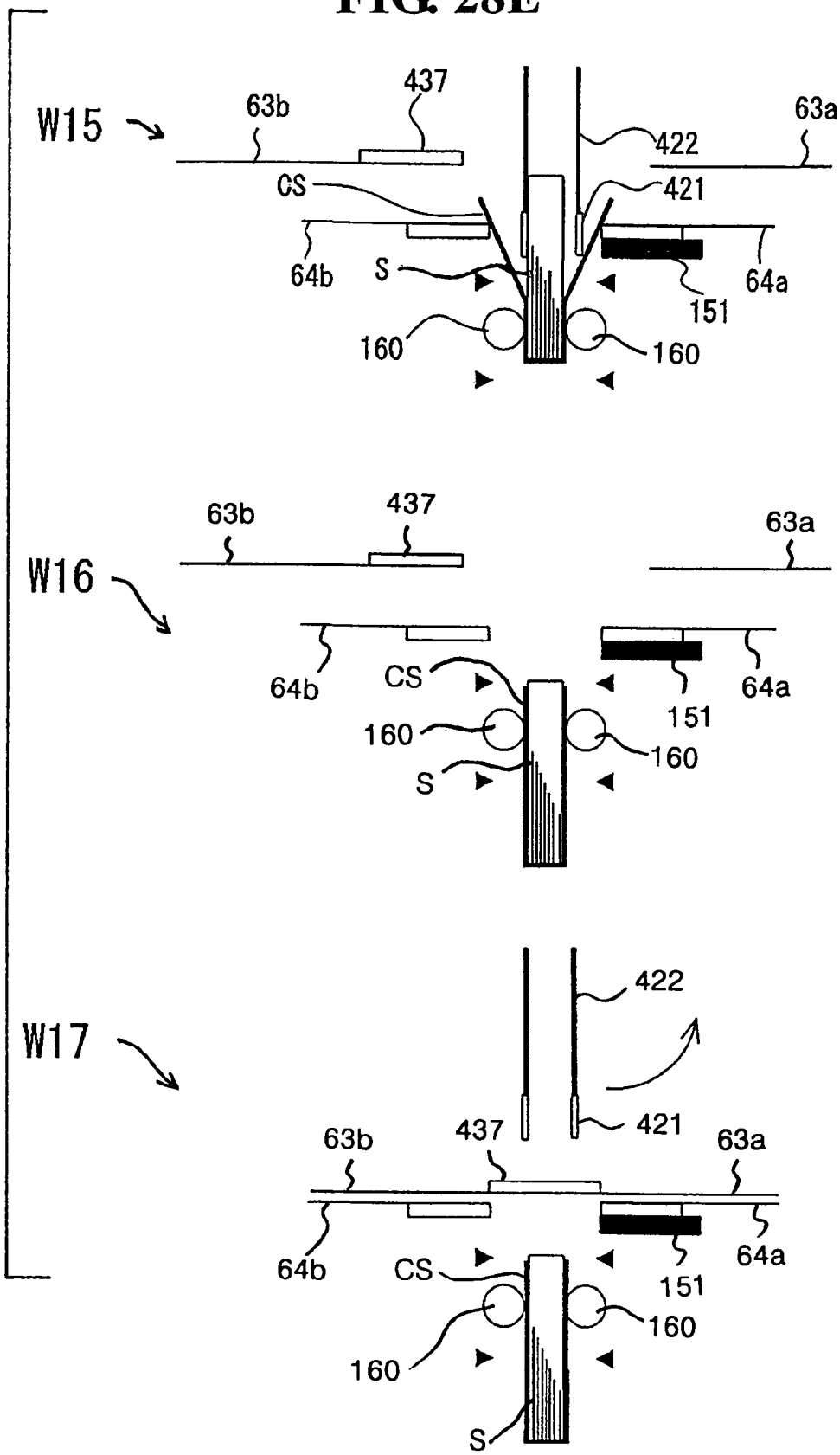
FIG. 28E illustrates additional positions in the folding of a sheet bundle and cover sheet in the apparatus of FIG. 1A.
Figure 28F:
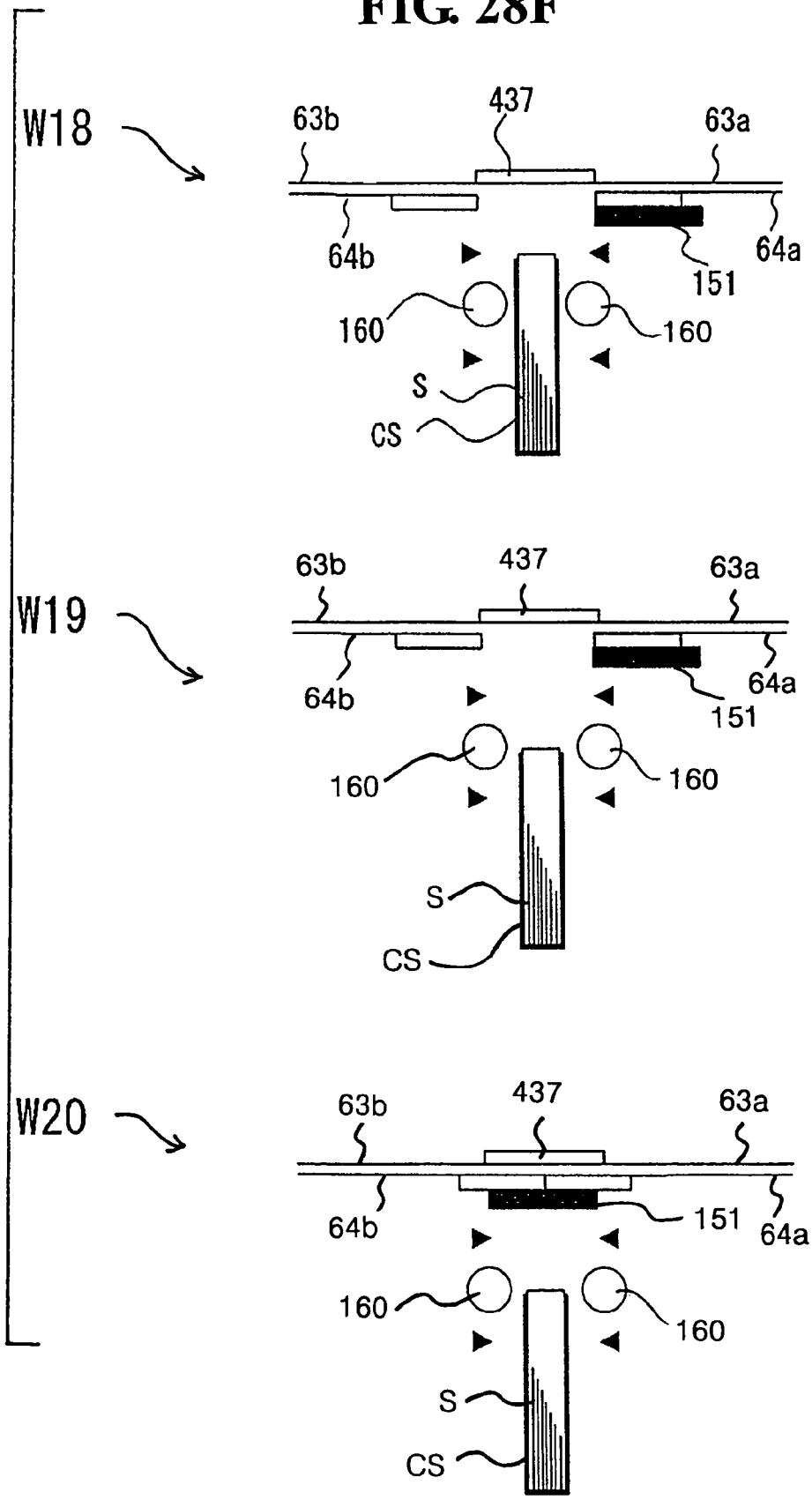
FIG. 28F illustrates additional positions in the folding of a sheet bundle and cover sheet in the apparatus of FIG. 1A.

Folding conveyance means are equipped on the first path at a downstream side of the joining stage 150. The drawings show this configured by a pair of folding rollers 160 (FIGS. 28D and 28E). This pair of folding rollers is configured for the rollers to press together and to separate from each other. A pressing spring, not shown, presses them together, and an operating solenoid is used to separate the rollers. The folding rollers 160 separate (W12), and the main clamper 421 lowers to a downstream side along the first path (W13). A sensor detects the position of the sheet bundle and the folding rollers 160 apply pressure (W14). Next, the main clamper 421 releases from the sheet bundle (W15) and the folding rollers rotate in a conveyance direction to convey the sheet bundle (W16). Thus, with this configuration and these operations, the sheet bundle and cover sheet are joined together to form a booklet, and are folded. The following will explain the recovery operation of this configuration.

At W17, after the trailing edge of the sheet bundle passes the joining stage 150 at the recover operation of the main clamper 421, a sensor transmits a signal of the detection of the trailing edge of the sheet bundle, and the second gripping conveyance means 420 including the main clamper 421 convert its posture 90 degrees to recover to the posture to receive the next sheet bundle. Simultaneously to this, the first and the second upper conveyance guides also recover to their original position to convey the next cover sheet.

At W18 and W19, the folding rollers 16 recover from a pressed state to a separated state. At W20, the backup member 151 and the back folding block 155 both recover to their original positions. In this way, the sheet bundle formed into a booklet is conveyed from the folding conveyance means to a trimming unit where edges in three directions, excluding the glued and bound edge are cut, and the finished sheet bundle is stored in a storing stacking tray.

While the invention has been explained with reference to the specific embodiments of the invention, the explanation is illustrative and the invention is limited only by the appended claims.

What is claimed is:

1. A bookmaking apparatus comprising:

first and second paths intersecting each other;

a sheet bundle conveyance device for conveying a sheet bundle along the first path;

a cover sheet conveyance device for conveying a cover sheet along the second path;

and a joining stage disposed at the intersection of the first and the second paths, the joining stage operable to join the sheet bundle and cover sheet in a substantially upside-down T-shape;

wherein the cover sheet conveyance device is equipped with a first aligning device for aligning an edge of the cover sheet in a direction of conveyance, and a second aligning device for aligning a side edge perpendicular to the direction of conveyance, and the first and the second aligning devices are arranged on the second path at an upstream side of the joining stage, and the cover sheet conveyance device is equipped with an offset conveyance device capable of adjusting a conveyance amount of the cover sheet positioned by the first and the second aligning devices according to a length direction of sheet conveyance to the joining stage at a downstream side, the offset conveyance device comprising an operation device for calculating a conveyance amount of the cover sheet aligned by the first and the second aligning devices according to a thickness of the sheet bundle.

2. The bookmaking apparatus according to claim 1 further comprising:

an adhesive application device for applying adhesive to the sheet bundle, the adhesive application device being arranged at the upstream side of the joining stage on the first path; and a folding conveyance device for folding a backside of the cover sheet joined to the sheet bundle, the folding conveyance device being arranged at a downstream side of the joining stage.

3. The bookmaking apparatus according to claim 2, wherein the first aligning device is operable to first align a sheet trailing edge, the second aligning device is then operable to align a side edge of the cover sheet, and the offset conveyance device is then operable to convey the cover sheet to a predetermined position at the joining stage.

4. The bookmaking apparatus according to claim 2, wherein the first aligning device comprises an aligning unit configured to engage the cover sheet and touch a trailing edge of the cover sheet;

the second aligning device comprises a shifting device for shifting the aligning unit in a direction orthogonal to the conveyance direction; and the offset conveyance device is arranged at a downstream side of the aligning unit, and is configured to move between a first position touching the cover sheet, and a retracted position separated from the cover sheet.

5. The bookmaking apparatus according to claim 4, further comprising a roller unit configured to convey the cover sheet in a direction opposite to the conveyance direction, the roller unit including a stopper member operable to hold the cover sheet when the shifting device shifts to a direction intersecting the conveyance direction.

6. The bookmaking apparatus according to claim 5, wherein the shifting device is set to a shifting position of the aligning unit using cover sheet size information and information from at least one of a plurality of sensors arranged in the shifting direction of the aligning unit.

7. The bookmaking apparatus according to claim 1, wherein the first aligning device is operable to first align a sheet trailing edge, the second aligning device is then operable to align a side edge of the sheet, and the offset conveyance device is then operable to convey the cover sheet to a predetermined position at the joining stage.

8. The bookmaking apparatus according to claim 7, wherein the first aligning device comprises an aligning unit configured to engage the cover sheet and touch a trailing edge of the cover sheet;

the second aligning device comprises a shifting device for shifting the aligning unit in a direction orthogonal to the conveyance direction; and the offset conveyance device is arranged at a downstream side of the aligning unit, and is configured to move between a first position touching the cover sheet, and a retracted position separated from the cover sheet.

9. The bookmaking apparatus according to claim 8, further comprising a roller unit configured to convey the cover sheet in a direction opposite to the conveyance direction, the roller unit including a stopper member operable to hold the cover sheet when the shifting device shifts to a direction intersecting the conveyance direction.

10. The bookmaking apparatus according to claim 9, wherein the shifting device is set to a shifting position of the aligning unit using cover sheet size information and information from at least one of a plurality of sensors arranged in the shifting direction of the aligning unit.

11. The bookmaking apparatus according to claim 1, wherein the first aligning device comprises an aligning unit configured to engage the cover sheet and touch a trailing edge of the cover sheet;

the second aligning device comprises a shifting device for shifting the aligning unit in a direction orthogonal to the conveyance direction; and the offset conveyance device is arranged at a downstream side of the aligning unit, and is configured to move between a first position touching the cover sheet, and a retracted position separated from the cover sheet.

12. The bookmaking apparatus according to claim 11, further comprising a roller unit configured to convey the cover sheet in a direction opposite to the conveyance direction, the roller unit including a stopper member operable to hold the cover sheet when the shifting device shifts to a direction intersecting the conveyance direction.

13. The bookmaking apparatus according to claim 12, wherein the shifting device is set to a shifting position of the aligning unit using cover sheet size information and information from at least one of a plurality of sensors arranged in the shifting direction of the aligning unit.

14. The bookmaking apparatus according to claim 1, further comprising:

a thickness detection device disposed on the sheet bundle conveyance device, wherein the sheet bundle conveyance device further comprises clamping members operable to open and close in order to grip the sheet bundle, and the thickness detection device is operable to calculate an opening amount of the clamping members, and the operation device calculates the conveyance amount based on information from the thickness detection device.

15. An image forming apparatus comprising:

an image forming device for forming images on a sheet;

a tray device for stacking in a bundle of sheets from the image forming device; and the bookmaking apparatus according to claim 1, operable to stack the sheet bundle in a booklet shape.

* * * * *